US005541714A

United States Patent [19]

Watanabe et al.

[11] Patent Number: 5,541,714

[45] Date of Patent: Jul. 30, 1996

[54] DEVELOPER CARTRIDGE AND IMAGE FORMING APPARATUS USING THE SAME

[75] Inventors: Mamoru Watanabe, Kawasaki; Michihiro Fujii, Hyogo; Hideyuki Nanba; Masato Kawashima, both of Kawasaki, all of Japan

[73] Assignee: Fujitsu Limited, Kawasaki, Japan

[21] Appl. No.: 60,971

[22] Filed: May 13, 1993

[30] Foreign Application Priority Data

May 18, 1992 [JP] Japan ..... 4-124424
Jun. 30, 1992 [JP] Japan ..... 4-173131

[51] Int. Cl.[6] ..... G03G 15/06

[52] U.S. Cl. ..... 355/260; 355/200; 355/245

[58] Field of Search ..... 355/200, 210, 355/245, 260, 298; 222/DIG. 1

[56] References Cited

U.S. PATENT DOCUMENTS

| | | | |
|---|---|---|---|
| 4,565,435 | 1/1986 | Hart . | |
| 4,768,055 | 8/1988 | Takamatsu et al. | 355/298 |
| 5,101,237 | 3/1992 | Molloy | 355/245 |
| 5,109,254 | 4/1992 | Oka et al. | 355/200 |
| 5,121,168 | 6/1992 | Aoki et al. | 355/298 |
| 5,243,390 | 9/1993 | Takemoto et al. | 355/245 |
| 5,307,128 | 4/1994 | Murasaki et al. | 355/260 |

FOREIGN PATENT DOCUMENTS 4-118675 4/1992 Japan .

OTHER PUBLICATIONS

M. Watanabe et al. U.S. Ser. No. 08/080,209 Jun. 23, 1993, Fujitsu Limited.

*Primary Examiner*—Sandra L. Brase
*Attorney, Agent, or Firm*—Staas & Halsey

[57] ABSTRACT

The invention relates to a developer cartridge for exchanging developers in an apparatus which develops an electrostatic latent image, and an image forming apparatus using the developer cartridge. The developer cartridge has a first storage room for unused developer, a second storage room under the first room for storing used developer, openings in the first and second rooms and shutters provided therewith, together with a paddling mechanism in the first storage room for moving unused developer. The image forming apparatus has an endless latent carrier, a mechanism for forming an electrostatic latent image on the carrier and a mechanism for developing the latent image on the carrier. The developer cartridge is detachable positioned to the developing mechanism and a mechanism is provided for driving the shutters of the developer cartridge for exchanging used developer with unused developer.

47 Claims, 42 Drawing Sheets

DEVELOPER CARTRIDGE AND IMAGE FORMING APPARATUS USING THE SAME

BACKGROUND OF THE INVENTION

1. Field of the Invention

The present invention relates to a developer cartridge for exchanging developers in a developing apparatus which develops an electrostatic latent image, and an image forming apparatus using this developer cartridge.

2. Description of the Related Art

In an image forming apparatus such as a copying machine, a printer or a facsimile etc, an electrostatic latent image is formed on a latent image carrier like a photosensitive drum. A developing apparatus is used to develop an electrostatic latent image with a developer. A typical developer used in the developing apparatus is composed of two components, toner and carrier. As the toner in this developer is consumed in a developing process, the toner should be supplemented. Further, the developer in the developing apparatus is deteriorated with the passage of time so that the quality of an image becomes lower. It is therefore necessary to exchange the old developer with a new one. Recently, this exchange is often conducted by the user of the image forming apparatus. In this respect, there is a demand for an image forming apparatus designed to facilitate the developer exchange without making the operator's hands dirty.

In general, the developer exchange is conducted as follows. A developer cartridge containing an unused developer and an empty collecting cartridge for collecting the developer in the developing apparatus are placed in the developing apparatus. Then, after the developer in the developing apparatus is collected in the collecting cartridge, the unused developer is supplied into the developing apparatus from the developer cartridge. This method involves two cartridges, thus complicating the exchange.

For example, U.S. Pat. No. 5,109,254 proposed a developer cartridge having those two cartridges designed as a single cartridge to ensure automatic exchange of developers. In the proposed method, a developer exchanging section is provided on a side of the developing apparatus. The developer cartridge comprises a cylindrical portion, a developer storage room which is located above the cylindrical portion and where an used developer is retained, and a collecting room located under the cylindrical portion. This developer cartridge is placed in the developer exchanging section of the developing apparatus. More specifically, the cylindrical portion of the developer cartridge is fitted in the developer exchanging section of the developing apparatus.

When the shutter of the collecting room of the developer cartridge is open, the used developer in the developing apparatus falls into the collecting room from the developer exchanging section. Then, the shutter of the collecting room is closed and the shutter of the developer storage room is open. As a result, the unused developer in the developer storage room falls into the developer exchanging section to be supplied into the developing apparatus. The developer in the developing apparatus is exchanged with an used developer in this manner.

This method is effective when there is a small amount of the developer to be exchanged. When there is a large amount of the developer to be exchanged, however, it is necessary to make the developer storage room and collecting room of the developer cartridge longer. In this case, the developer cartridge inevitably becomes larger in length. This makes the handling of the developer cartridge troublesome, and requires extra space for storage of such developer cartridges. It is also necessary to provide extra space for placing the developer cartridge in the developing apparatus. In addition, as the developer exchanging section of the developing apparatus is used only for developer exchange, it is cost effective to make this section smaller. But, it is troublesome to conduct the developer exchange in the small exchanging space.

SUMMARY OF THE INVENTION

It is therefore an object of the present invention to provide a developer cartridge designed to ensure the exchange of developers using a smaller cartridge, and an image forming apparatus using this developer cartridge.

It is another object of the present invention to provide a developer cartridge designed to ensure the exchange of developers using free space in an apparatus where the cartridge is used, and an image forming apparatus using this cartridge.

It is a further object of the present invention to provide a developer cartridge designed to shorten the exchange of developers, and an image forming apparatus using this cartridge.

To achieve the foregoing objects, there is provided a developer cartridge for exchanging developers, which comprises a first developer storage room for storing an unused developer; a second developer storage room located under the first developer storage room for storing a used developer; openings respectively formed in the first and second developer storage rooms; shutters respectively provided at the openings; and a paddling member disposed in the first developer storage room for paddling the unused developer in the first developer storage room.

With this structure, as the unused developer in the first developer storage room can be supplied into the developing apparatus with the paddling member, the second developer storage room can be provided directly under the first developer storage room. This design can make the developer cartridge smaller. Accordingly, it is easy to handle the developer cartridge and is possible to reduce the space for developer exchange.

In a preferable embodiment, the second developer storage room of the developer cartridge has a projecting portion where the opening and shutter are provided. This design can allow the used developer to fall into the second developer storage room from the developing apparatus to which the developer cartridge is attached, due to the dead weight.

According to another embodiment, the developer cartridge has a conveying screw provided below the opening of the projecting portion of the second developer storage room to supply the developer into the second developer storage room. This design can permit the used developer to be effectively stored in the second developer storage room even if the developer cartridge is made smaller.

According to a further embodiment, the second developer storage room of the developer cartridge has a bottom inclined to the face of the projecting portion where the opening and shutter are provided. This design can permit the used developer coming through the opening to further enter deeper into the second developer storage room due to the dead weight, thus preventing the developer from clogging at the opening portion.

According to a still further embodiment, the first developer storage room of the developer cartridge has a circular cross section and the opening of the first developer storage room is formed at the obliquely lower portion of the circular cross section. This design can allow the unused developer in the first developer storage room to be smoothly supplied into the developing apparatus.

To achieve the foregoing objects, there is provided an image forming apparatus comprising an endless latent carrier; means for forming an electrostatic latent image on the endless latent carrier; a developing means for developing the electrostatic latent image on the endless latent carrier; a developer cartridge detachably attached to the developing means for exchanging developers, and having a first developer storage room for storing an unused developer, a second developer storage room located under the first developer storage room for storing a used developer, openings respectively formed in the first and second developer storage rooms, shutters respectively provided at the openings, and a paddling member disposed in the first developer storage room for paddling the unused developer in the first developer storage room; and drive means for driving the shutters of the attached developer cartridge, for exchanging a used developer with an unused developer.

Other features and advantages of the present invention will be apparent from the following description taken in conjunction with the accompanying drawings.

DETAILED DESCRIPTION OF THE PREFERRED EMBODIMENTS

A preferred embodiment of the present invention will now be described referring to the accompanying drawings.

Figure 1:
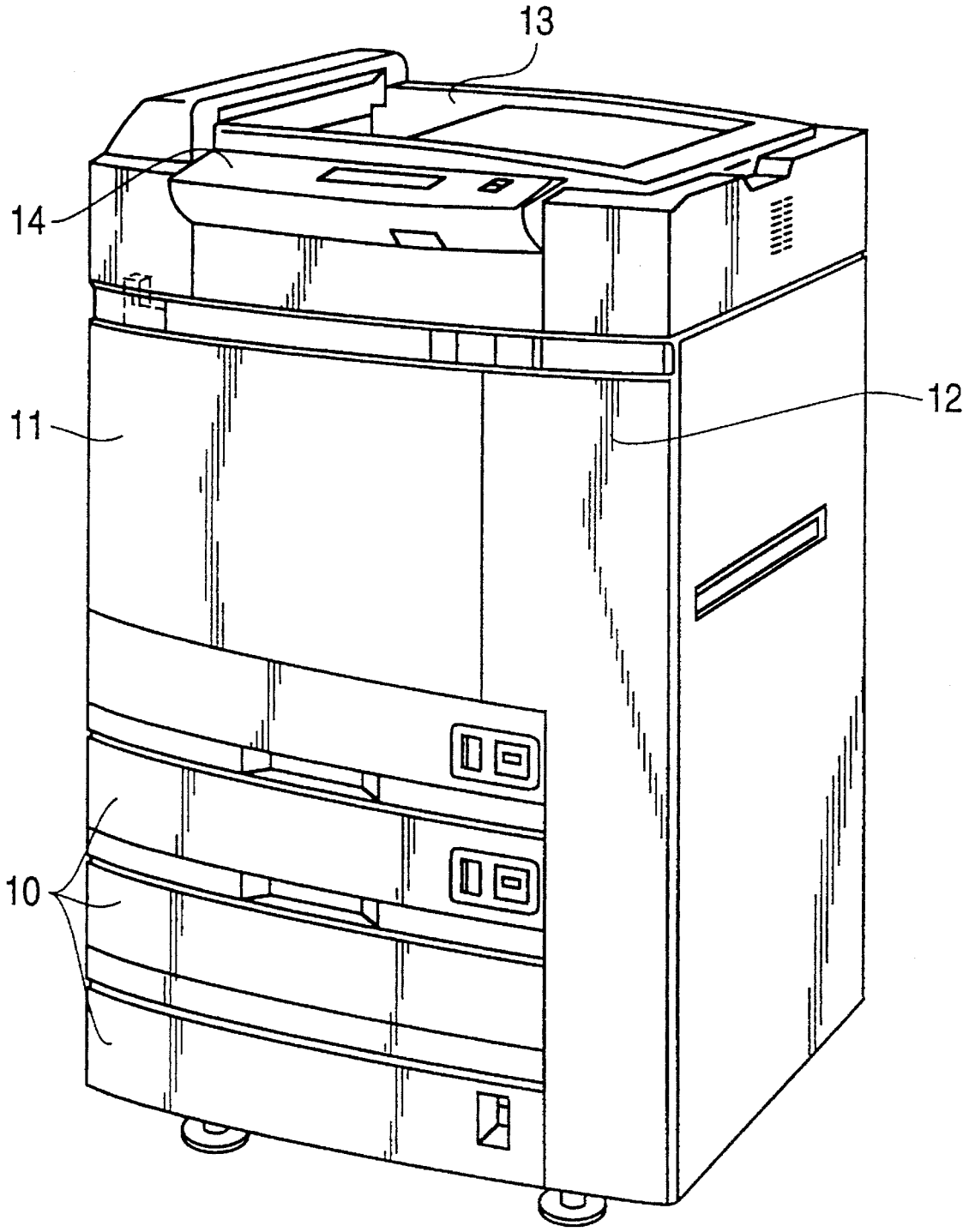
FIG. 1 is a diagram showing the outline of a printing machine according to one embodiment of the present invention.
Figure 2:
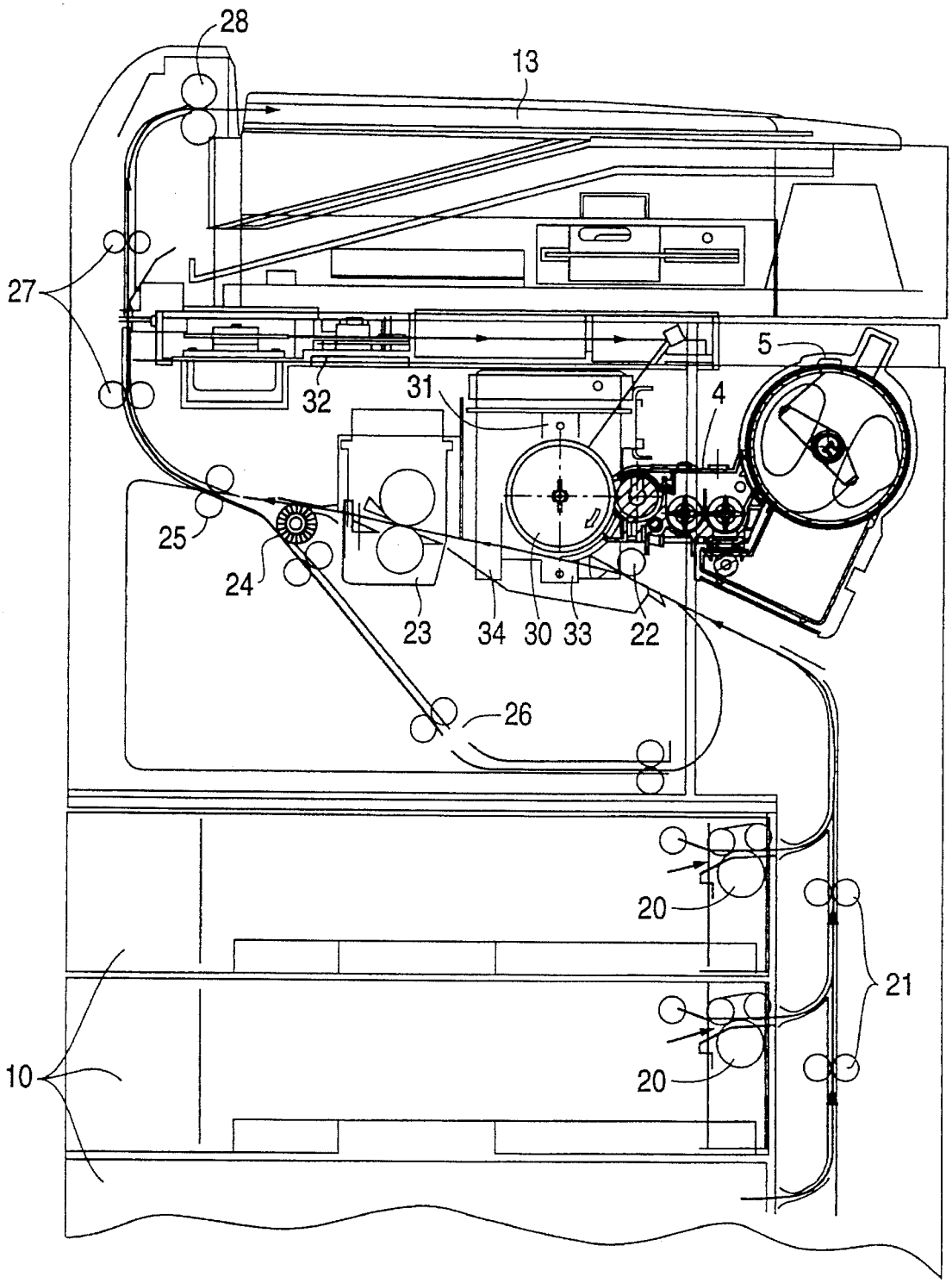
FIG. 2 is a diagram illustrating the structure of the printing machine in FIG. 1.
Figure 3:
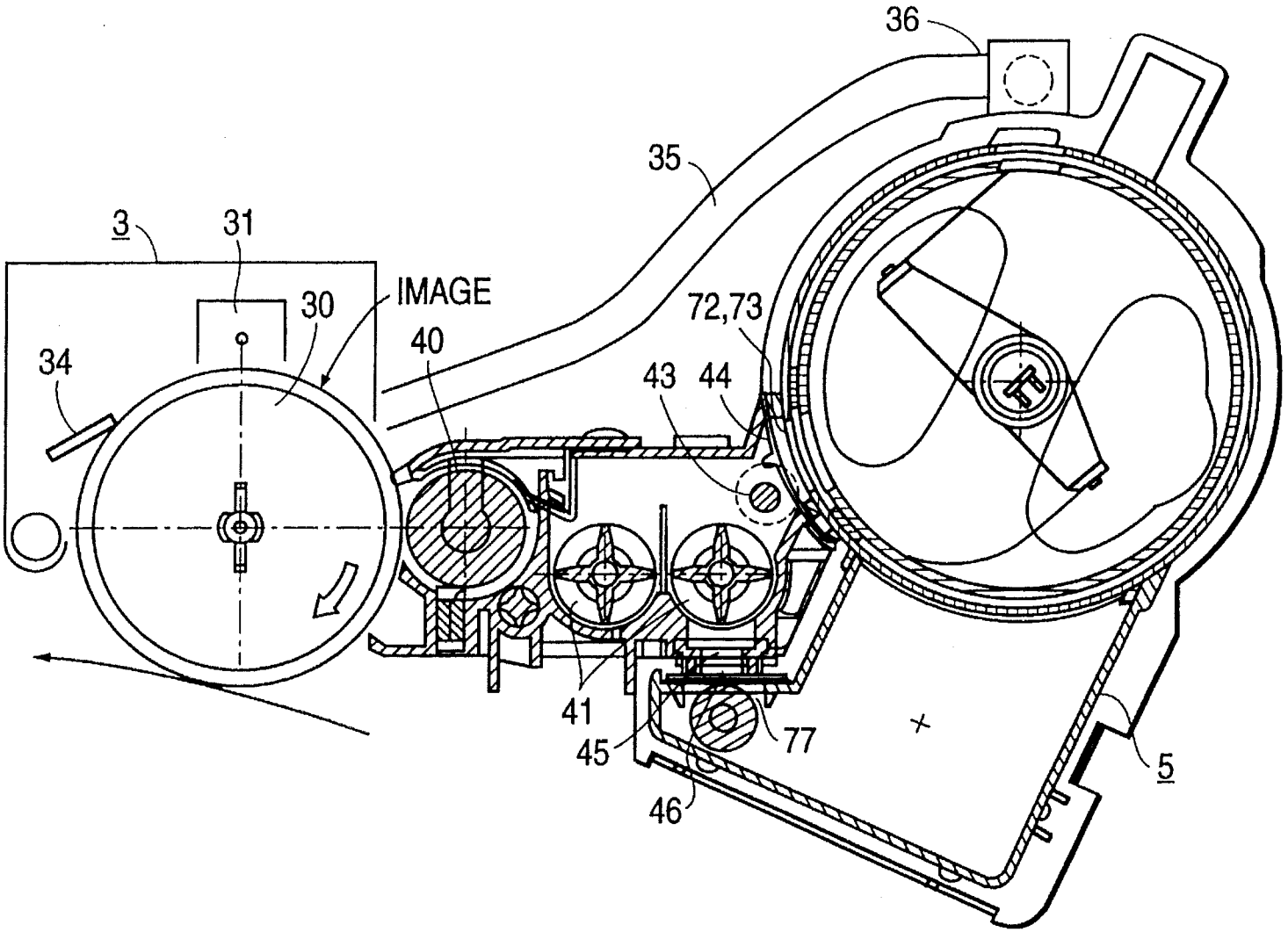
FIG. 3 is a diagram showing the arrangement of the essential portions in the structure of FIG. 2.

FIG. 1 illustrates the outline of a printing machine according to one embodiment of the present invention, FIG. 2 illustrates the structure of the printing machine in FIG. 1, and FIG. 3 shows the arrangement of the essential portions in the structure of FIG. 2.

As shown in FIG. 1, an image forming apparatus is constituted of a printing machine. This printing machine includes three paper cassettes 10 for retaining printing sheets, left and right doors 11 and 12 of a print mechanism shown in FIG. 2, a stacker 13 provided at an upper portion for retaining printed sheets, and an operation panel 14 for operating the printing machine. As shown in FIG. 2, the print mechanism has a rotatable photosensitive drum 30, a precharger 31 for electrifying the photosensitive drum 30, a laser optical unit 32 which writes a light image on the photosensitive drum 30 to form a latent image thereon, a developing apparatus 4 for developing the latent image on the photosensitive drum 30 with a toner, a transfer/separating unit 33 for transferring a toner image of the photosensitive drum 30 onto a sheet to be fed and separating this sheet, and a cleaner 34 for cleaning the photosensitive drum 30 after the image transfer. A developer cartridge 5 is attached to this developing apparatus 4 for collecting the developer, supplying the developer, supplementing a toner and collecting a waste toner.

A paper feeding system has pick rollers 20 for picking sheets in the sheet cassettes 10, feed rollers 21 for feeding picked sheets to a hold roller 22, and a heat roller fixing apparatus 23 for thermally fixing the sheet after the toner-image transfer. This paper feeding system also has a blade wheel 24 for directing the rear end of the sheet from the heat roller fixing apparatus 23 toward a back-printing feeding passage 26, switchback rollers 25 for feeding the sheet from the heat roller fixing apparatus 23 in the discharging direction and then feeding that sheet to the back-printing feeding passage 26, guide rollers 27 for guiding the ejection of the sheet, discharge rollers 28, the stacker 13 for retaining the ejected sheet, and the back-printing feeding passage 26 for feeding the sheet from the switchback rollers 25 to the hold roller 22 using feed rollers.

The operation of this printing machine will be described below. After the photosensitive drum 30 is electrified by the precharger 31, a light image is written on the drum 30 by the optical system unit 32 to form a latent image thereon. Then, the photosensitive drum 30 is developed to have a toner image by the developing apparatus 4. In the meantime, the printing sheet is picked up from the associated sheet cassette 10 by the pick rollers 20, and is fed to the hold roller 22 by the feed rollers 21. This sheet is held by the resist roller 22 to be in synchronism with the toner image on the photosensitive drum 30.

The transfer/separating unit 33 transfers the toner image of the photosensitive drum 30 onto the sheet fed by the hold roller 22, and then separates the sheet from the photosensitive drum 30. After the toner image is fixed by the heat roller fixing apparatus 23, the sheet is fed toward the switchback rollers 25. Further, the sheet is fed toward the stacker 13 by the switchback rollers 25. When the rear end of the sheet reaches the blade wheel 24, the switchback rollers 25 stop feeding the sheet. When the feeding of the sheet is stopped, the rear end of the sheet is directed toward the back-printing feeding passage 26 by the counterclockwise rotation of the blade wheel 24. The switchback rollers rotate in the reverse direction to feed the sheet to the back-printing feeding passage 26. The sheet is further fed to the resist roller 22 by the feed rollers of the back-printing feeding passage 26.

Thereafter, the transfer/separating unit 33 transfers the toner image of the photosensitive drum 30 on the back of the sheet and separates it from the photosensitive drum 30 as per the front printing of the sheet. After the toner image is fixed by the heat roller fixing apparatus 23, the sheet is fed toward the switchback rollers 25. Further, the sheet is fed toward the stacker 13 by the switchback rollers 25, and is discharged on the stacker 13 by discharge rollers 28. Double-side printing is performed on the sheet in this manner. For single-side printing, the sheet is discharged on the stacker 13 after printing is done only on the top surface of the sheet.

In this printing machine, the sheet cassettes 10 are mounted into the machine from the front and the sheet is discharged onto the overlying stacker 13 as shown in FIG. 1. This design requires no space on either side of the machine, thus making it possible to reduce the space. Further, as the discharging passage is used in the switchback path, the double-side printing machine can be made compact.

Referring to FIG. 3, the developing apparatus 4 and the developer cartridge (hereinafter called "cartridge") 5 will be described. The developing apparatus 4 has a developing roller 40, which rotates counterclockwise to supply the developer to the photosensitive drum 30, a pair of stirring screws 41 for stirring the developer, which is comprised of toner and carrier, a collecting blade 48 for scraping the developer off the developing roller 40 and returning the scraped developer back to the stirring screws 41, and a toner supply roller 43 for supplying a toner into the developing apparatus 4. Further, an injection port 44 for receiving the developer and toner from the cartridge 5. This injection port 44 faces outlet ports 72 and 73 of the cartridge 5, which will be described later. Provided below the stirring screws 41 of the developing apparatus 4 are a discharge port 45 for discharging the developer and a discharge shutter 46 which covers the discharge port 45. The discharge port 45 and discharge shutter 46 face a collecting section 77 of the cartridge 5.

This cartridge 5 is positioned opposite the photosensitive drum 30 of the developing apparatus 4. Therefore, it is possible to dispose only the developing apparatus 4 in the space around the photosensitive drum 30 and arrange the cartridge 5 in the free space therearound. It is thus unnecessary to provide space for the cartridge 5 in the narrow space around the photosensitive drum 30, contributing to making the image forming apparatus compact. As the cartridge 5 is placed in the free space, a relatively large cartridge 5 can be installed. Further, the cartridge 5 is disposed by the developing apparatus 4, the cartridge 5 can be made smaller.

The photosensitive drum 30, the precharger 31 and the cleaner 34 are assembled into a single drum unit 3, and are detachable from the apparatus. Connected to the lower portion of the cleaner 34 is a waste toner carrying pipe 35 for conveying the residue toner (waste toner) on the photosensitive drum 30 removed by the cleaner This pipe 35 is connected to a waste toner discharging section 38 provided at the upper portion of the cartridge 5 to discharge the waste toner to the cartridge 5.

This design allows for the supply of the developer and the supplement of the toner to the developing apparatus 4. In addition, it is possible to collect the developer from the developing apparatus 4 to the cartridge 5 as well as to collect the waste toner from the cleaner 34 to the cartridge 5.

Figure 4:
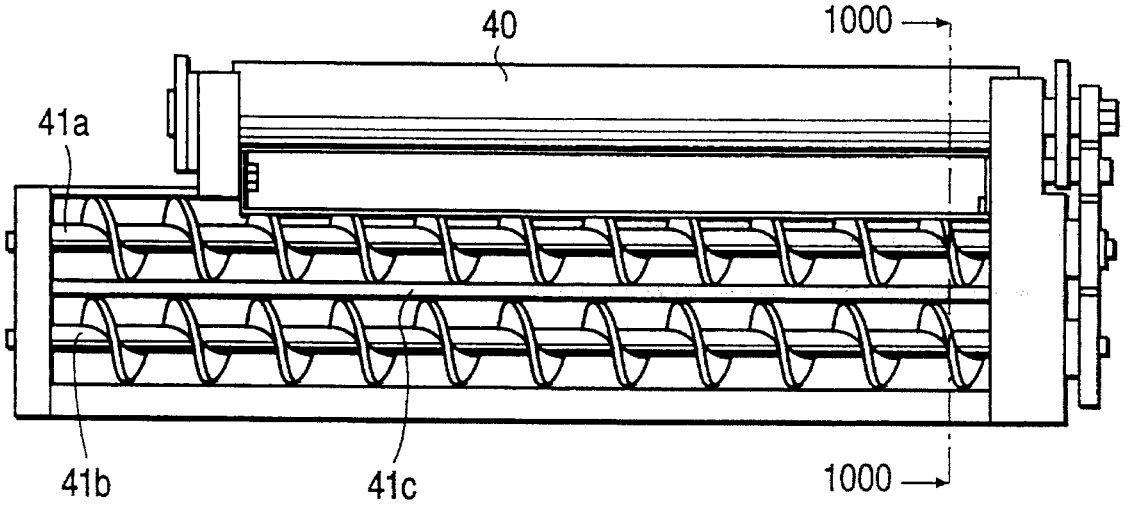
FIG. 4 is a top cross section of a developing apparatus shown in FIG. 3.
Figure 6:
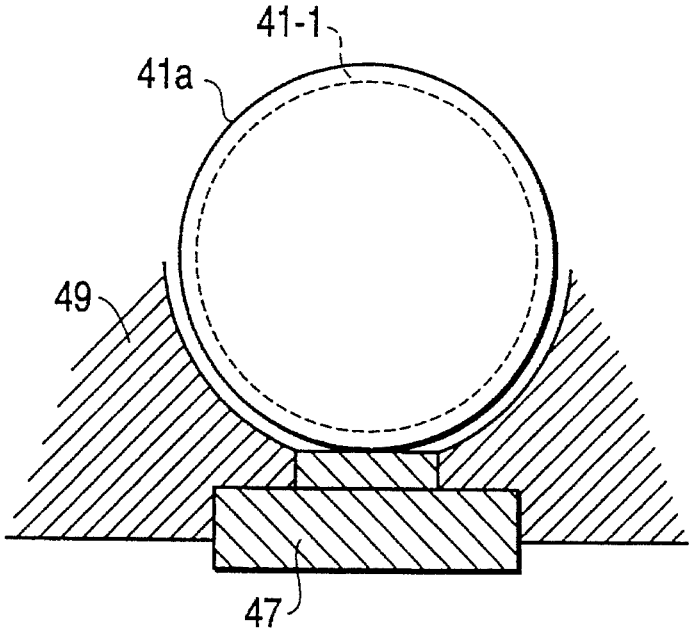
FIG. 6 is a diagram showing the relationship between a stirring screw and a toner density sensor in the developing apparatus shown in FIG. 4.
Figure 7A:
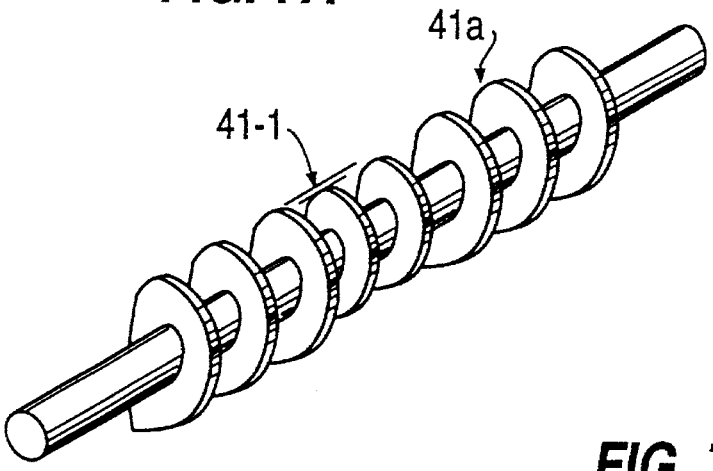
FIG. 7A is a perspective view of the stirring screw in FIG. 6.
Figure 7B:
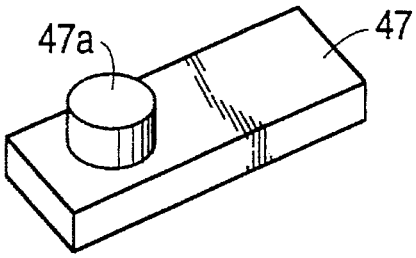
FIG. 7B is a perspective view of the toner density sensor in FIG. 6.

The developing apparatus 4 will be described more specifically. FIG. 4 is a top view of the developing apparatus, FIG. 5 is a cross section taken along the line 1000—1000 in FIG. 4, FIG. 6 is an explanatory diagram of a toner density sensor, FIG. 7A is a perspective view of the stirring screw, and FIG. 7B is a perspective view of the toner density sensor.

As shown in FIG. 4, a pair of stirring screws 41*a* and 41*b* are each constituted of a spiral screw. The stirring screws 41*a* and 41*b* rotate in the opposite directions. A partition 41*c* is provided between the stirring screws 41*a* and 41*b*. The stirring screw 41*b* stirs the developer while conveying it rightward in the diagram. The developer conveyed by the stirring screw 41*b* gets over the partition 41*c* onto the stirring screw 41*a*. The stirring screw 41*a* stirs the developer while conveying the developer leftward in the diagram to supply it to the developing roller 40. This design permits the developer to be sufficiently stirred and minimizes the developer that will not be stirred. This design is indicated by PCT application No. JP92/01452 dated Nov. 9, 1992.

Figure 5:
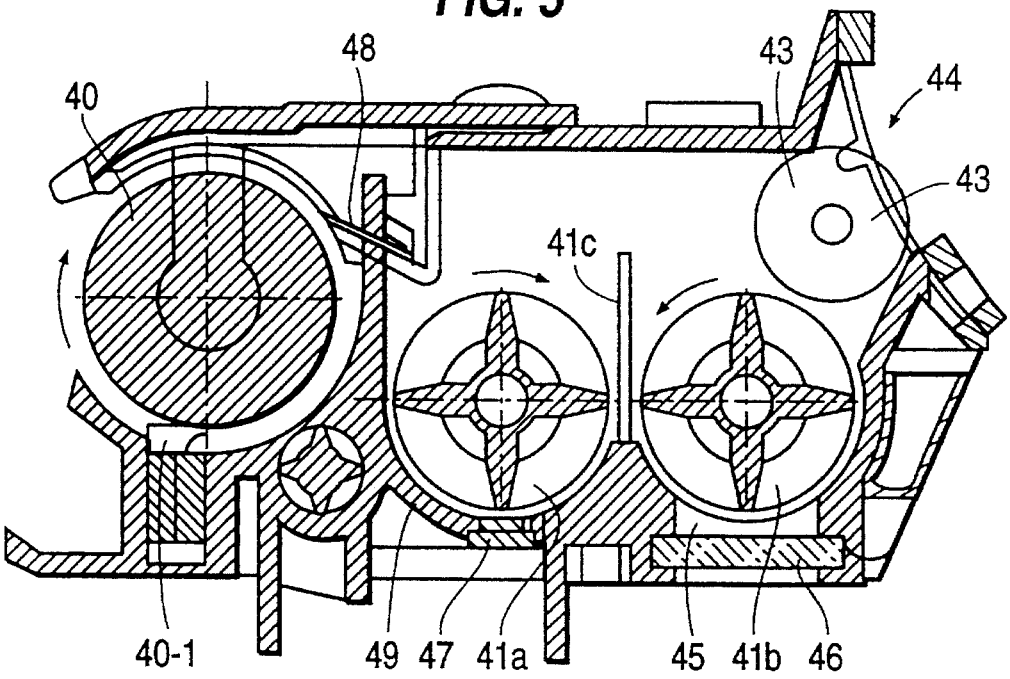
FIG. 5 is a cross section taken along the line 1000—1000 FIG. 4.

As shown in FIG. 5, those portions of a container 49 of the developing apparatus 4 which correspond to the stirring screws 41*a* and 41*b* are each formed into a U shape. Accordingly, the developer that will not be stirred can be minimized. At the time the developer is collected, the developer in the developing apparatus 4 is discharged from the discharge port 45 by the conveying force of the stirring screws 41*a* and 41*b*. As the bottom of the container 49 has a U shape, the developer that will not be discharged can be minimized, so that the efficiency of exchanging developers can be improved.

Figure 8:
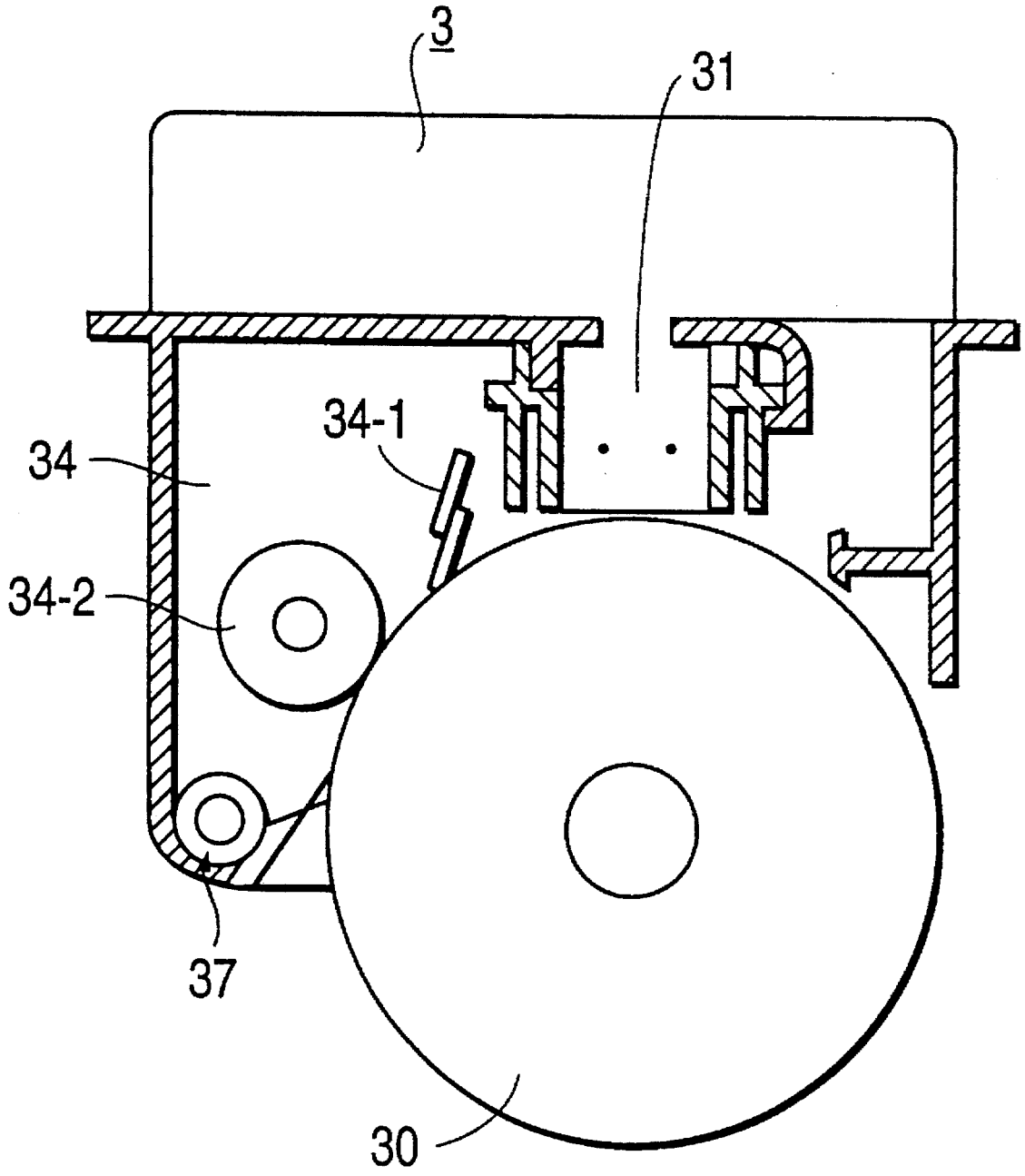
FIG. 8 is a front cross section of a drum unit shown in FIG. 3.
Figure 11:
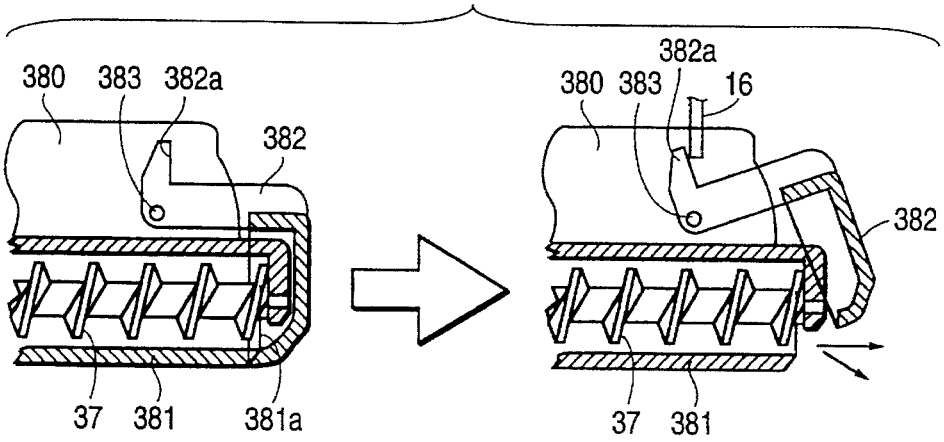
FIG. 11 is a diagram for explaining the operation of the waste toner collecting mechanism shown in FIGS. 10A and 10B.
Figure 12:
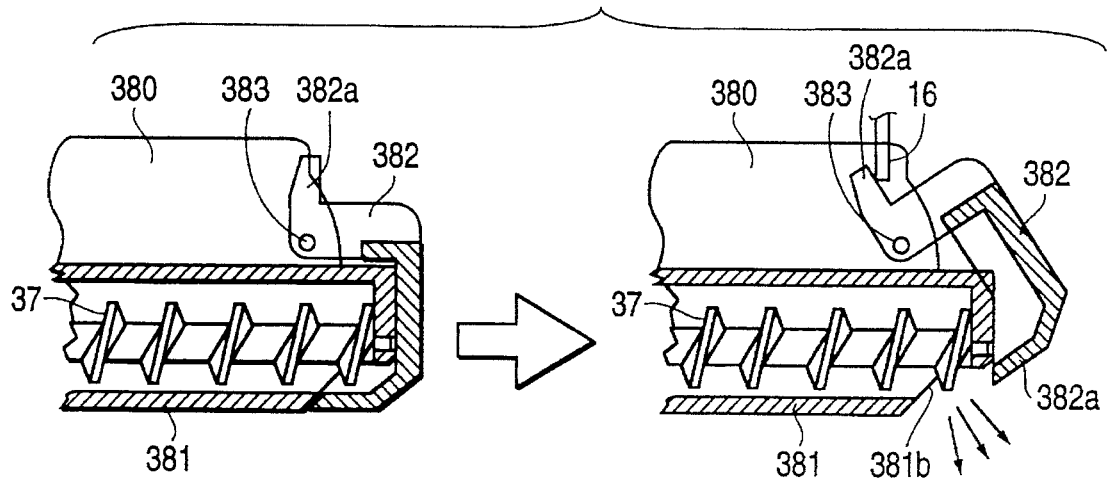
FIG. 12 is an explanatory diagram of a modification of the waste toner collecting mechanism shown in FIG. 9.
Figure 13:
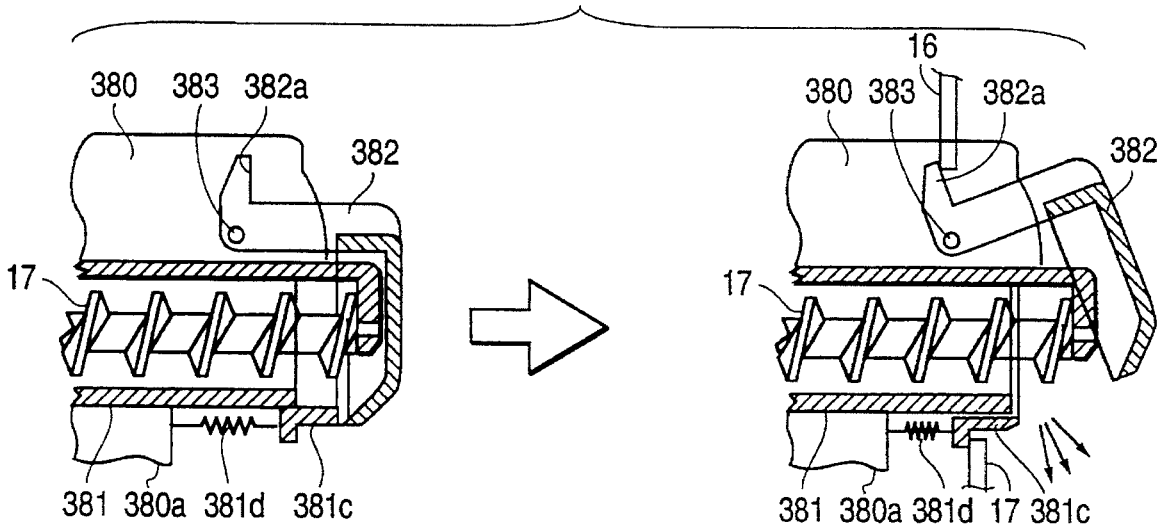
FIG. 13 is an explanatory diagram of another modification of the waste toner collecting mechanism shown in FIG. 9.

The developing roller 40 has a fixed magnetic roller and a rotatable sleeve on which a magnetic brush is formed. The height of the magnetic brush on the sleeve is restricted by a doctor blade 40-1. Below the stirring screw 41*a* is provided a toner density sensor 47 shown in FIG. 7B. This toner density sensor 47, constituted of a magnetic sensor, detects the toner density of the developer. The reason why the toner density sensor 47 is provided there is to sense the toner density near the developing roller 40 so that the toner density on the developing roller 40 can be detected accurately. As shown in FIG. 6, the toner density sensor 47 is attached so that its upper end will not be positioned below the U-shaped bottom of the container 49. In general, the toner density sensor 47 is attached slightly below the bottom of the container 49 in order to avoid a contact with the stirring screw 41*a*. In this case, however, the developer stays in the clearance between the bottom of the container 49 and the sensor 47, and the toner density cannot be detected accurately. In this respect, the toner density sensor 47 is attached so that its upper end is not positioned below the U-shaped bottom of the container 49. The toner density sensor 47 in this arrangement may contact the stirring screw 41a. To avoid this problem, that outer surface of the stirring screw which faces the toner density sensor 47 is cut so that the screw 41*a* will not hit against the top end of the toner density sensor A description will now be given of the drum unit. FIG. 8 is a front view of the drum unit shown, FIG. 9 is a side view of the drum unit, FIG. 10A is a front view of a waste toner collecting mechanism shown, FIG. 103 is a side view of the toner collecting mechanism, FIG. 11 is a diagram for explaining the operation of the toner collecting mechanism, FIG. 12 is an explanatory diagram of a modification of the toner collecting mechanism, and FIG. 13 is an explanatory diagram of another modification of the toner collecting mechanism.

As shown in the front view of FIG. 8, the drum unit 3 has the photosensitive drum 30, the precharger 31 and the cleaner 34 assembled as a single unit. The cleaner 34 has a scraping blade 34-1 for scraping the residue toner off the photosensitive drum 30, a cleaning roller 34-2 that rotates to remove the residue toner on the photosensitive drum 30, and a waste toner discharging screw 37 for discharging the toner, removed by the blade 34-1 and roller 34-2 and accumulated in the cleaner 34, outside.

Figure 9:
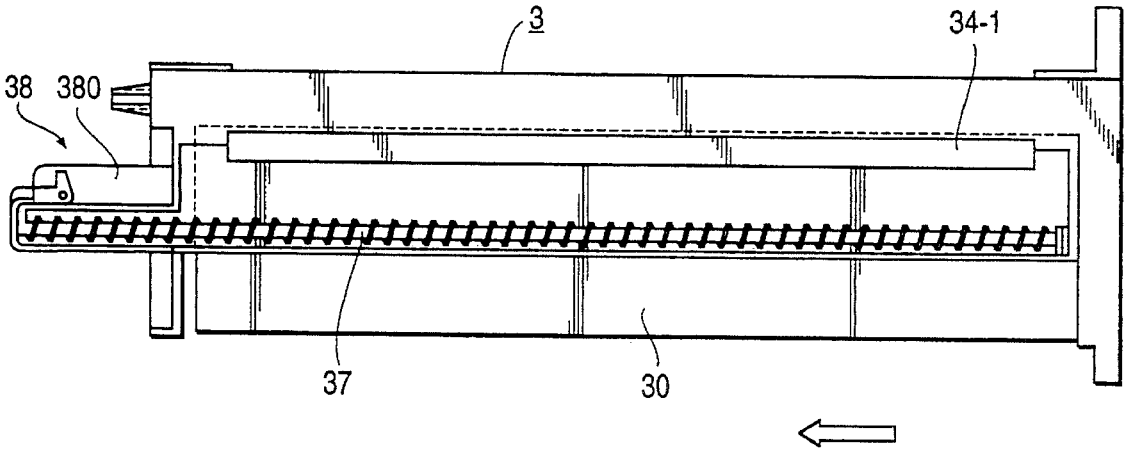
FIG. 9 is a lateral cross section of the drum unit shown in FIG. 8.

As shown in FIG. 9, a toner discharging mechanism 38 is provided at the distal end of the waste toner discharging screw 37 of the cleaner 34 in the drum unit 3. This toner discharging mechanism 38 protrudes from the end portion of the drum unit 3. As shown in FIG. 103, this toner discharging mechanism is provided with a toner discharging pipe 381 provided around the distal end of the discharging screw 37, a protruding block 380 of the drum unit 3, and a cap 382 supported on the protruding block 380 by a pin 383 to cap the distal end of the toner discharging pipe 381.

This cap 382 is provided to cap the distal end of the toner discharging pipe 381 to prevent the toner from leaking from the cleaner 34 when the drum unit 3, detachably attached to the image forming apparatus, is detached therefrom for replacement.

Figure 10B:
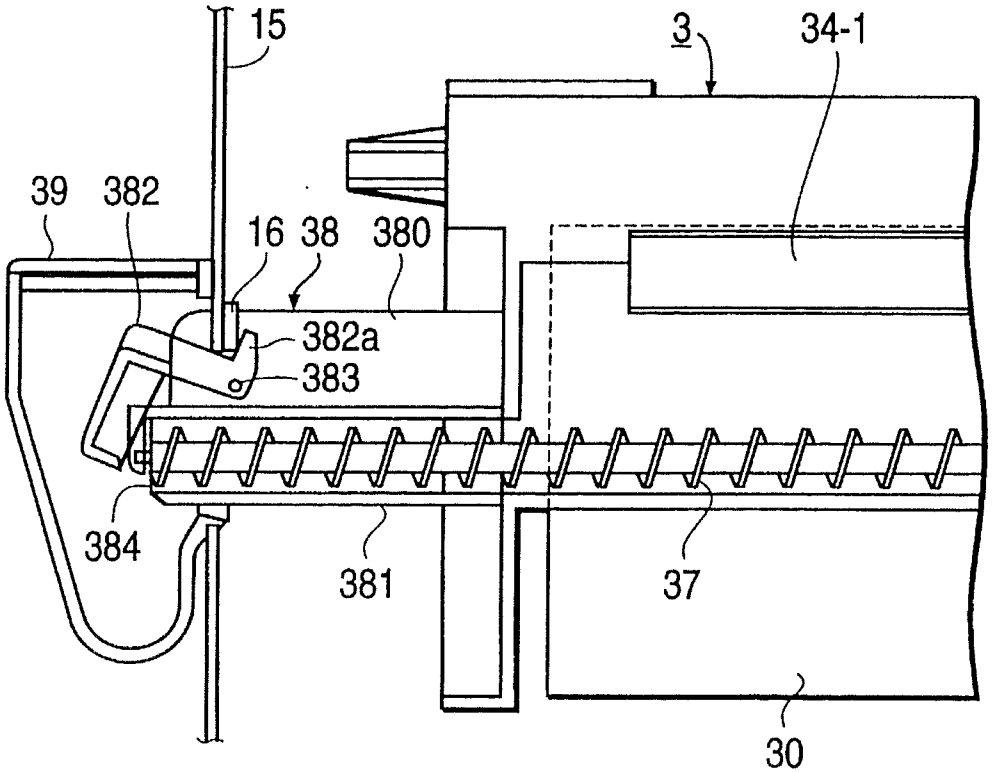
FIG. 10B is a lateral cross section of the waste toner collecting mechanism shown in FIG. 9.
Figure 10A:
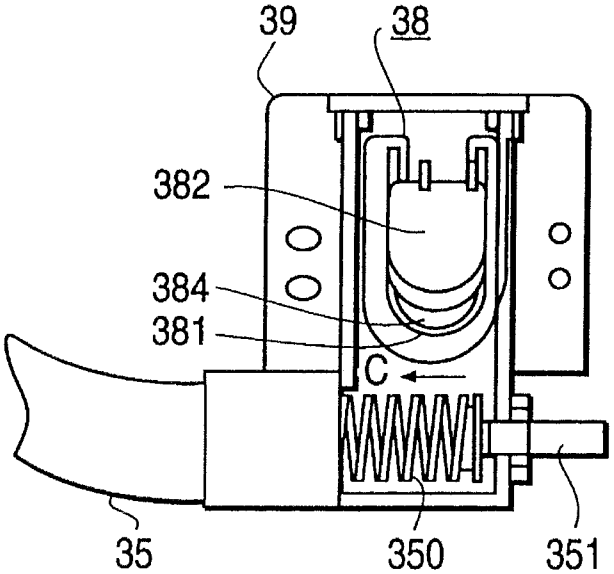
FIG. 10A is a front cross section of a waste toner collecting mechanism shown in FIG. 9.

As shown in FIG. 10B, a frame 15 of the apparatus is provided with a hole where the toner discharging mechanism 38 of the cleaner 34 is inserted, an engaging projection 16 provided at the upper portion of the hole, and a waste toner carrying block 39 so provided as to cover the hole. The waste toner carrying pipe 35, which has been explained with reference to FIG. 3, is connected to the waste toner carrying block 39 as shown in FIG. 10A. Disposed in this pipe 35 is a carrying screw 350 which is rotated by a drive shaft 351.

The toner carrying operation will now be described. The drum unit 3 in FIG. 9 is inserted into the apparatus in the arrow direction in the diagram for its replacement. The toner discharging mechanism 38 of the cleaner 34 enters the hole of the frame 15. Accordingly, an engage lever 382*a* of the cap 382 of the toner discharging mechanism 38 abuts on the engaging projection 16 of the frame 15, thereby rotating the cap 382 around the pin 383, as shown in FIGS. 10A and 10B. As a result, the distal end of the discharging pipe 381 becomes free so that the toner can be discharged from an opened portion 384 by the discharging screw 37. This is illustrated in FIG. 11. As the drum unit 3 is installed, the lower portion of the distal end of the discharging pipe 381 becomes free by the cap 382 to discharge the waste toner from the lower portion 384 of the discharging pipe 381 as shown in FIG. 11. The discharged toner falls in the waste toner carrying block 39 and is carried inside the waste toner carrying pipe 35 by the carrying screw 350 to a waste toner discharging section 36 shown in FIG. 3.

FIG. 12 illustrates a modification of the toner discharging mechanism 38. As shown in FIG. 12, an obliquely cut portion 381*b* is provided at the distal end of the discharging pipe 381 and the cap 382 is provided with a protruding portion 382*a* in this modification. In the embodiment shown in FIG. 11, when the cap 382 is open, only the lower portion of the end face of the discharging pipe 381 is opened. When the toner absorbs water and the fluidity gets lower, the toner will not fall from the aforementioned opened portion 384 and will be carried to the cap 382. As the toner is kept pressed by the cap 382 by the discharging screw 37, the toner sticks firmly on the cap 382. This may clog the discharging pipe 381. In this modification, therefore, the obliquely cut portion 381*b* is provided on the discharging pipe 381 to make the opened portion wider. Accordingly, the toner discharging port becomes wider so that the toner can surely be discharged. Even when the toner absorbs water to reduce the fluidity, it is possible to prevent the toner from firmly sticking on the cap 382.

FIG. 13 illustrates another modification of the toner discharging mechanism 38. This modification has an auxiliary pipe 381*c* provided at the front edge portion of the discharging pipe 381 as shown in FIG. 13. This auxiliary pipe 381*c* is engaged slidable in the axial direction of the discharging pipe 381. The auxiliary pipe 381*c* is connected to a spring 381*d* provided at the protruding block 380*a* of the drum unit.3 and is urged toward the cap 382. Therefore, the auxiliary pipe 381*c* abuts against the cap 382 to accomplish the capping of the discharging pipe 381, as shown in FIG. 13. When the drum unit 3 is installed, the cap 382 is rotated by the engaging projection 16, and the auxiliary pipe 381*c* abuts against another engaging projection 17 provided on the frame 15 to compress the spring 381d and move away from the front end portion of the discharging pipe 381. The opened portion of the discharging pipe 381 becomes wider accordingly. Therefore, the toner discharging port becomes wide to allow the toner to be surely discharged as in the modification of FIG. 12. Even when the toner absorbs water to reduce the fluidity, therefore, it is possible to prevent the toner from firmly sticking on the cap 382.

Figure 14:
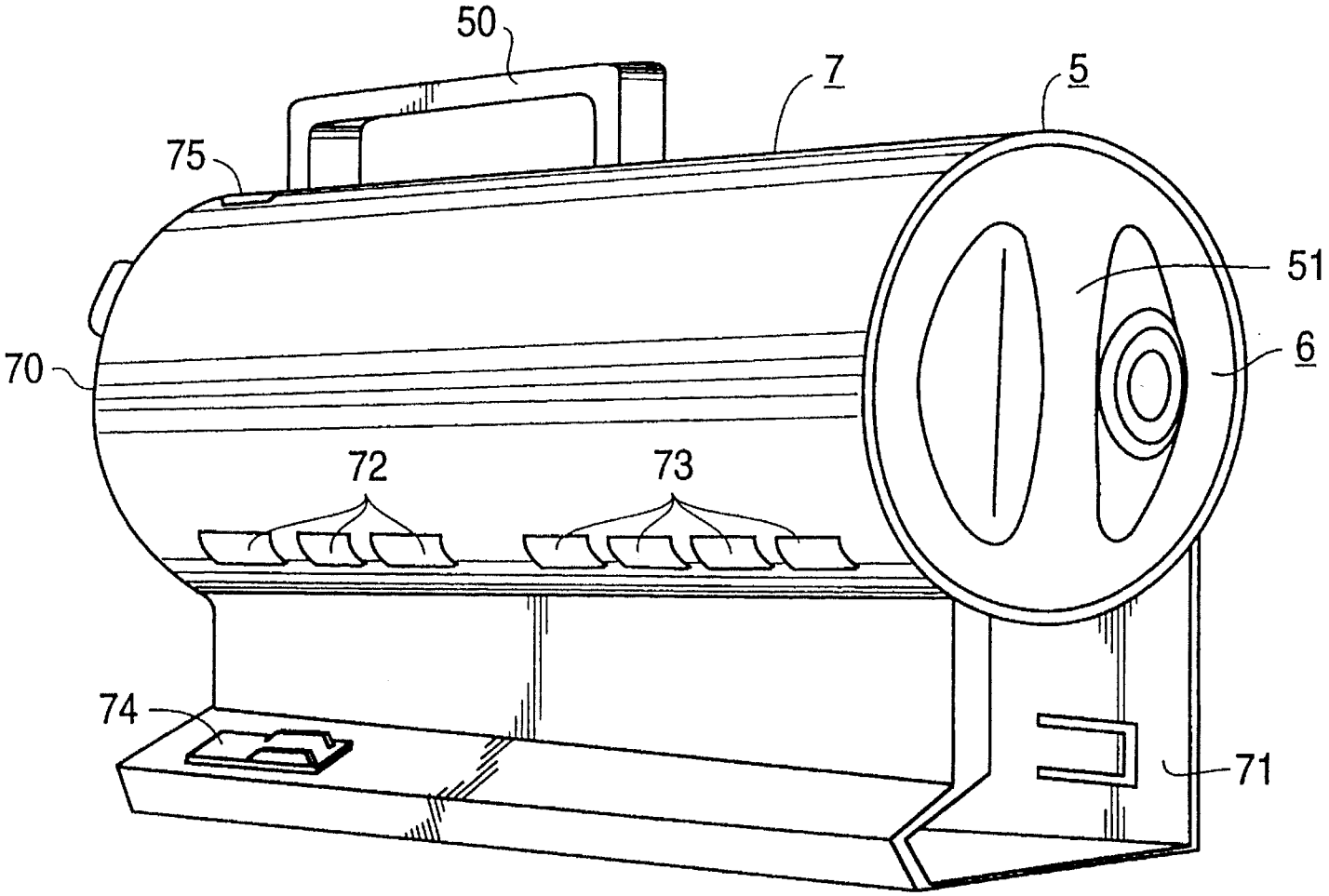
FIG. 14 is a diagram showing the outline of a developer cartridge according to one embodiment of the present invention.
Figure 17:
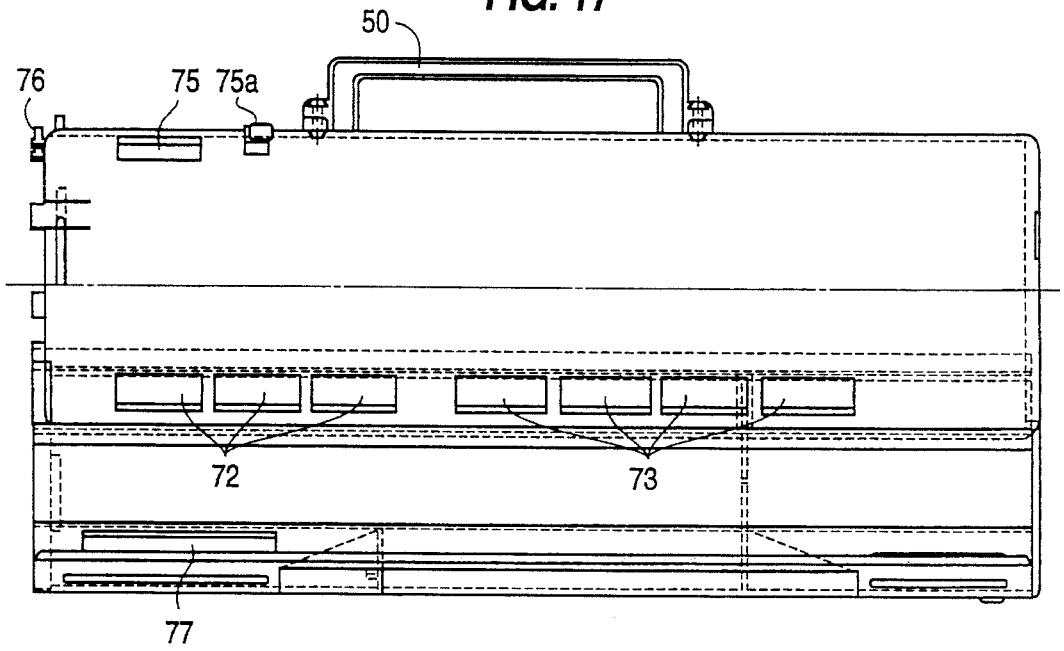
FIG. 17 is a front view of an outer case shown in FIG. 14.
Figure 18:
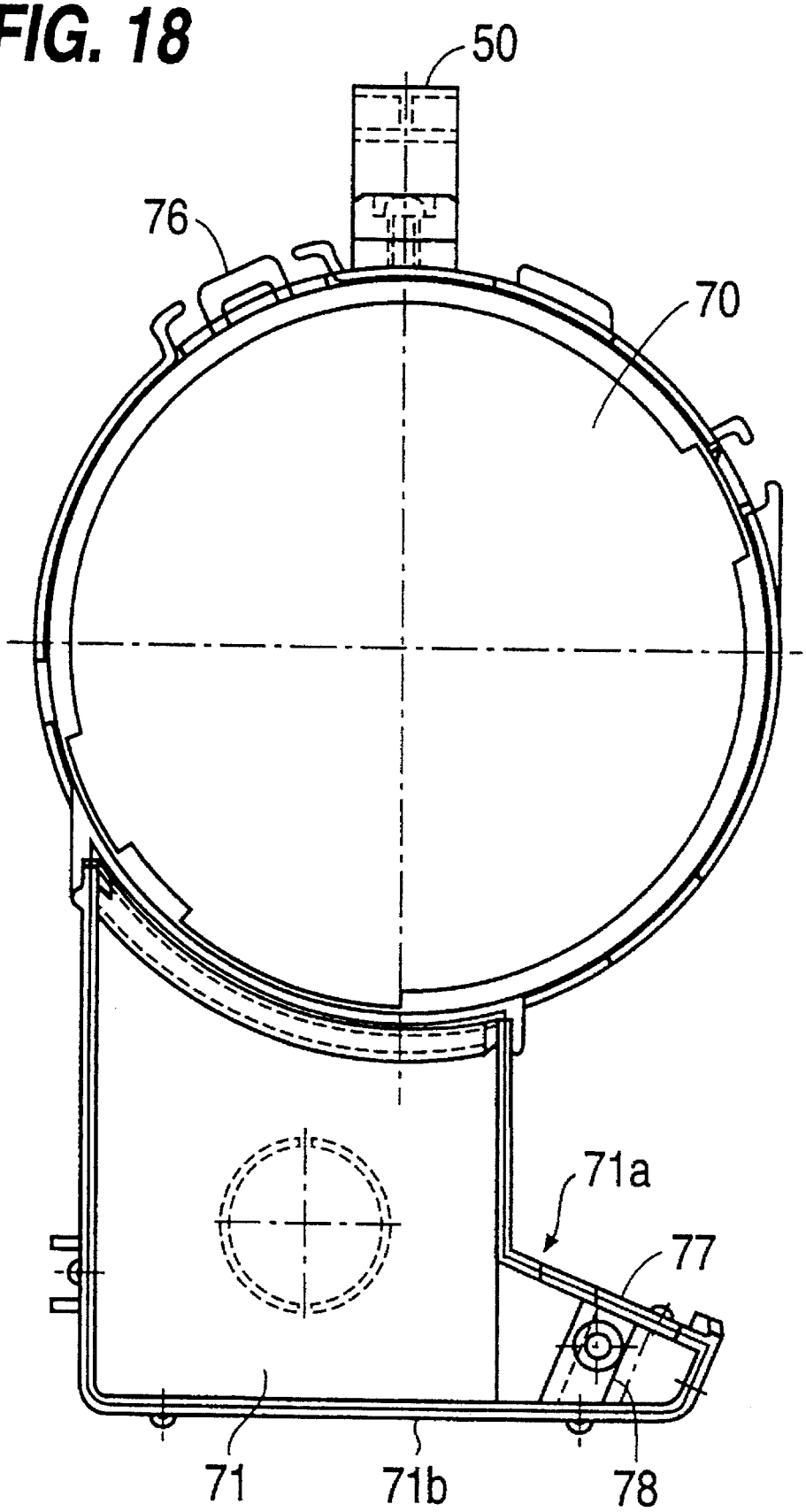
FIG. 18 is a cross-sectional view of the outer case in FIG. 17.

A description will now be given of the aforementioned cartridge. FIG. 14 shows the outline of a developer cartridge according to one embodiment of the present invention, FIG. 15 is a front view of an inner drum of the cartridge, FIG. 16 is an explanatory diagram of the inner drum of the cartridge shown in FIG. 15, FIG. 17 is a front view of an outer case of the cartridge shown in FIG. 17, and FIG. 18 is a cross-sectional view of the outer case of the cartridge shown in FIG. 17.

As shown in FIG. 14, a top handle 51 is provided at the top of the cartridge 5 for easier holding by a human hand, and a side handle 51 is provided on the right-hand side of the cartridge 5 which will be used to manually detach the cartridge 5. The cartridge 5 comprises an inner drum 6 and an outer case 7 having an inner drum retaining section 70 to retain the inner drum 6 and a waste developer storage room 71. This waste developer storage room 71 serves to store the used developer of the developing apparatus 4. The outer case 7 is provided with developer injection ports 72 and toner injection ports 73 at the lower portion of the inner drum 6 retaining section 70, and is provided with a waste toner collecting port 75 at the upper portion of the drum retaining section 70. The waste developer storage room 71 of the outer case 7 is provided with a collecting shutter 74 which covers the collecting port 77.

Figure 15:
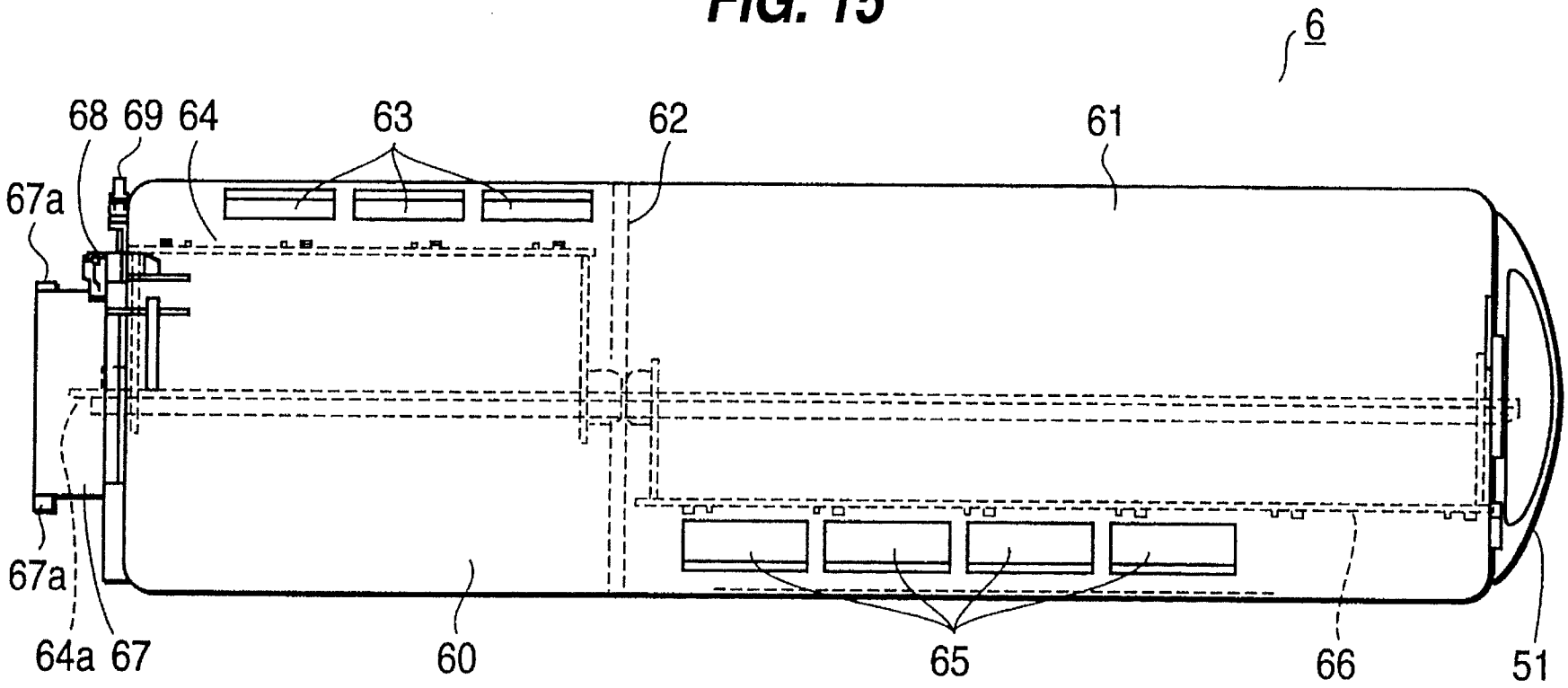
FIG. 15 is a front view of an inner drum of the cartridge shown in FIG. 14.

As shown in FIG. 15, the interior of the inner drum 6 is divided into right and left portions by a partition 62. One is a developer storage room 60 for storing an unused developer, and the other is a toner storage room 61 for storing a supplemental toner. The developer storage room 60 is provided with developer supply ports 63 for discharging the unused developer and a paddle 64 for discharging the developer. The toner storage room 61 is provided with toner supply ports 65 for discharging a supplemental toner and a paddle 66 for discharging the toner.

Disposed in the center of the inner drum 6 is a paddle shaft 64a for driving both paddles 64 and 66. The side handle 51 is provided at the right end of the inner drum 6. The left end of the inner drum 6 is provided with a rotatable engaging portion 67, which has a lock projection 67*a* and engages with drive means to rotate the inner drum 6, a new/old discrimination section 68 for discriminating if the cartridge is new or old, and a lock pawl 69.

Figure 16A:
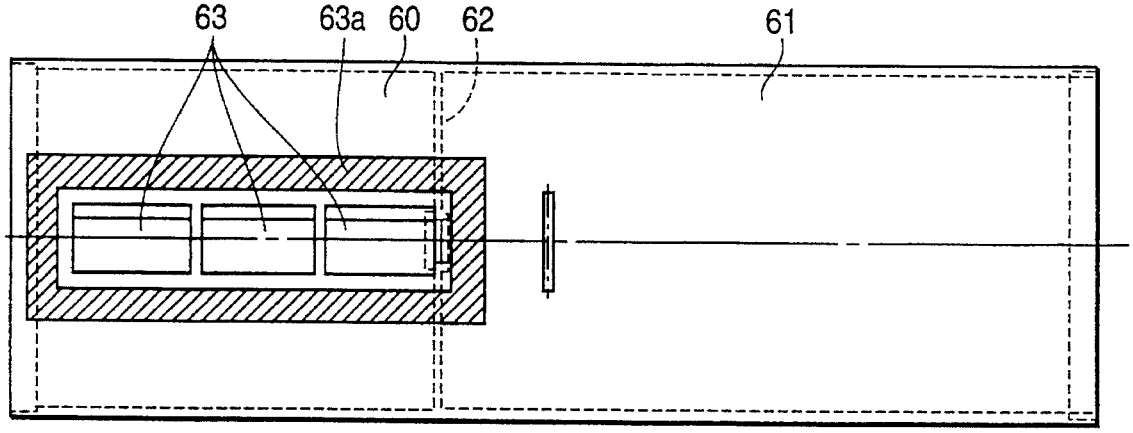
FIGS. 16A and 16B are explanatory diagrams of the inner drum of the cartridge shown in FIG. 15.
Figure 16B:
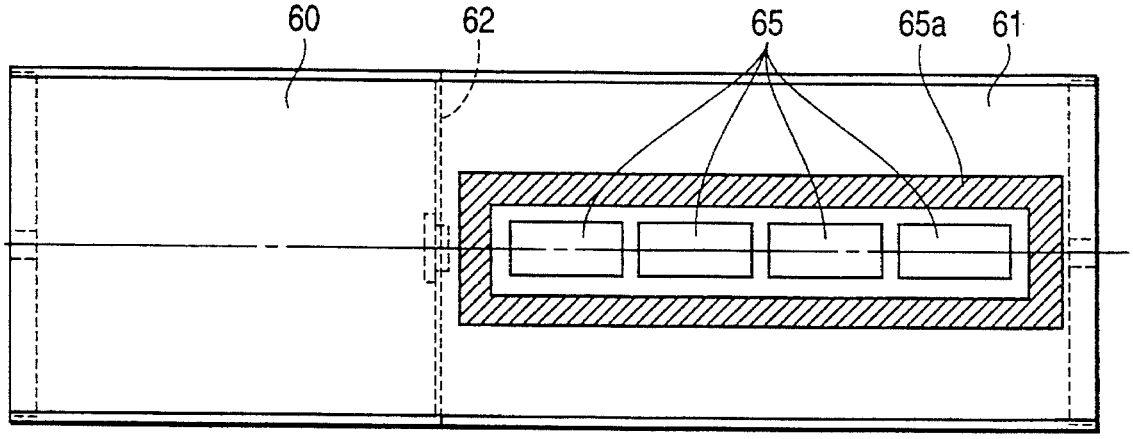

As shown in FIG. 16A, there are three developer supply ports 63 provided on the left end of the inner drum 6, with a leak preventing seal 63*a* placed around the ports 63. As shown in FIG. 16B, there are four toner supply ports 65 provided at the right end of the inner drum 6, with a leak preventing seal 65*a* placed around the ports 65. The developer supply ports 63 are located apart from the toner supply ports 65 by 120 degrees in the rotational direction of the inner drum 6 as shown in FIG. 15.

As shown in FIGS. 17 and 18, the outer case 7 is provided with the top handle 50, the inner drum retaining section 70 for retaining the inner drum 6 and the waste developer storage room 71 for storing a waste developer as mentioned earlier. Provided at the upper portion of the inner drum retaining section 70 are the waste toner collecting port 75, a shutter opening/closing projection 75*a* for opening the discharge shutter of the waste toner discharging section 36 (see FIG. 3), and an outer case lock pawl 76. There are three developer injection ports 72 and four toner injection ports 73 provided at the lower portion of the inner drum retaining section 70. The waste developer storage room 71 is provided with a protruding block 71*a*. The collecting port 77 for collecting the used developer and a discharging screw 78 for guiding the used developer into the storage room 71 are provided at the left-hand portion of the protruding block 71*a*. Further, the bottom 71*b* of the waste developer storage room 71 is inclined with respect to the face of the collecting port 77 of the protruding block 71*a*.

Figure 19:
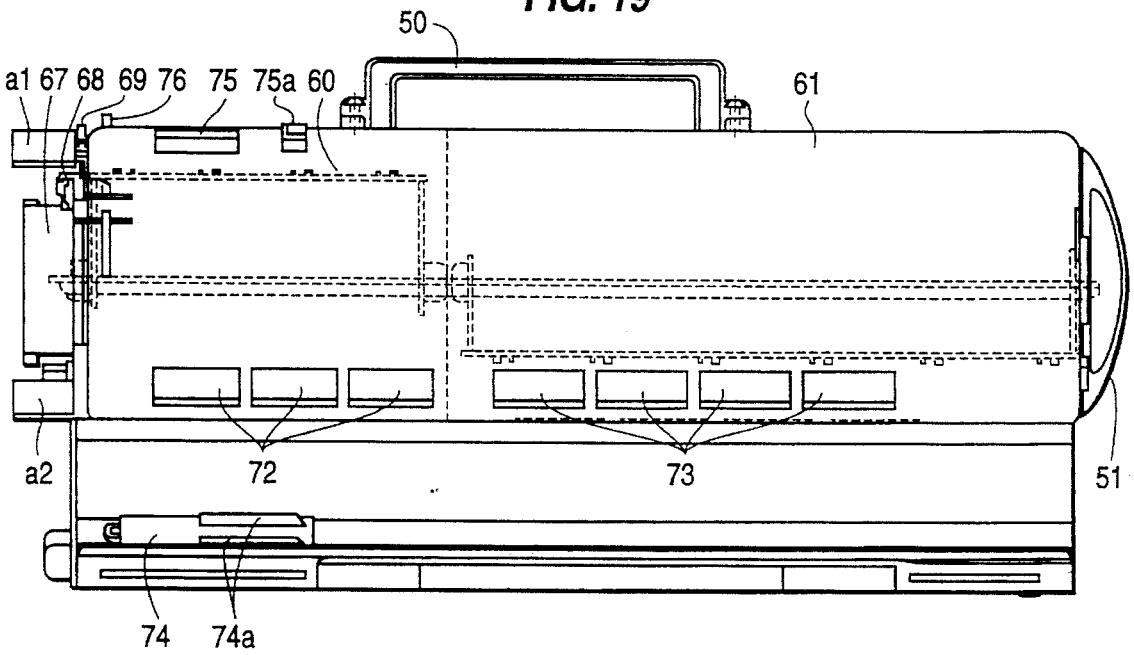
FIG. 19 is a front view of a cartridge assembly in FIG. 14.
Figure 21:
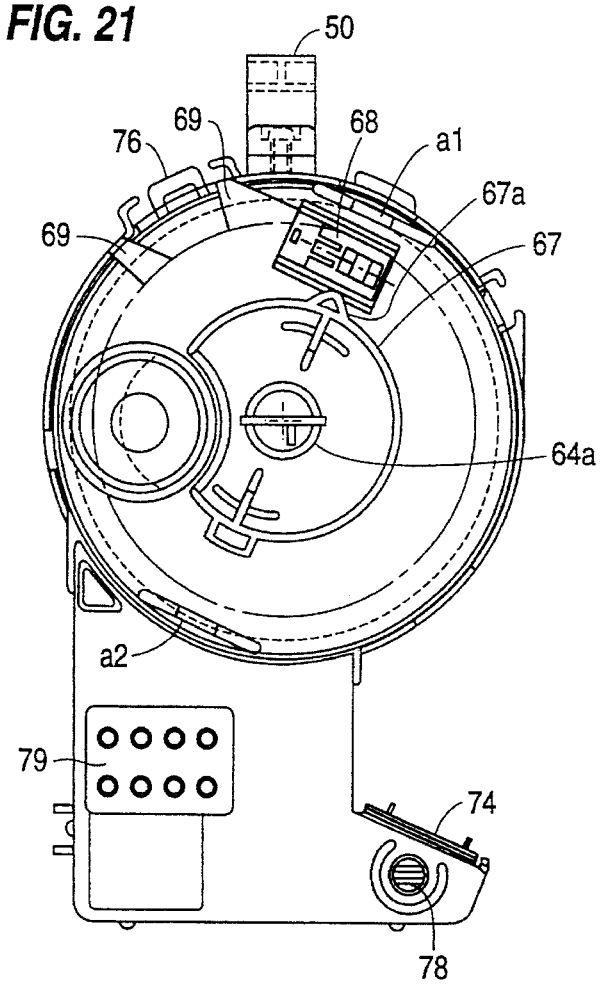
FIG. 21 is a side view of the cartridge assembly in FIG. 19.
Figure 22:
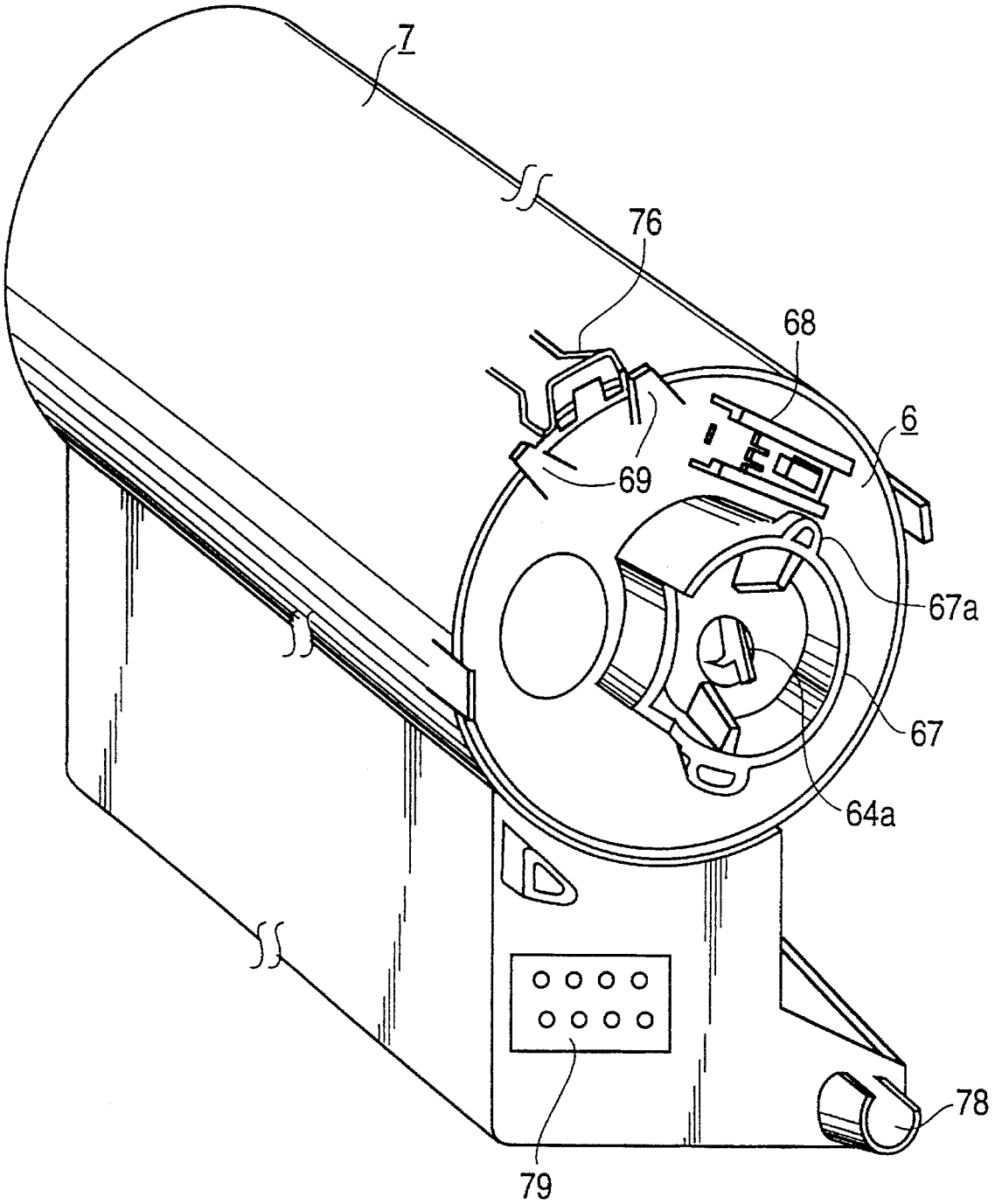
FIG. 22 is a perspective view of the cartridge assembly in FIG. 19.

A cartridge assembly having the outer case 7 and the inner drum 6 assembled together will be described below. FIG. 19 is a front view of the cartridge assembly in FIG. 14, FIG. 20 is a rear view of the cartridge assembly in FIG. 19, FIG. 21 is a side view of the cartridge assembly in FIG. 19, and FIG. 22 is a perspective view of the cartridge assembly in FIG. 19.

As shown in FIG. 19, the cartridge 5 is completed by placing the inner drum 6 in the inner drum retaining section 70. The cartridge 5 is provided with the top handle 50, the waste toner collecting port 75, the shutter opening/closing projection 75*a*, and the outer case lock pawl 76 at the top portion. The cartridge 5 is further provided with the developer injection ports 72 and toner injection ports 73 at the lower portion. Further, the collecting shutter 74 is provided in the waste developer storage room 71 at the lower portion of the cartridge 5. This collecting shutter 74 has a projection 74*a* which engages with the projecting portion of the developing apparatus to be open or closed.

Figure 20:
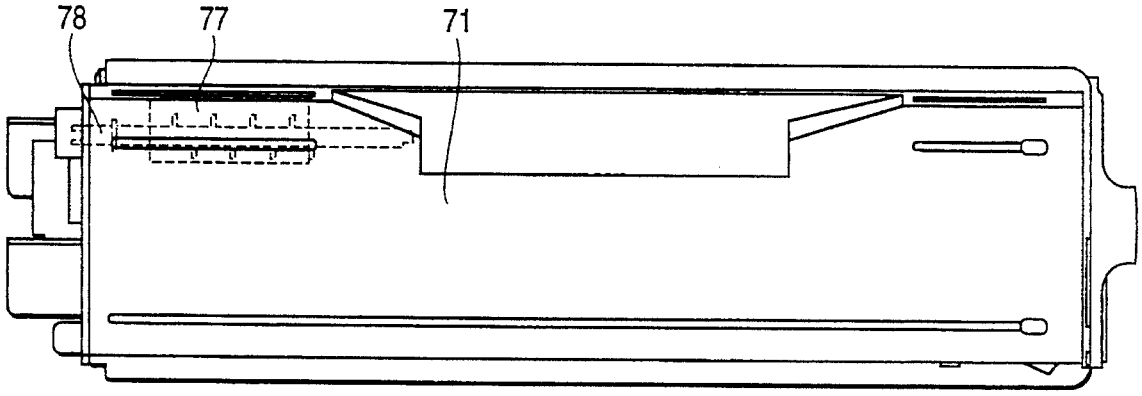
FIG. 20 is a rear view of the cartridge assembly in FIG. 19.

As shown in FIG. 20, the discharging screw 78 is provided at the lower portion of the waste developer collecting port 77. As shown in FIG. 19, there are provided a seal tab al for covering the waste toner collecting port 75 and a seal tab a2 for covering the developer injection ports 72 and toner injection ports 73 to seal those ports 77, 72 and 73, respectively. Further, as shown in FIGS. 19, 21 and 22, the rotatable engaging portion 67 having the lock projection 67*a* is provided at the left end of the cartridge 5, and the paddle shaft 64*a*, the new/old discrimination section 68, the lock pawl 69 and a characteristic setting section 79 which indicates the characteristics of the stored developer and toner are provided at the center portion of the cartridge 5.

Figure 23:
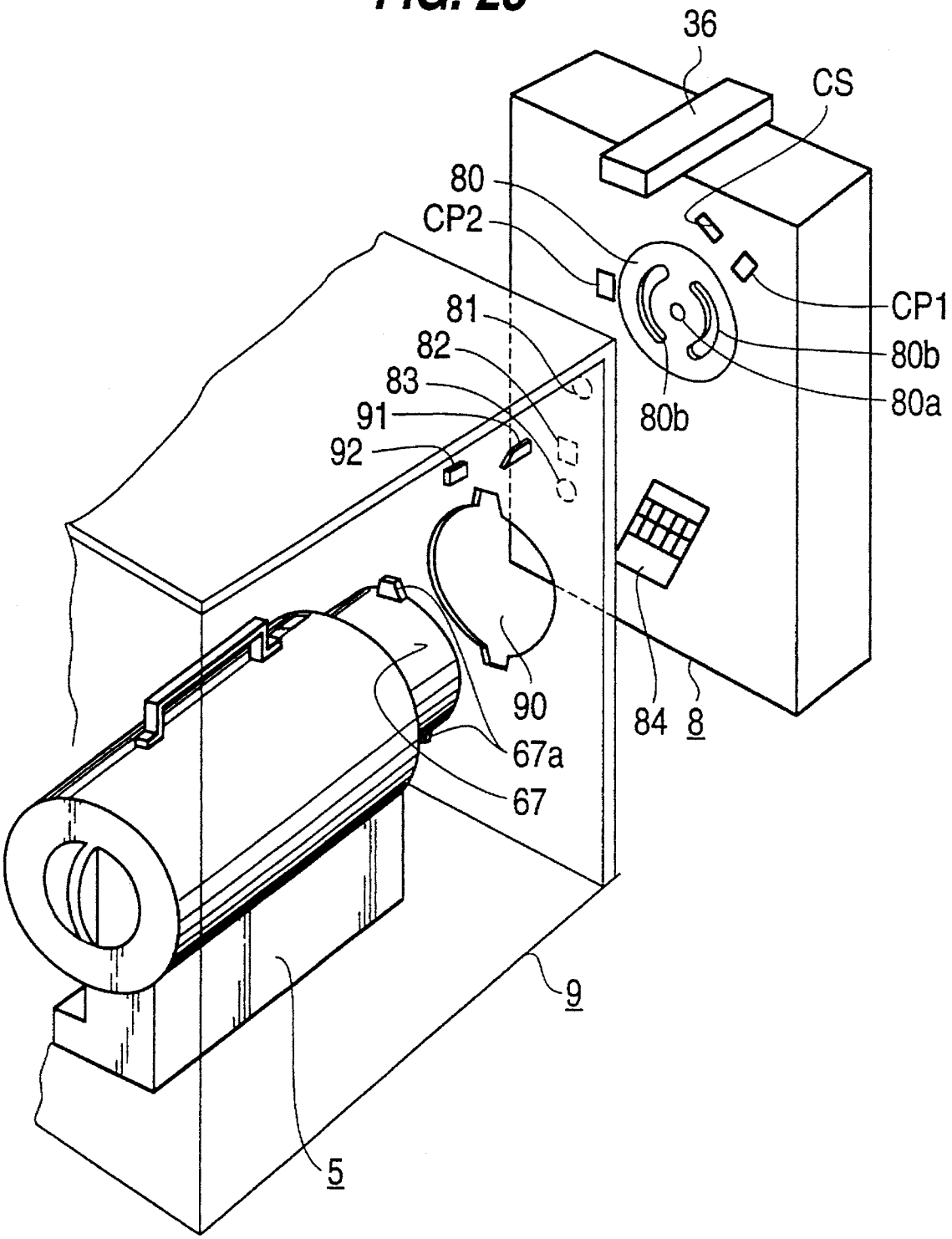
FIG. 23 is an explanatory diagram of a drive mechanism for driving the cartridge assembly in FIG. 19.
Figure 24:
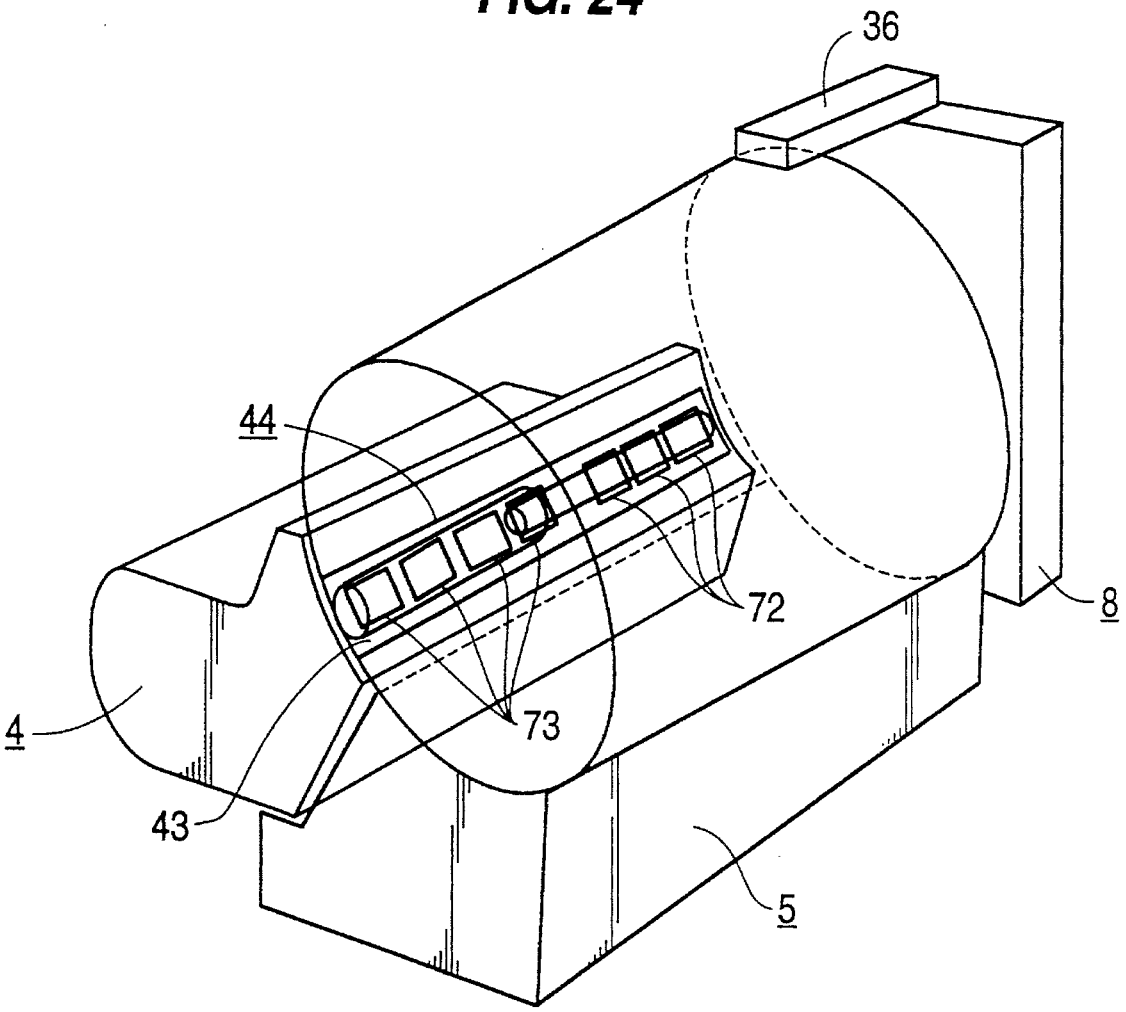
FIG. 24 is a perspective view showing the cartridge of FIG. 19 mounted in a developing apparatus.
Figure 25:
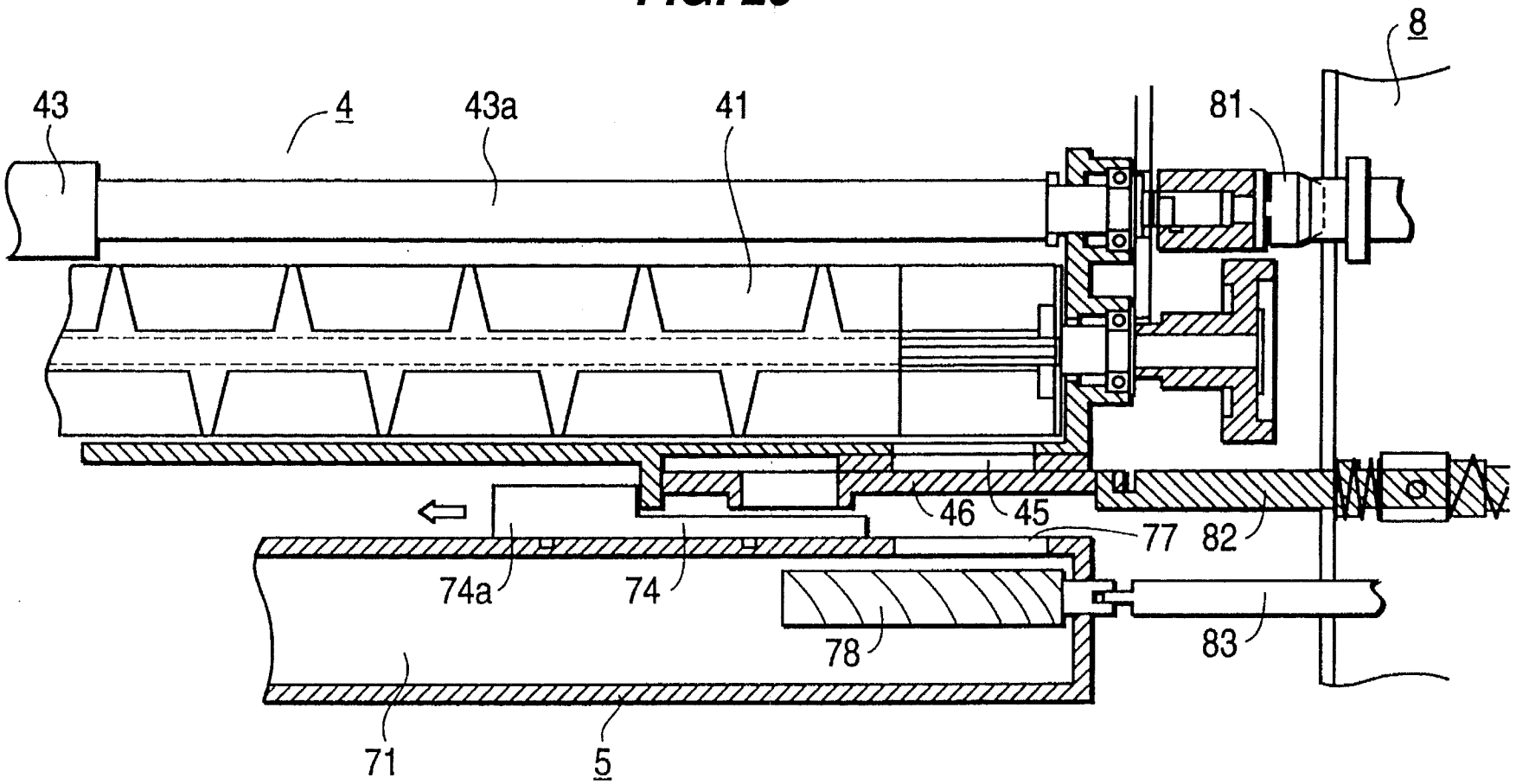
FIG. 25 is a diagram showing the connection between the mounted cartridge and the drive mechanism.
Figure 26A:
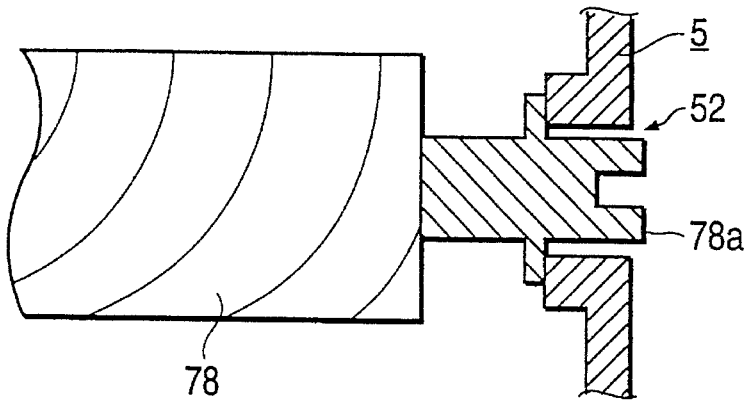
FIGS. 26A through 26C present explanatory diagrams of a discharging screw of the cartridge.
Figure 26B:
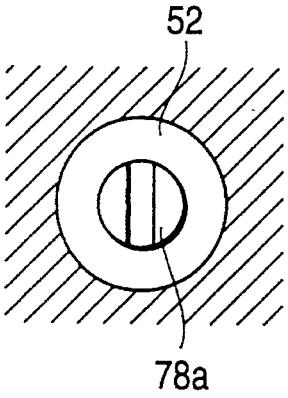
Figure 26C:
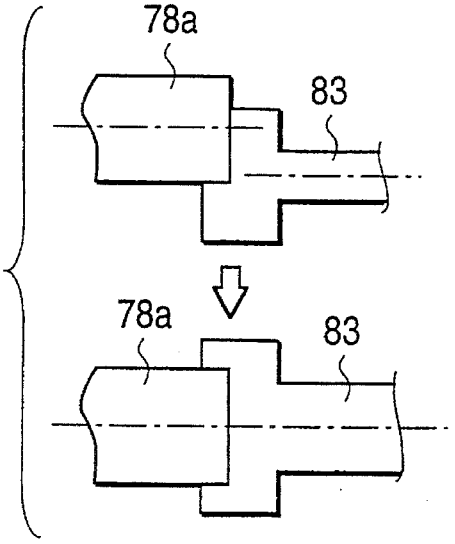
Figure 27:
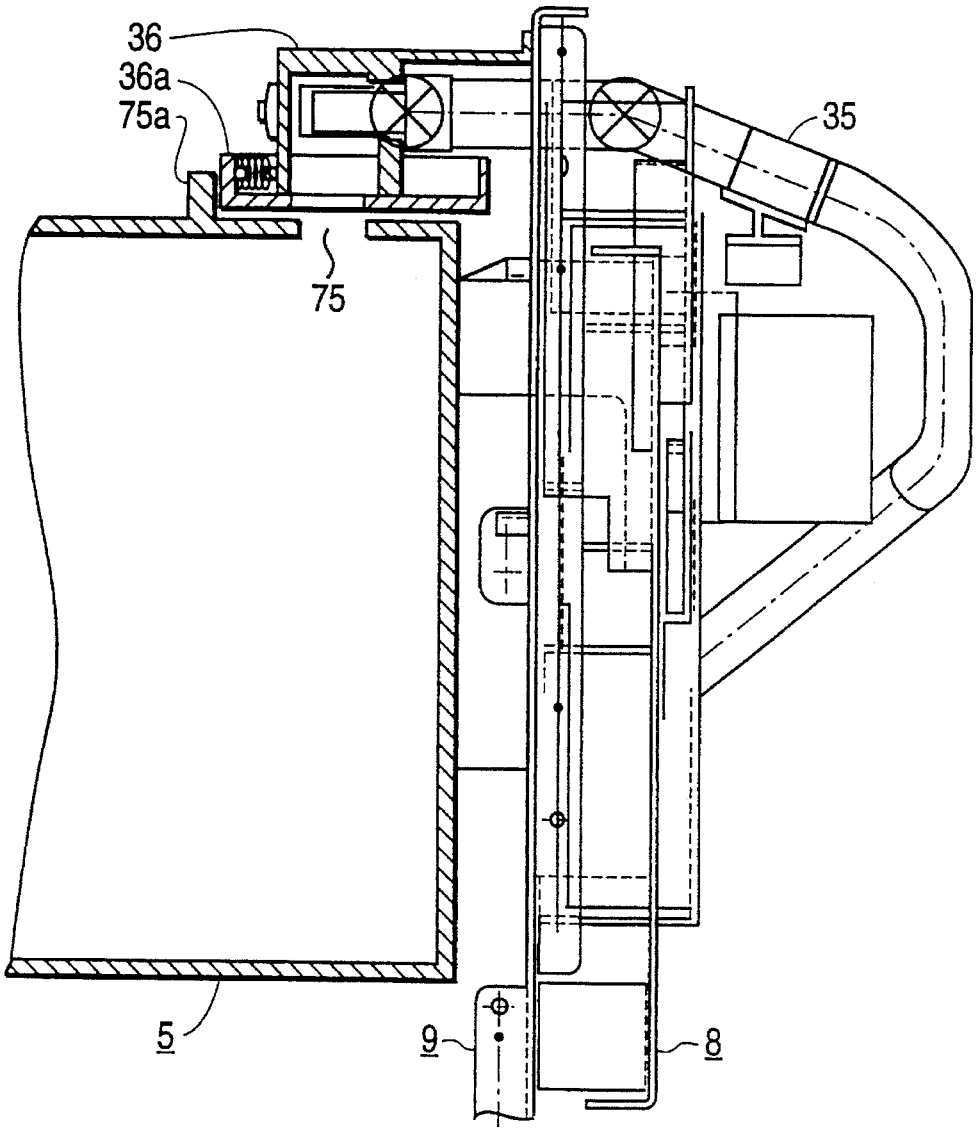
FIG. 27 is an explanatory diagram of a waste toner conveying mechanism shown in FIG. 23.
Figure 28:
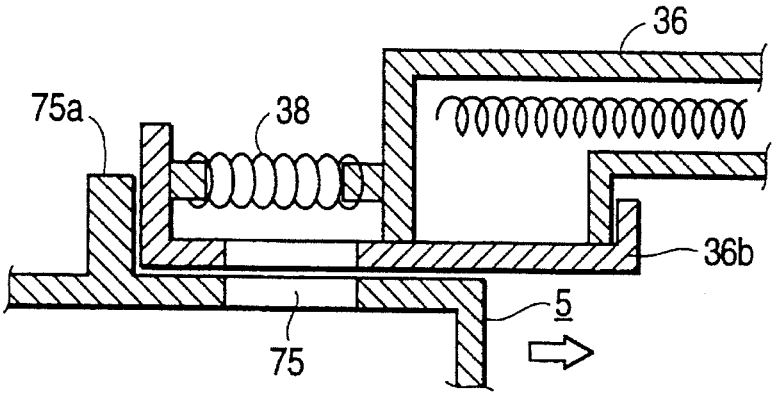
FIG. 28 is a diagram showing the arrangement of the essential portions of the waste toner conveying mechanism shown in FIG. 27.

An operation for mounting this cartridge 5 will now be described. FIG. 23 is an explanatory diagram of a drive mechanism for driving the cartridge assembly in FIG. 19, FIG. 24 is a perspective view showing the cartridge of FIG. 19 mounted in a developing apparatus, FIG. 25 is a diagram showing the connection between the mounted cartridge and a drive mechanism, FIGS. 26A through 26C present explanatory diagrams of the discharging screw of the cartridge, FIG. 27 is an explanatory diagram of the waste toner conveying mechanism shown in FIG. 23, and FIG. 28 is a diagram showing the arrangement of the essential portions of the waste toner conveying mechanism shown in FIG. 27. In FIG. 23, a frame 9, which is for setting the cartridge 5, has a drive mechanism 8 provided at the back to drive the cartridge 5. This frame 9 is provided with a mounting hole 90 in which the rotatable engaging portion 67 and engaging projection 67*a* of the cartridge 5 are to be fitted, a lock release rod 91 which unlocks the outer-case lock pawl 76 of the cartridge 5 to permit the rotation of the inner drum 6, and a new/old setting rod 92 for activating the new/old discriminating section 68.

As shown in FIG. 23, the drive mechanism 8 is provided with a drive shaft 80. This drive shaft 80 has a paddle drive portion 80*a* and a drive projection 80*b*. The paddle drive portion 80*a* engages with the paddle shaft 64*a* of the cartridge 5 to rotate the paddle shaft 64*a*. The drive projection 80*b* engages with the rotatable engaging portion 67 of the cartridge 5 to rotate the inner drum 6. The drive mechanism 8 is also provided with a developing-apparatus drive shaft 81 (see FIG. 25) for driving the toner supply roller 43 of the developing apparatus 4, a shutter opening/closing lever 82 (see FIG. 25) for opening and closing the discharge shutter 46 of the developing apparatus 4, and a discharging screw drive mechanism 83 (see FIG. 25) for rotating the discharging screw 78 of the cartridge 5.

The drive mechanism 8 further has a characteristic detecting switch 84 for detecting the setting of the character setting section 79 of the cartridge 5, a cartridge right-end sensor CP1 for detecting the right-hand rotational end of the inner drum 6, a cartridge left-end sensor CP2 for detecting the left-end rotational end of the inner drum 6, and a new/old discriminating switch CS which is activated by the new/old discriminating section 68 of the cartridge 5. The waste toner discharging section 36 is provided at the upper portion of the drive mechanism 8.

An operation to mount the cartridge 5 will now be described. The cartridge 5 is inserted in the frame 9 so that the rotatable engaging portion 67 of the cartridge 5 if fitted in the mounting hole 90. Then, the cartridge 5 is turned rightward so that the engaging projection 67*a* of the rotatable engaging portion 67 engages with the frame 9 to lock the cartridge 5, thereby disabling the removable of the cartridge 5. In this state, the toner injection ports 73 of the cartridge 5 face the toner supply roller 43 at the injection port 44 of the developing apparatus 4, while the developer injection ports 72 of the cartridge 5 face the shaft 43*a* of the toner supply roller 43 at the injection port 44 of the developing apparatus 4, as shown in FIG. 24. The waste toner discharging section 36 of the drive mechanism 8 faces the waste toner collecting port 75 of the cartridge 5. Further, the rotatable engaging portion 67 of the inner drum 6 of the cartridge 5 engages with the drive projection 80*b* of the drive shaft 80 of the drive mechanism 8, so that the inner drum can be rotated. The paddle shaft 64*a* of the inner drum 6 of the cartridge 5 engages with the paddle drive portion 80*a* of the drive shaft 80, allowing the paddle shaft 64*a* to rotate.

By this mounting operation, the projection 74*a* of the collecting shutter 74 covering the waste developer collecting port 77 of the cartridge 5 abuts against the lower portion of the developing apparatus 4, thus opening the shutter 74 as shown in FIG. 17. At that time, the discharging screw 78 is connected to the screw drive shaft 83 of the drive mechanism 8. A bearing portion 52 of the cartridge 5 is set large for a screw shaft 78*a* of this discharging screw 78, as shown in FIGS. 26A and 26B to provide a clearance to allow the screw shaft 78*a* to move. Even if the center of the screw shaft 78*a* is misaligned with the center of the screw drive shaft 83 as shown in FIG. 26C, therefore, when the screw drive shaft 83 rotates, the centering is made to align the shaft centers with each other.

By the mounting operation, as shown in FIGS. 27 and 28, the shutter 36*a* covering the discharge port of the waste toner discharging section 36 is pushed by the shutter driving projection 75*a* at the waste toner collecting port 75 to move while compressing the spring 36*b*. As a result, the discharge port is open and faces the waste toner collecting port 75.

Figure 29A:
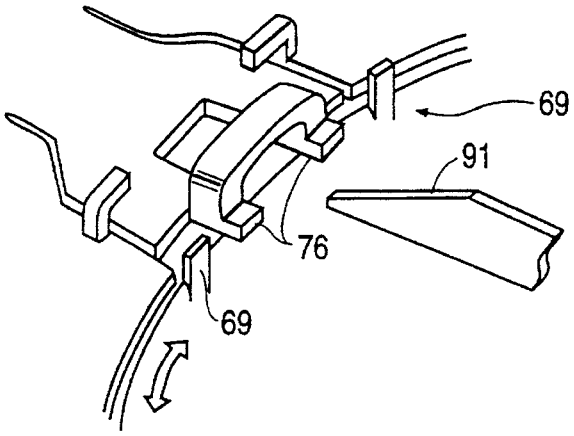
FIGS. 29A, 29B, 30A and 30B present diagrams for explaining the operation at the time the cartridge is attached.
Figure 30A:
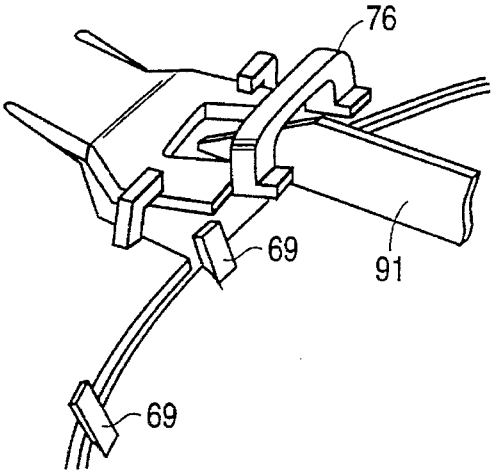
Figure 29B:
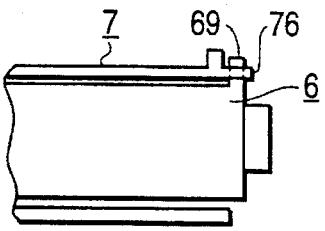
Figure 30B:
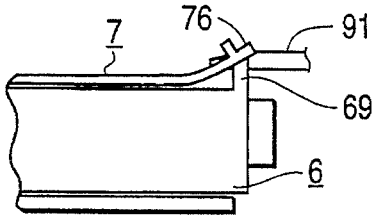

As shown in FIGS. 29A and 29B, before the mounting, the lock pawl 69 of the inner drum 6 in the cartridge 5 abuts against the lock pawl 76 of the outer case 7, restricting the rotation of the inner drum 6. Before the mounting of the cartridge 5, therefore, the rotation of the inner drum 6 by the operator is restricted and the positional relation between the outer case 7 and the inner drum 6 is maintained. Through the mounting operation, as shown in FIGS. 30A and 30B, the lock release rod 91 of the frame 9 lifts the lock pawl 76 of the outer case 7 to unlock the lock pawl 69 of the inner drum 6 from the lock pawl 76 of the outer case 7, thereby permitting the inner drum 6 to rotate.

Figure 31:
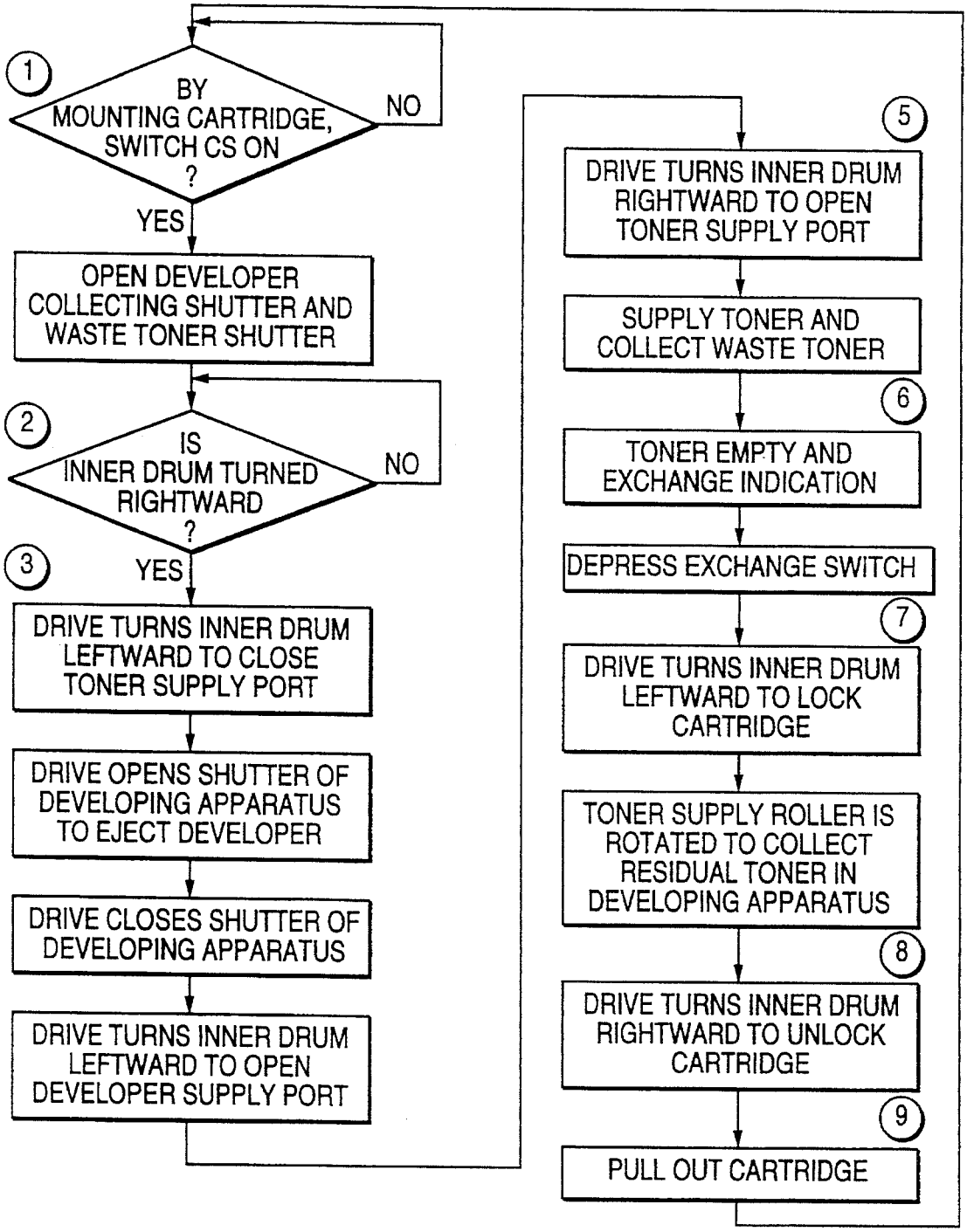
FIG. 31 presents an explanatory diagram of a cartridge exchanging sequence.
Figure 32A:
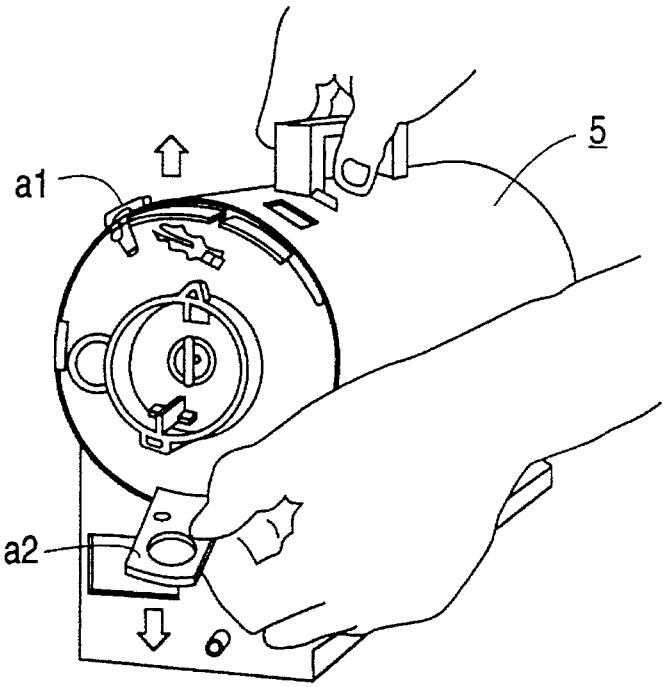
FIGS. 32A and 32B are diagrams for explaining the attaching operation of the cartridge.
Figure 32B:
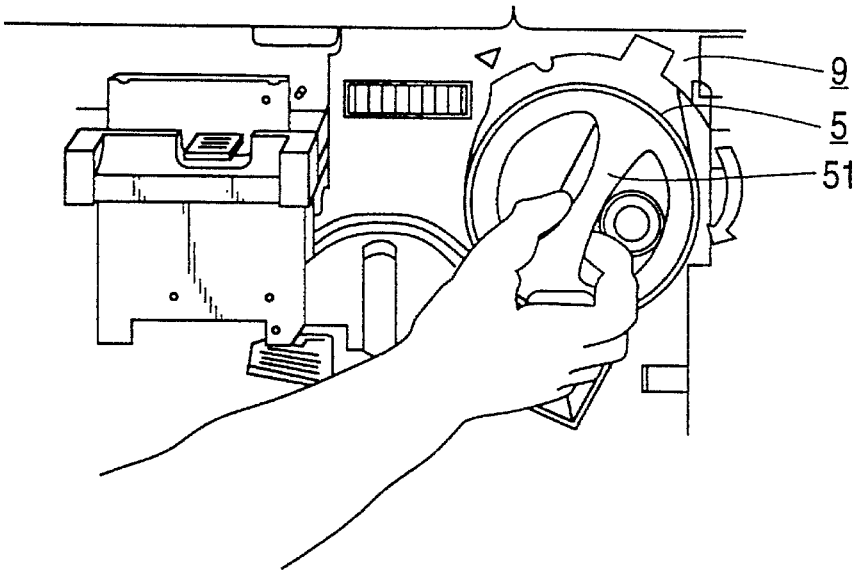
Figure 33A:
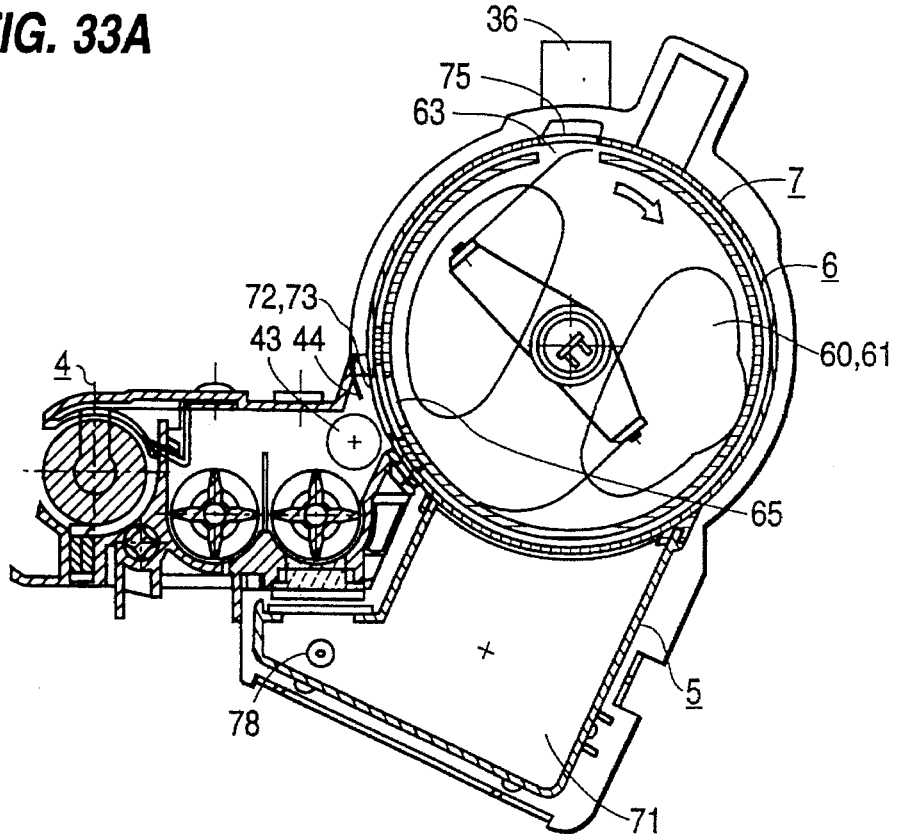
FIGS. 33A through 33F are diagrams for explaining the cartridge exchanging operation.
Figure 34A:
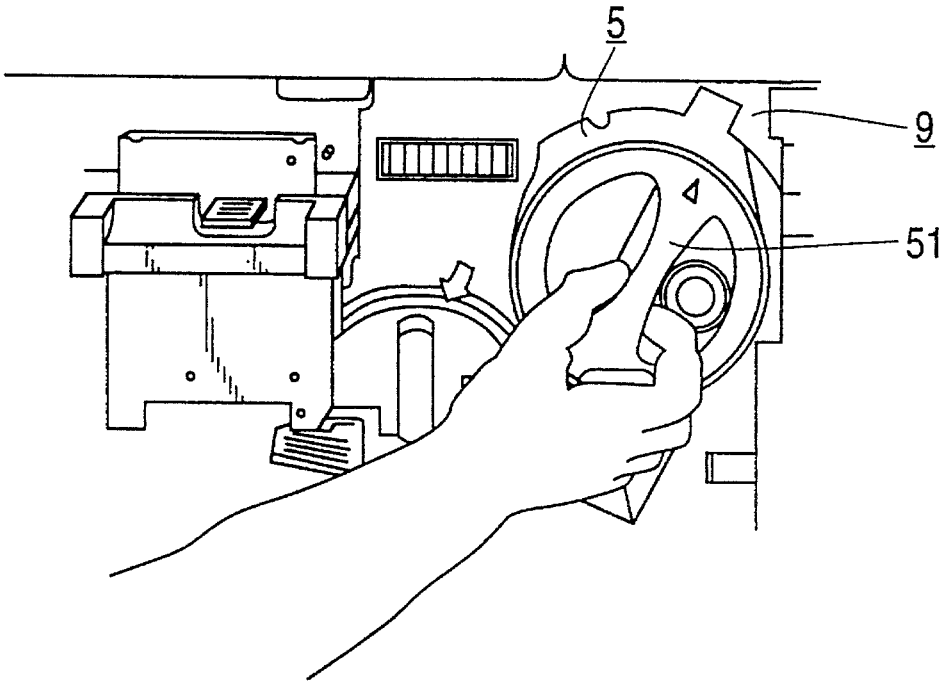
FIGS. 34A and 34B present diagrams for explaining how to detach the cartridge.
Figure 34B:
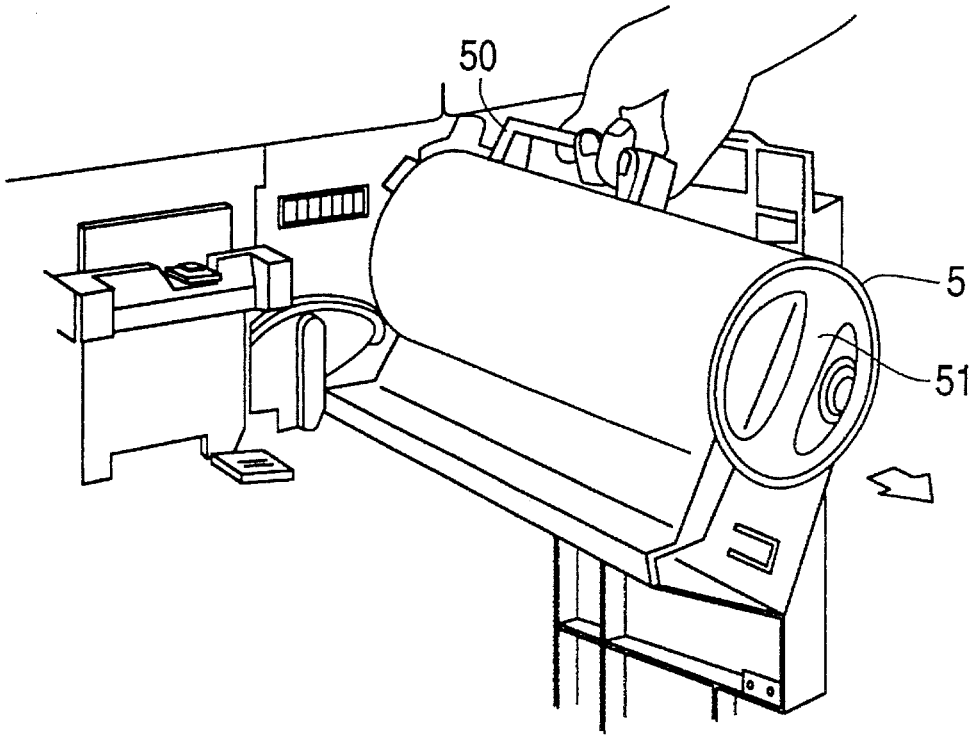
Figure 35A:
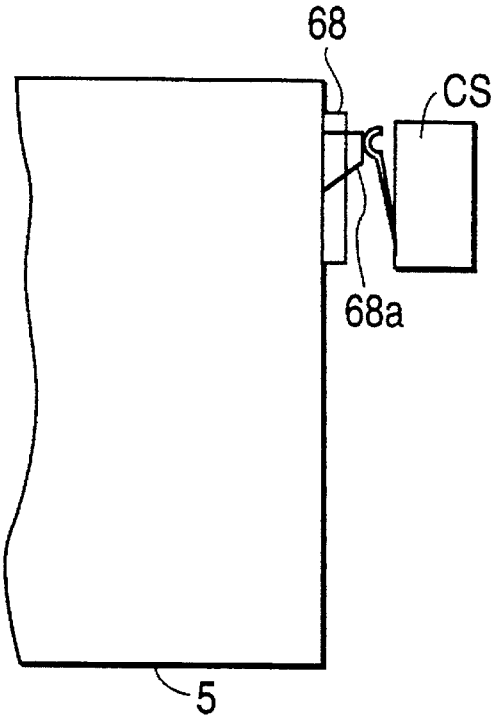
FIGS. 35A and 35B are diagrams for explaining a cartridge discrimination at the time the cartridge is attached.
Figure 35B:
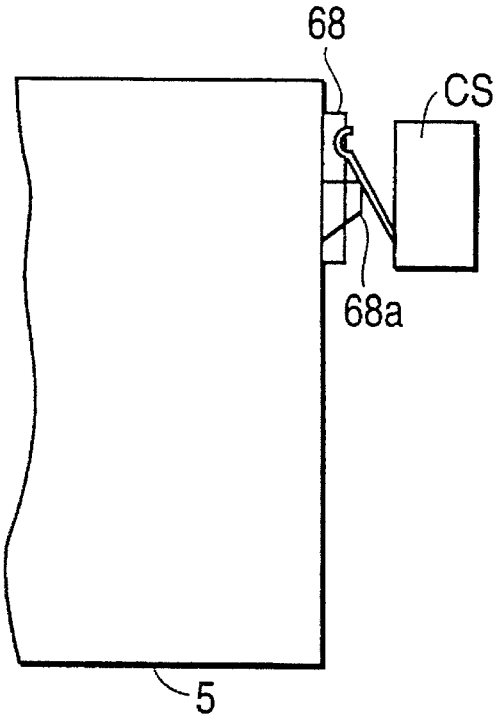
Figure 36:
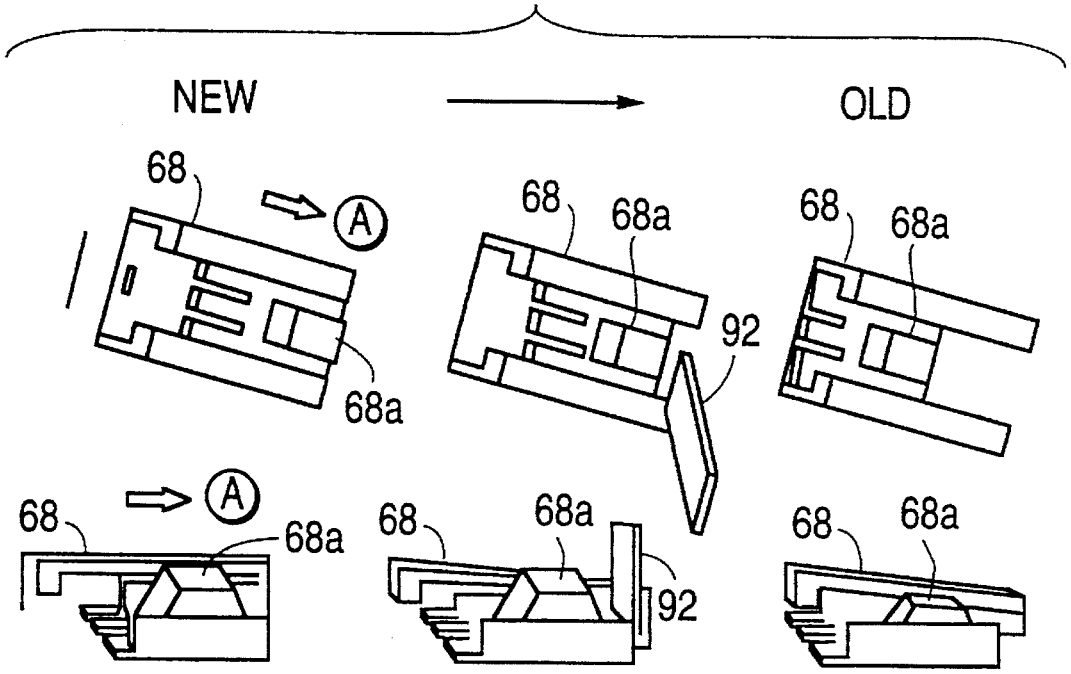
FIG. 36 is a diagram for explaining an automatic setting operation at the time the cartridge is attached.

An operation for exchanging this cartridge will be described below. FIG. 31 presents an explanatory diagram (No. 1) of a cartridge exchanging sequence, FIGS. 32A and 32B are explanatory diagrams of the attaching operation of the cartridge, FIGS. 33A through 33F are explanatory diagrams of the cartridge exchanging operation (No. 2), FIGS. 34A and 34B present diagrams for explaining how to detach the cartridge, FIGS. 35A and 35B are diagrams for explaining a cartridge discrimination at the time the cartridge is attached, and FIG. 36 is a diagram for explaining an automatic setting operation at the time the cartridge is attached. The following description will be given along the exchanging sequence illustrated in FIG. 31.

① As shown in FIG. 32A, the operator bends the tabs a1 and a2 of the cartridge 5 and then pulls out the cartridge 5 to unseal the waste toner collecting port 75, developer injection ports 72 and toner injection ports 73 of the outer case 7. Then, as shown in FIG. 32B, the operator mounts the cartridge 5 into the apparatus. If the cartridge 5 is new at this time, a slide projection 68*a* of the new/old discriminating section 68 is positioned on the left-hand side as shown in FIG. 36. Therefore, the new/old discriminating switch CS of the drive mechanism 8 is set on as shown in FIG. 35A to allow the apparatus to recognize the mounting of the new cartridge 5, and the exchanging sequence will start. If the cartridge 5 is a used (old) one, on the other hand, the slide projection 68*a* of the new/old discriminating section 68 is positioned on the right-hand side as shown in FIG. 36. In this case, therefore, the new/old discriminating switch CS of the drive mechanism 8 will not be set on as shown in FIG. 35B so that the exchanging sequence will not start.

When the cartridge 5 is mounted and is turned leftward (in the direction of an arrow A) as viewed from the mounting direction, the slide projection 68*a* slides rightward in the diagram by the new/old setting rod 92 of the frame 9 as shown in FIG. 36, so that the cartridge 5 is set as an old one. Accordingly, once the cartridge 5 is mounted into the apparatus, it is set as an old cartridge, so that even if this cartridge is newly mounted later, it will be discriminated as an old one and the exchanging sequence will not start to disable the use of this cartridge. It is therefore possible to prevent the exchanging sequence from starting with the erroneous mounting of an old cartridge 5 by the operator.

By the mounting operation, the developer collecting shutter 74 of the cartridge 5 is open as shown in FIG. 25, and the shutter 36*a* of the waste toner discharging section 36 is open as shown in FIG. 27. As shown in FIG. 30A, the lock pawl 76 of the outer case 7 is disengaged from the lock pawl 69 of the inner drum 6 by the lock release rod 91, permitting the inner drum 6 to rotate.

② When the operator turns inner drum 6 of the cartridge 5 rightward as shown in FIG. 32B, the projection 67*a* of the rotatable engaging portion 67 of the inner drum 6 engages with the frame 9, locking the cartridge 5. Consequently, the cartridge 5 is securely positioned in the apparatus. Then, the projection 67*a* of the rotatable engaging portion 67 of the inner drum 6 sets the drive rightward rotational position switch CP1 on. This allows the apparatus side to recognize the completion of the mounting of the cartridge 5. In this state, the toner injection ports 73 in the outer case 7 of the cartridge 5 face the injection port 44 of the developing apparatus 4 as shown in FIG. 33A. The collecting port 77 in the outer case 7 of the cartridge 5 is positioned directly below the discharge port 45 of the developing apparatus 4. In other words, the cartridge 5 is arranged opposite to the photosensitive drum 30 in a tilted state. Further, the developer injection ports 63 of the inner drum 6 face the discharge port of the waste toner discharging section 36, while the toner supply ports 65 of the inner drum 6 face the tone injection ports 73 in the outer case 7.

Figure 33B:
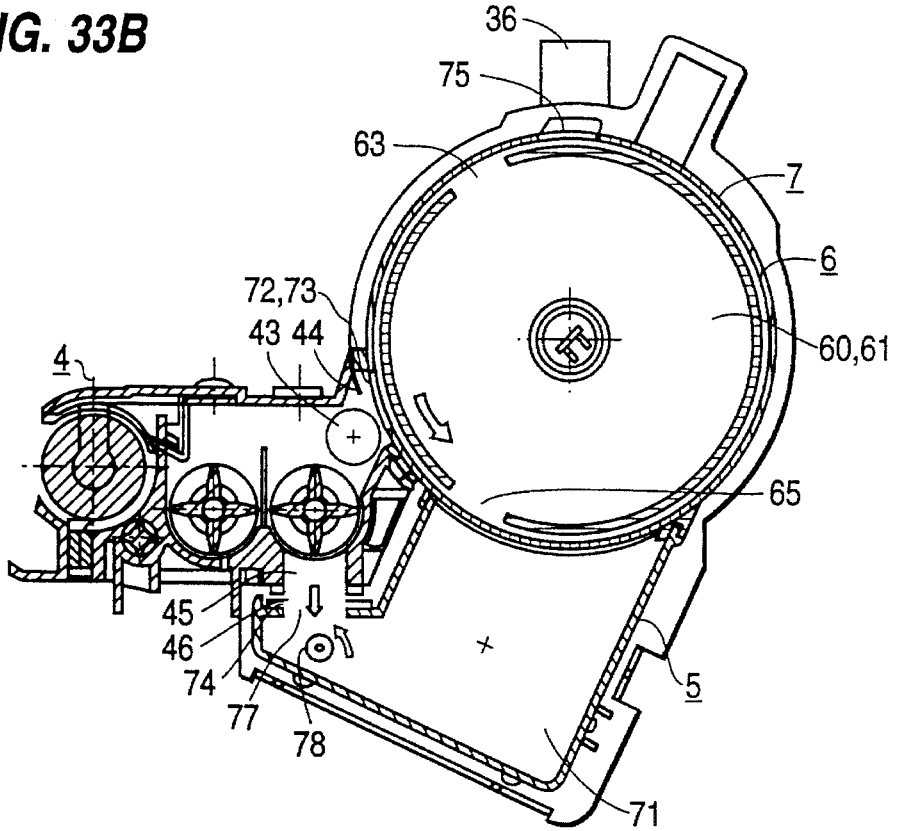

③ As the drive rightward rotational position switch CP1 is set on, the drive mechanism 8 turns the inner drum 6 leftward to position it as shown in FIG. 33B. This releases the state of the toner supply ports 65 of the inner drum 6 facing the tone injection ports 73 of the outer case 7 and closes the latter ports 73. In this state, the drive mechanism 8 activates the shutter opening/closing lever 82 to open the discharge shutter 46 of the developing apparatus 4 and cause the screw drive shaft 83 to drive the discharging screw 78. Then, the developing apparatus 4 is driven for one minute by an unillustrated main motor. As a result, the developer in the developing apparatus 4 falls from the discharge port 45 of the developing apparatus into the waste developer storage room 71 through the collecting port 77 of the cartridge 5, and is discharged into the waste developer storage room 71 by the discharging screw 78, as shown in FIG. 33B, accomplishing the collection of the waste developer.

Then, after driving the developing apparatus 4 for one minute, the drive mechanism 8 activates the shutter opening/closing lever 82 to close the discharge shutter 46 of the developing apparatus 4, considering that the whole developer in the developing apparatus 4 have been collected. Then, the drive mechanism 8 stops causing the screw drive shaft 83 to drive the discharging screw 78, and stops driving the developing apparatus 4 by the main motor.

Figure 33C:
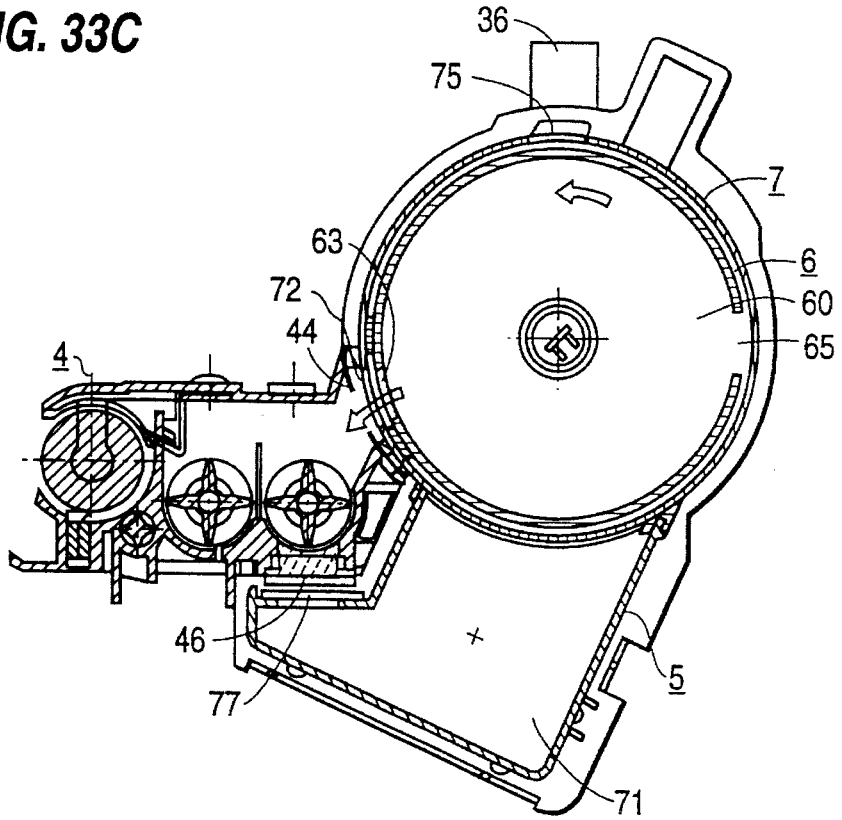

④ Next, the drive mechanism 8 rotates the inner drum 6 until the drive leftward rotational position switch CP2 is set on by the projection 67*a* of the rotatable engaging portion 67 of the inner drum 6. In this rotation end state, the developer injection ports 63 of the inner drum 6 face the developer injection ports 72 of the outer case 7 and the ports 72 are open as shown in FIG. 33C. The drive mechanism 8 then causes the paddle drive shaft 80*a* to drive the paddle shaft 62, thereby rotating the paddle 64. Accordingly, the developer in the developer storage room 60 in the inner drum 6 is supplied through the injection port 44 into the developing apparatus 4. As the unused developer in the developer storage room 60 is supplied in parallel through the three developer injection ports 72, the developer supplying time is shortened.

Figure 33D:
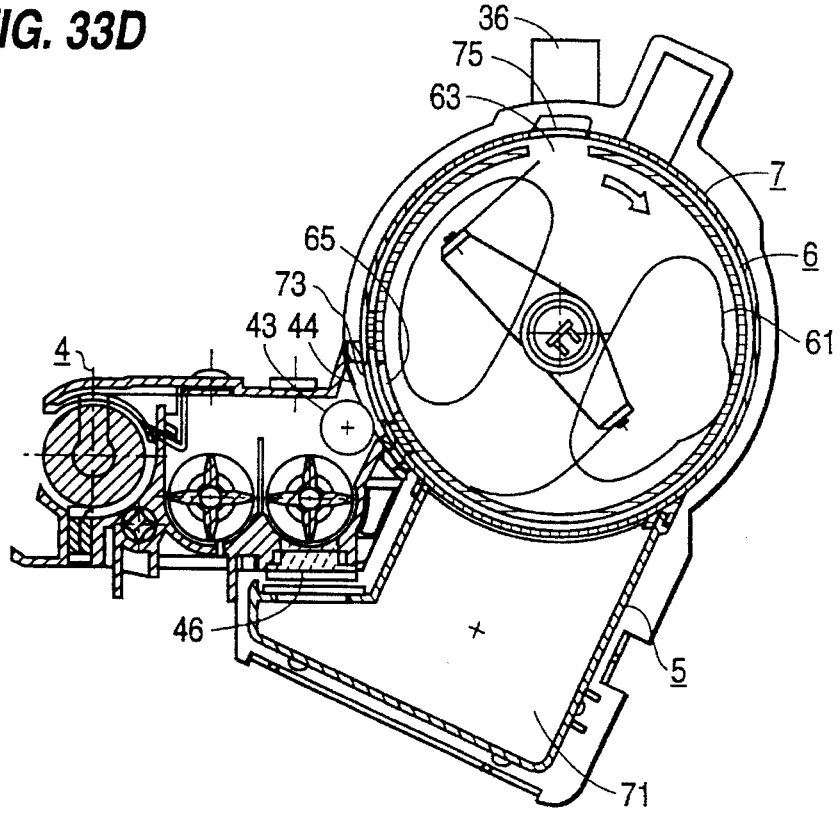

⑤ Then, the drive mechanism 8 rotates the inner drum 6 until the drive rightward rotational position switch CP1 is set on by the projection 67*a* of the rotatable engaging portion 67 of the inner drum 6. Accordingly, the developer injection ports 63 of the inner drum 6 face the discharge port of the waste toner discharging section 36, as shown in FIG. 33D. The toner supply ports 65 of the inner drum 6 face the toner injection ports 73 of the outer case 7.

Consequently, the apparatus is ready for normally printing and the supplement of the toner and the collection of the waste tone are possible. That is, as the paddle shaft 62 is driven by the paddle drive shaft 80*a* to rotate the paddle 66, the toner is supplied to the toner supply roller 43 from the toner storage room 61. Under the toner density control, the drive mechanism 8 causes the developing-apparatus drive shaft 81 to rotate the toner supply roller 43 to supply the toner into the developing apparatus 4. Further, the waste toner from the cleaner 34 is collected into the developer storage room 60 of the cartridge 5 through the waste toner carrying pipe 35 and the waste toner discharging section 36. That is, the developer storage room 60 is used as a collecting room for the waste toner.

⑥ When the toner empty is discriminated under the toner density control while supplementing the toner in the above manner, an exchange indication is given on the operator panel 14. The operator then depresses the exchange switch on the operator panel 14.

If, through the supplement of the toner, the amount of the toner in the toner storage room 61 falls down to a level to deteriorate the carrier of the unused developer in the developer storage room 60, the toner-empty state and the deterioration of the developer occur simultaneously, providing a high cartridge-exchanging efficiency.

Figure 33E:
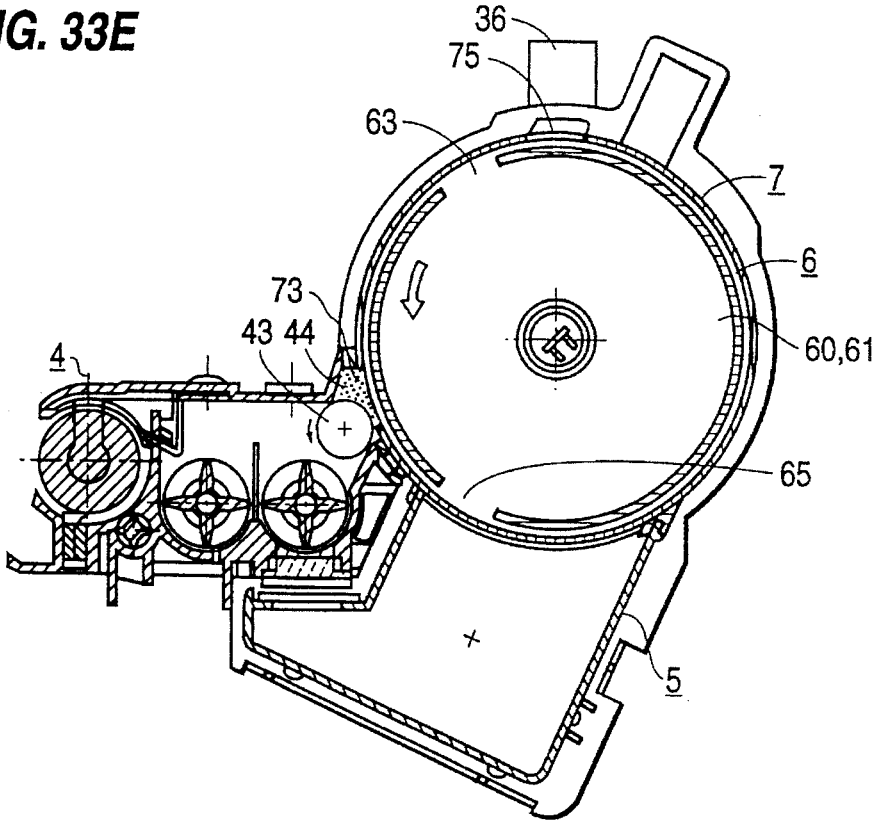

⑦ When detecting the depression of the exchange switch, the drive mechanism 8 rotates the inner drum 6 leftward to the position shown in FIG. 33E. As a result, the state of the toner supply ports 65 of the inner drum 6 facing the toner injection ports 73 of the outer case 7 is released, the latter ports 73 are closed and the cartridge 5 is locked. In this state, the drive mechanism 8 causes the developing-apparatus drive shaft 81 to rotate the toner supply roller 43 to allow the residual toner at the injection port 44 of the developing apparatus 4 to be collected in the developing apparatus 4, thereby preventing the sputtering of the toner at the time the cartridge 5 is detached therefrom.

Figure 33F:
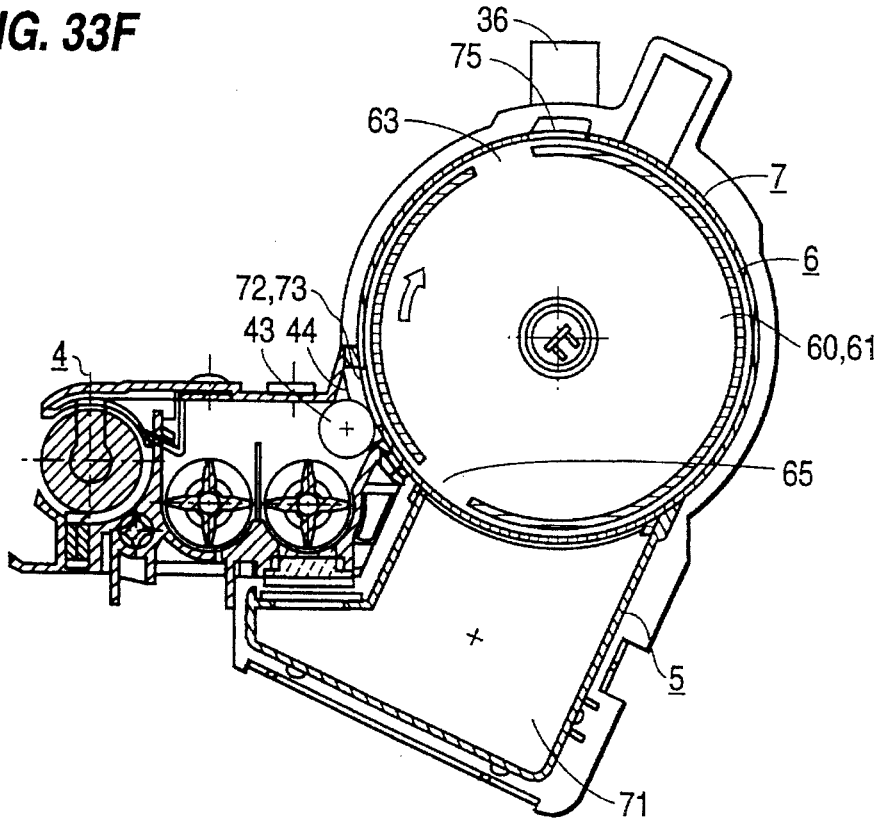

⑧ Thereafter, as shown in FIG. 33F, the drive mechanism 8 rotates the inner drum 6 rightward so that the projection 67*a* of the rotatable engaging portion 67 of the inner drum 6 comes to the mounting hole 90 of the frame 9. This unlocks the cartridge 5 so that it can be detached.

⑨ Then, the operator pulls out the cartridge 5 from the apparatus, while holding the side handle 51 of the cartridge 5, as shown in FIG. 34A. Then, holding the top handle 50 of the cartridge 5, the operator removes the cartridge from the apparatus as shown in FIG. 34B.

In the above manner, the detachment of the cartridge 5, the exchange of the developer, the supplement of the toner and the collection of the waste toner can be accomplished with a single cartridge 5 and in a single detaching operation.

Figure 37:
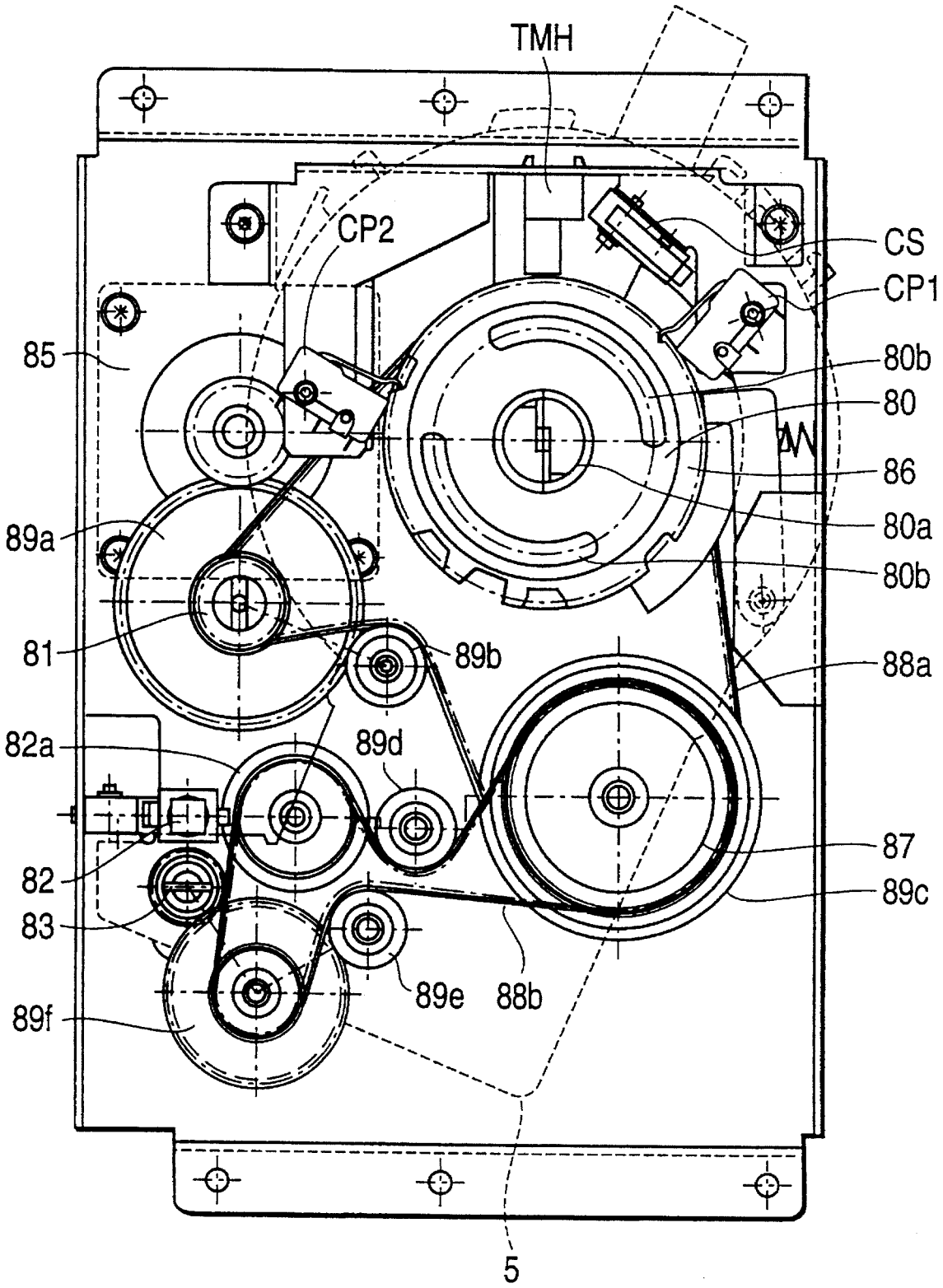
FIG. 37 is a cross-sectional front view of the drive mechanism in FIG. 19.
Figure 40:
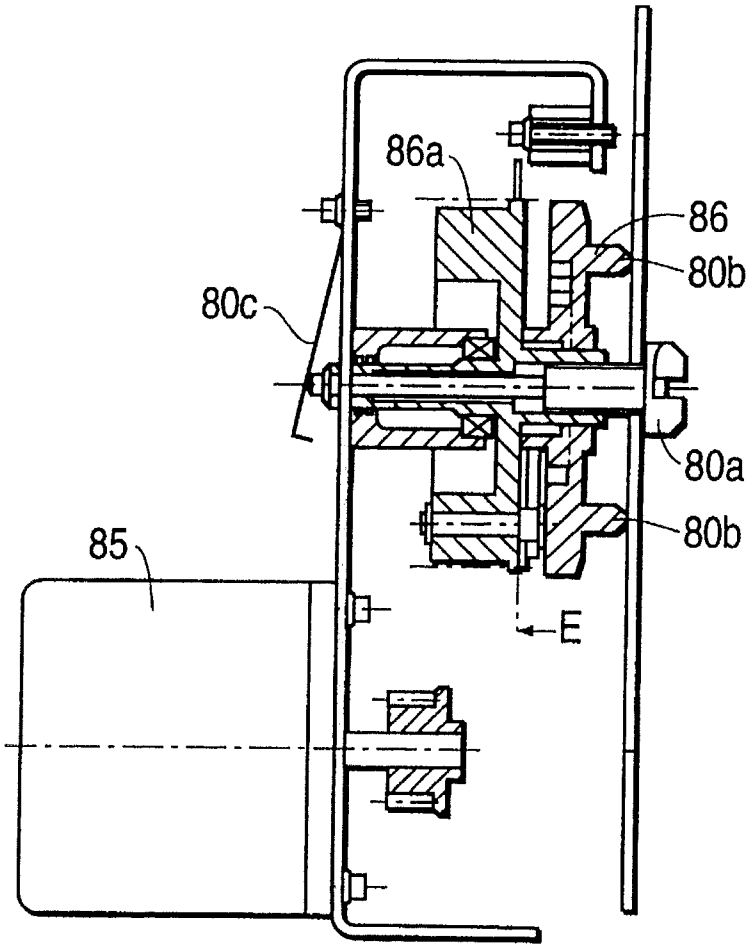
FIG. 40 is a left side view of the drive mechanism in FIG. 37.
Figure 41:
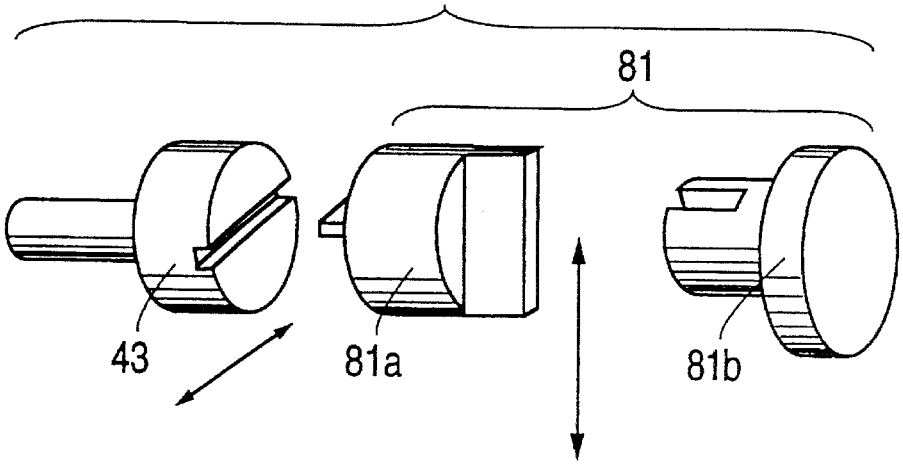
FIG. 41 is an explanatory diagram of the drive shaft of the developing apparatus, shown in FIG. 37.
Figure 42A:
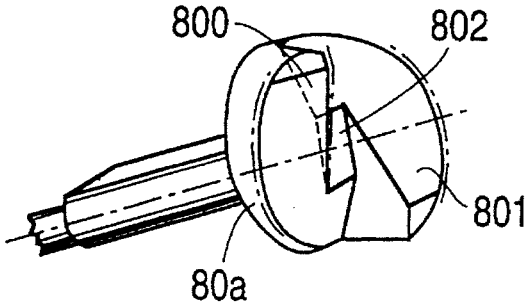
FIGS. 42A through 42D present explanatory diagrams of a paddle shaft shown in FIG. 37.
Figure 42B:
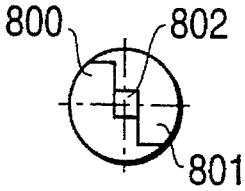
Figure 42C:
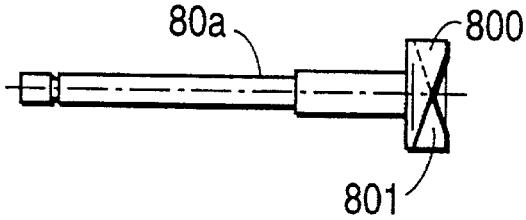
Figure 42D:
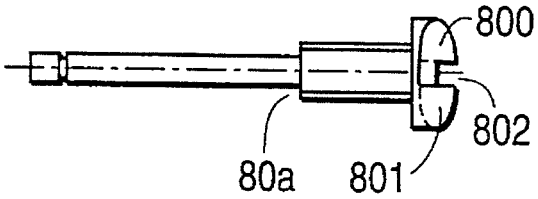
Figure 43:
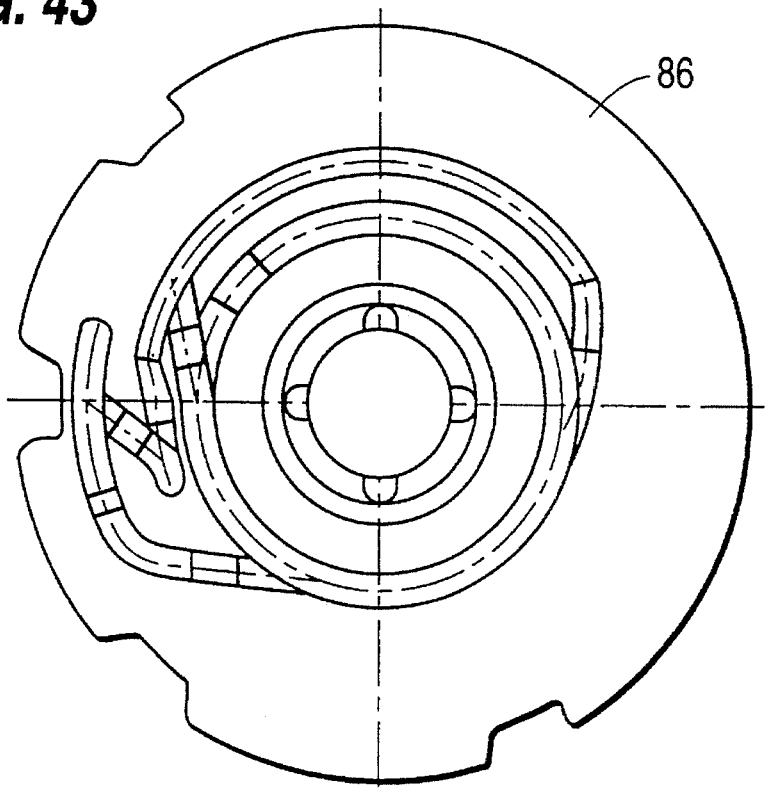
FIGS. 43 and 44 are diagrams showing the structures of cams of the drive mechanism in FIG. 37.

The drive mechanism will be described below. FIG. 37 is a cross-sectional front view of the drive mechanism in FIG. 19, FIG. 38 is a front view of the drive mechanism in FIG. 37, FIG. 39 is a lower side view of the drive mechanism in FIG. 37, FIG. 40 is a left side view of the drive mechanism in FIG. 37, FIG. 41 is an explanatory diagram of the developing-apparatus drive shaft shown in FIG. 37, FIGS. 42A through 42D present explanatory diagrams of a paddle shaft shown in FIG. 37, and FIGS. 43 and 44 are diagrams showing the structures of cams of the drive mechanism in FIG. 37.

Figure 38:
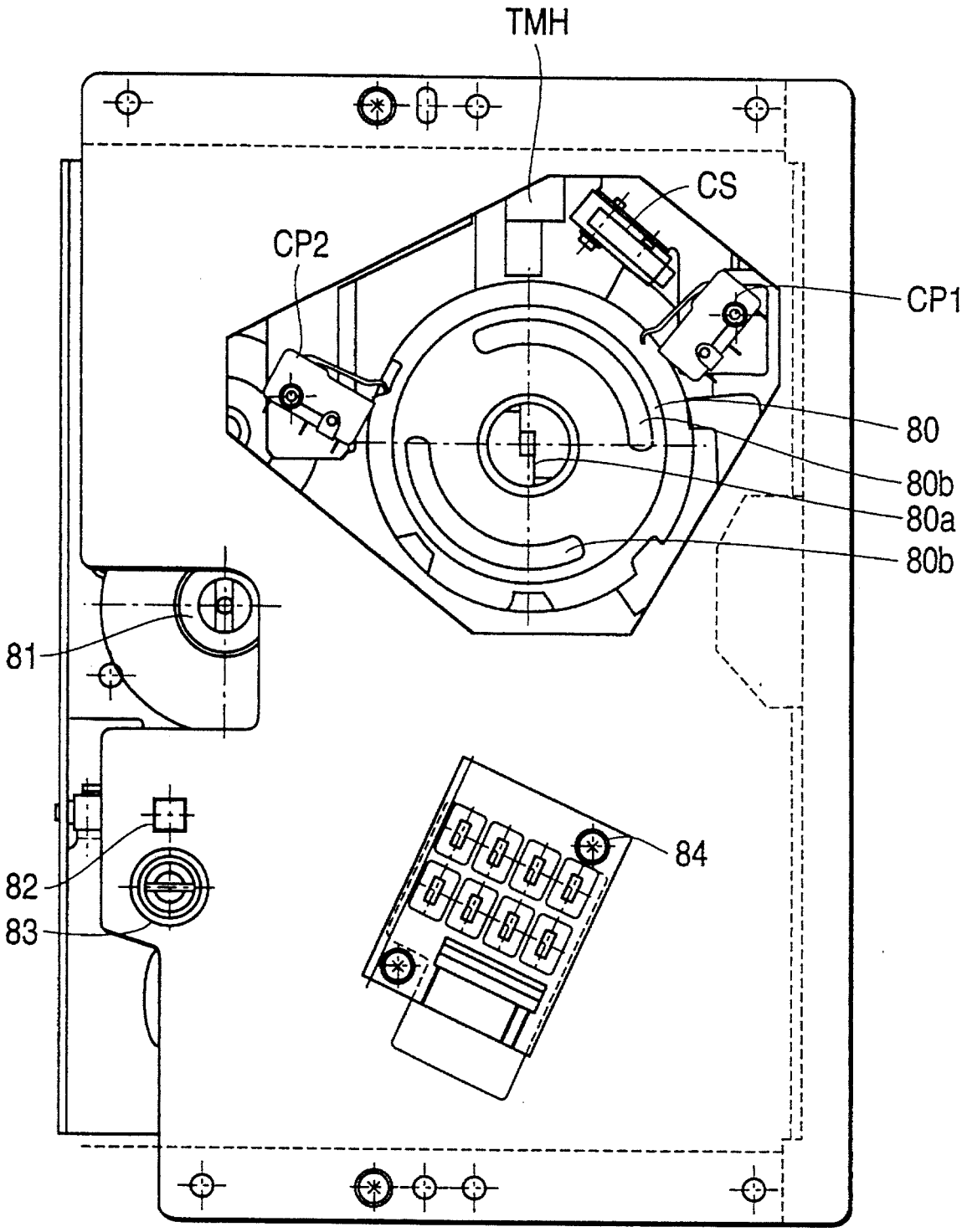
FIG. 38 is a front view of the drive mechanism in FIG. 37.

As shown in FIGS. 37 and 38, there is a single drive motor 85 which rotates a gear 89*a* of the developing-apparatus drive shaft 81 to thereby rotate the drive shaft 81. This drive shaft 81 drives a first cam 86 for the drive shaft 80 and a drive pulley 89*c* of a second cam 87 through a pulley 89*b* by means of a belt 88*a*. The second cam 87 drives a shutter opening/closing lever drive cam 82*a* and a drive gear 89*f* of the screw drive shaft 83 through pulleys 89*d* and 89*e* by means of a belt 88*b*.

The cartridge left position detecting switch CP1, new/old discriminating switch CS, a timing sensor TMH and the cartridge rightward position detecting switch CP2 are provided around this drive shaft 80. Below the drive shaft 80 is provided the characteristic detecting switch 84, as shown in FIG. 38.

Figure 39:
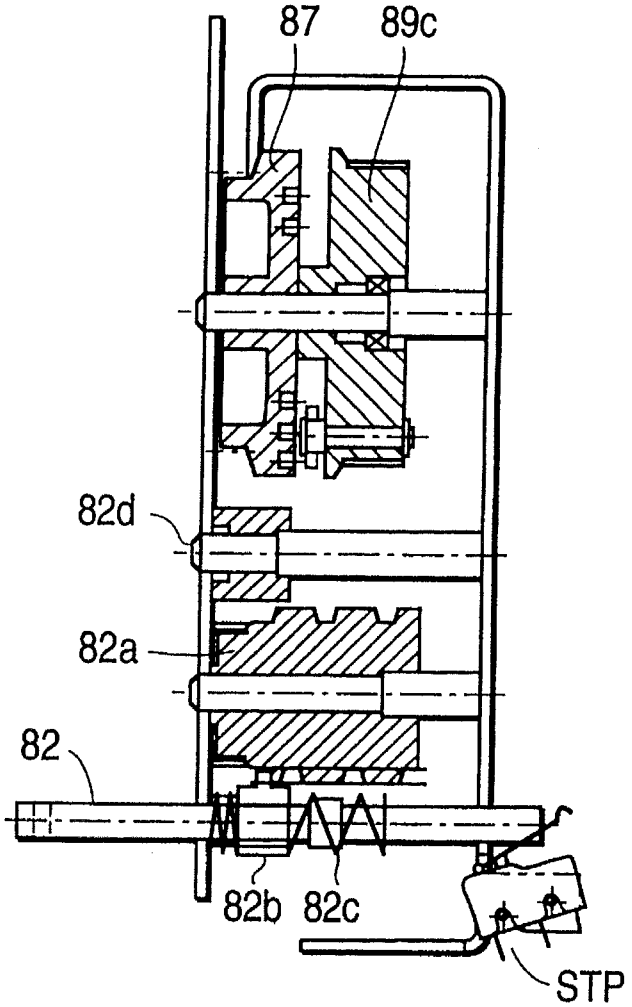
FIG. 39 is a lower side view of the drive mechanism in FIG. 37.
Figure 44:
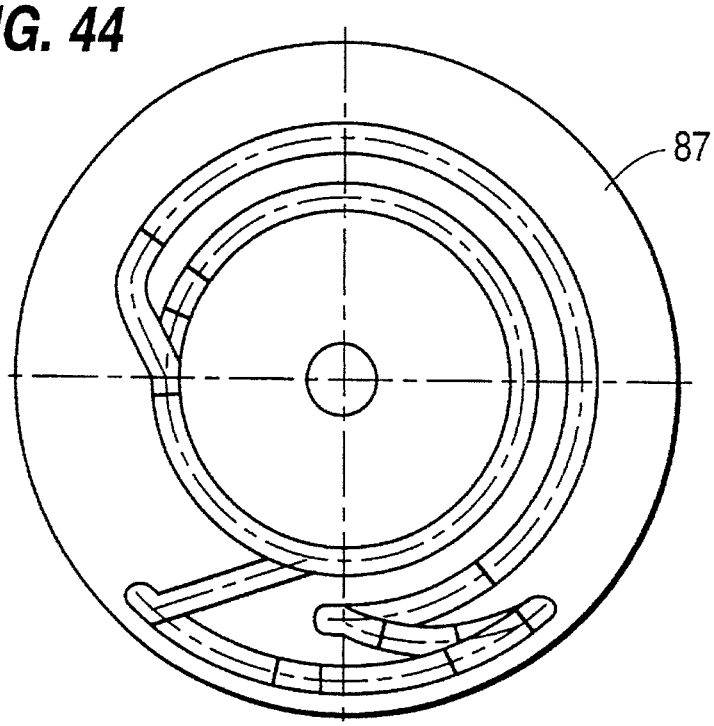

As shown in FIG. 39, the drive pulley 89*c*, which is driven by the belt 88*a*, has a pin that engages with a cam groove of the second cam 87 (see FIG. 44 for the groove). Accordingly, the shutter opening/closing lever drive cam 83*a* and the screw drive shaft 83 are driven. The shutter opening/closing lever 82 has an engagement metal fitting 82*b* and a spring 82*c*. As the metal fitting 82*b* moves along the cam groove of the drive cam 82*a* that is driven by the belt 88*b*, therefore, the shutter opening/closing lever 82 moves rightward and leftward in the diagram. The opening/closing of this shutter is detected by a shutter opening/closing detecting switch STP provided at the rear end of the shutter opening/closing lever 82.

As shown in FIG. 40, the drive pulley 86*a*, which is driven by the belt 88*a*, has a pin that engages with a cam groove of the first cam 86 (see FIG. 43 for the groove). The drive pulley 86*a* directly drives the paddle drive shaft 80*a*. The paddle drive shaft 80*a*, movable rightward and leftward in the diagram, is urged in the right direction in the diagram by a leaf spring 80*c*. This paddle shaft 80*a* has inclined projections 800 and 801 provided on the respective sides of a center recess 802, as shown in FIGS. 42A through 42D. When the paddle shaft 64*a* of the cartridge 5, which has a shape of a slotted screwdriver, is fitted in the recess 802 of the paddle drive shaft 80*a*, the paddle shaft 64a is driven by the inclined projections 800 and 801 with respect to the rightward turn in FIGS. 42A and 42B. With respect to the leftward turn, however, the paddle shaft 64*a* slides along the inclined surfaces of the inclined projections 800 and 801 so that the paddle drive shaft 80*a* shifts leftward in FIG. 40 against the force of the leaf spring 80*c*, inhibiting the driving of the paddle shaft 64*a*. In other words, the paddle drive shaft 80*a* and paddle shaft 80 constitute a one-way clutch.

The developing-apparatus drive shaft 81 comprises an intermediate member 81*a*, which has a horizontal projection with a shape of a slotted screwdriver at the left-hand end and a vertical projection with a shape of a slotted screwdriver at the right-hand end, and a drive shaft 81*b* having a vertical flat recess, with respect to the roller shaft 43 having a shape of a slotted screwdriver. Accordingly, the drive shaft 81 has a degree of freedom in the vertical and horizontal directions in the diagram, and can be driven in accordance with a change in the roller shaft 43 of the developing apparatus 4.

The inner drum 6, paddles 64 and 66, the toner supply roller 43, the developer discharge shutter 46 and the discharging screw 78 are sequentially driven by a single motor 85 in the above manner.

Figure 45:
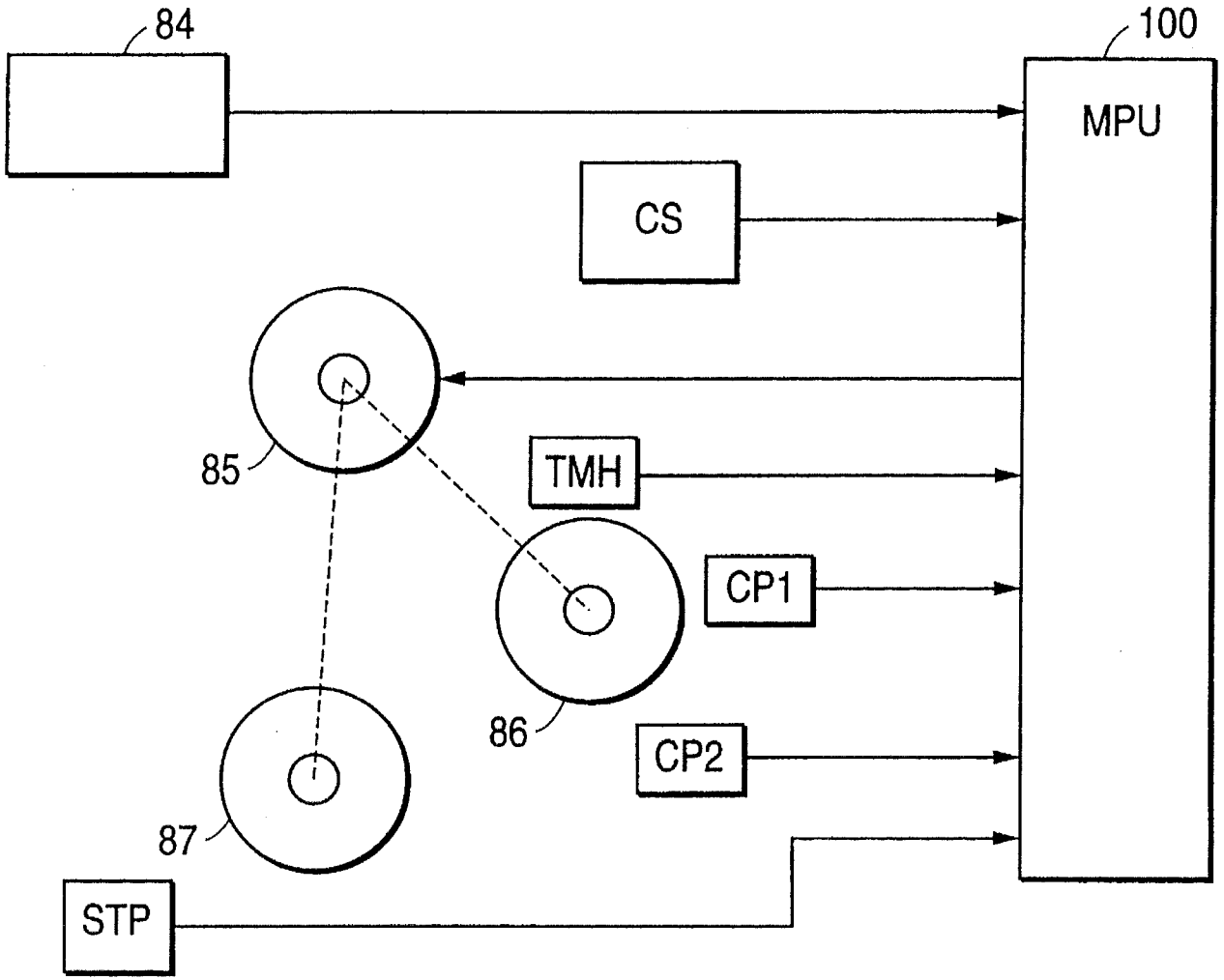
FIG. 45 is a control block diagram according to one embodiment of the present invention.
Figure 46:
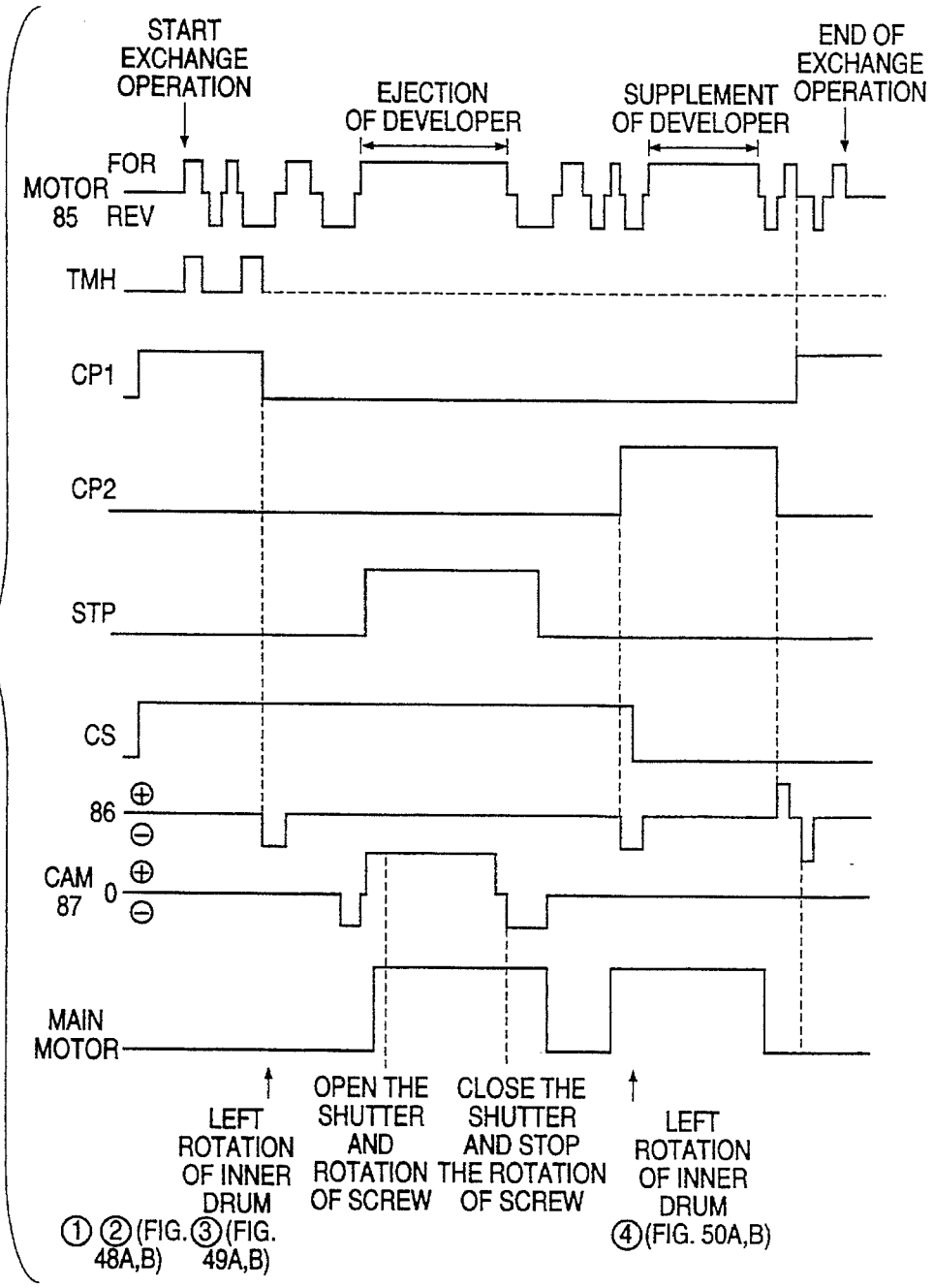
FIG. 46 and 47 present time charts for a developer exchanging operation according to one embodiment of the present invention.
Figure 47:
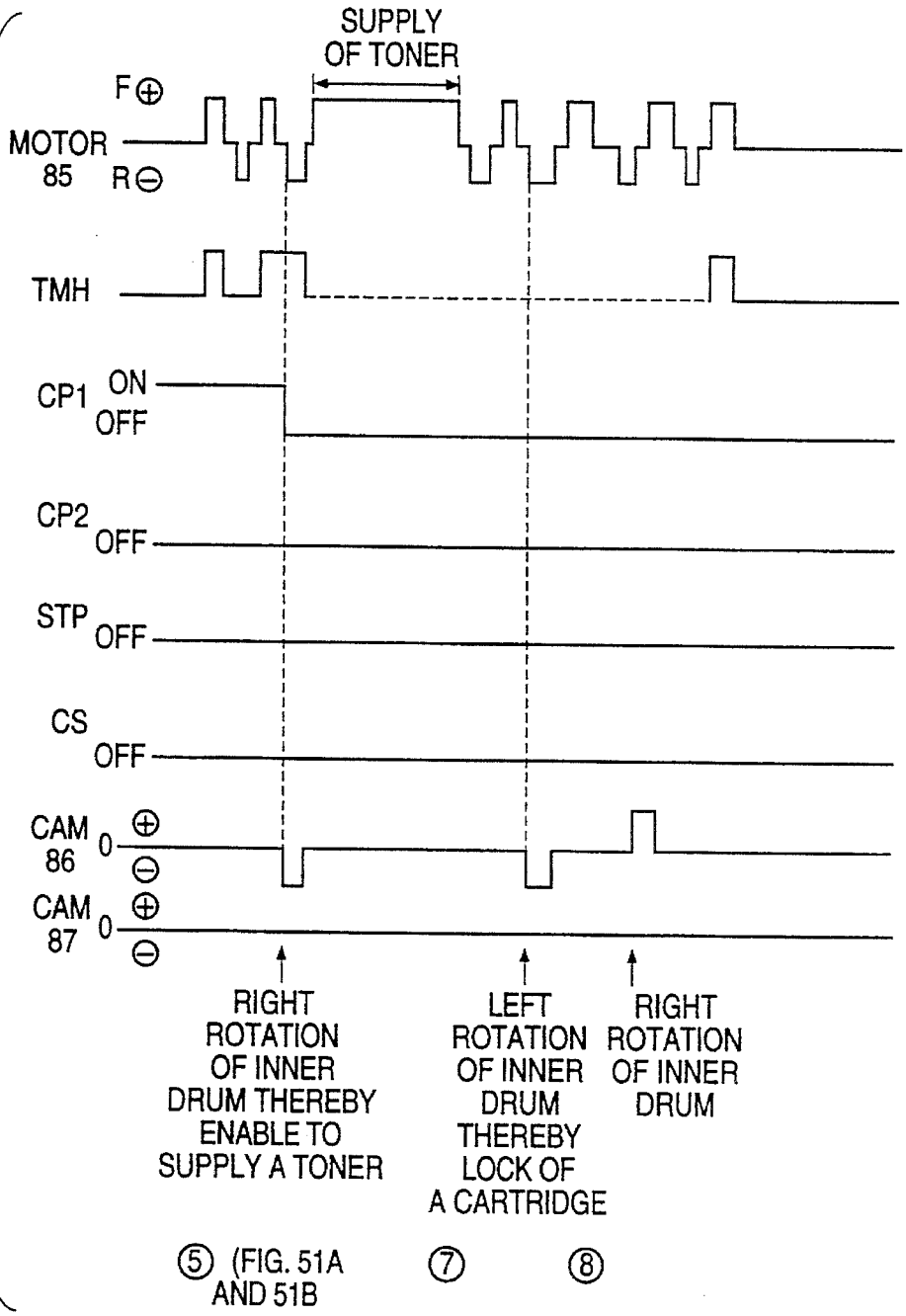

The operation of the drive mechanism will now be described. FIG. 45 is a control block diagram according to one embodiment of the present invention, FIG. 46 and 47 present time charts for a developer exchanging operation according to one embodiment of the present invention, FIGS. 48A, 48B, 49A, 49B, 50A, 50B, 51A and 51B present explanatory diagrams of a developer exchanging operation according to one embodiment of the present invention, and FIGS. 52A through 52D are diagrams for explaining the function of the cams in the developer exchanging operation.

Referring to FIG. 45, a control section 100, constituted of a microprocessor (MPU), detects the characteristics of the developer and toner from the output of the cartridge characteristic sensor 84 to control a precharging voltage, a developing bias voltage, etc., starts the exchanging sequence according to the output of the new/old discriminating switch CS, and controls the motor 85 based on the outputs of the timing sensor TMH, the cartridge right position detecting switch CP1, the cartridge left position detecting switch CP2 and the shutter opening/closing detecting switch STP.

The operation along the exchanging sequence of FIG. 31 will be described referring to FIGS. 46, 47 and 48 to 52. FIGS. 32 through 34 will also be referred to.

Figure 48B:
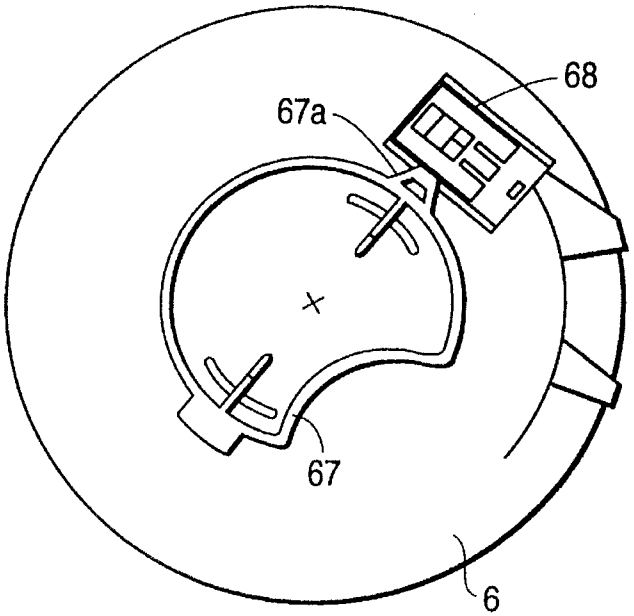
FIGS. 48A, 48B, 49A, 49B, 50A, 50B, 51A and 51B present explanatory diagrams of a developer exchanging operation according to one embodiment of the present invention.
Figure 48A:
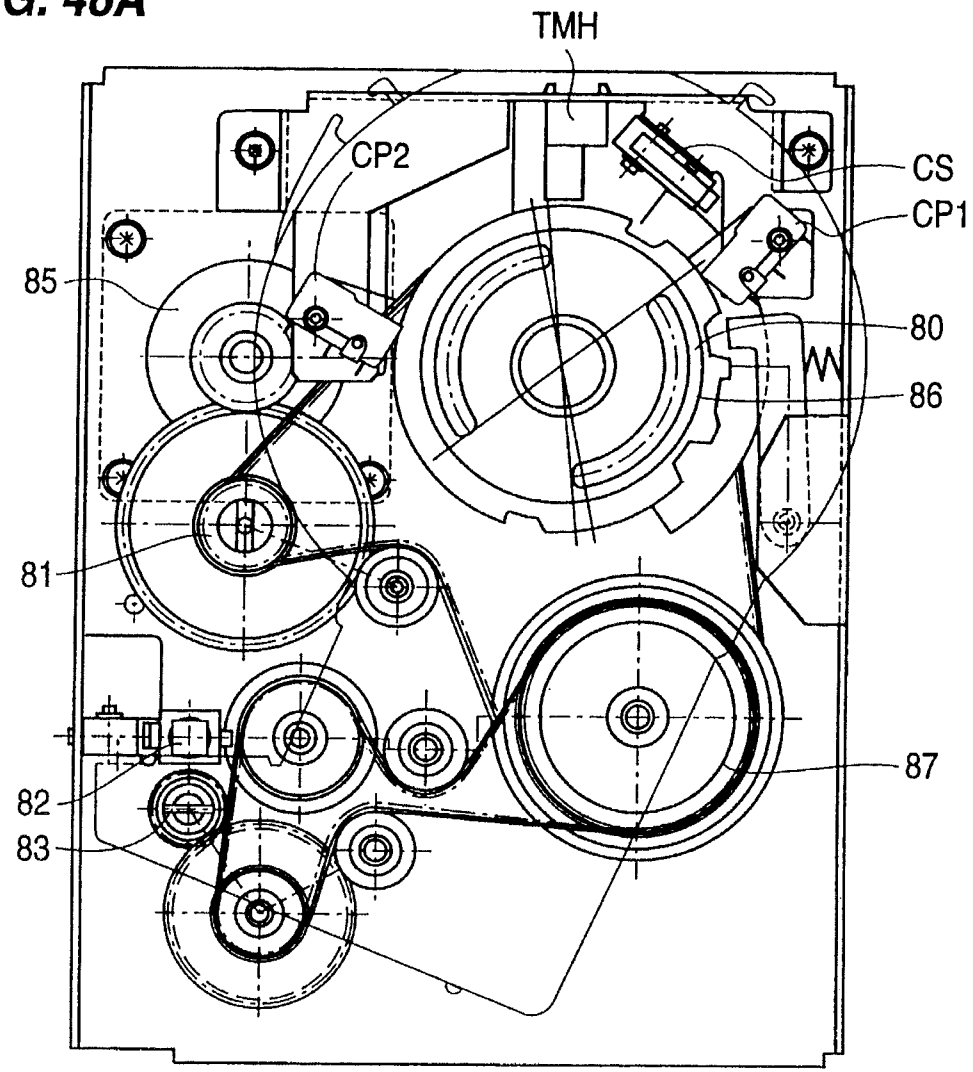
Figure 49B:
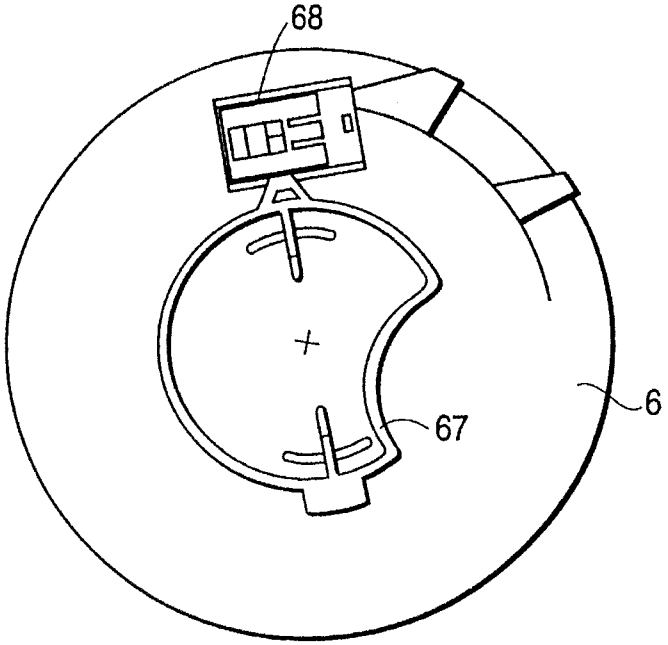
Figure 49A:
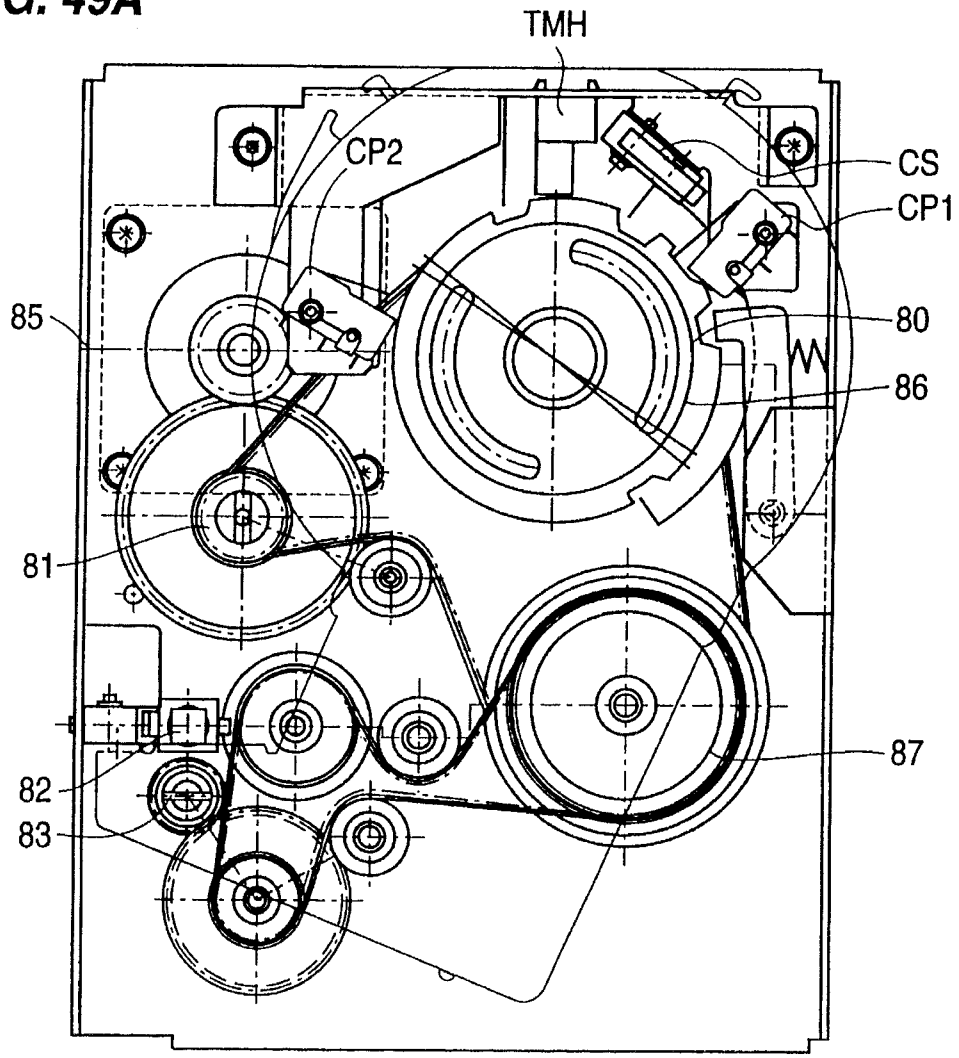

①, ② First, the operator mounts the cartridge 5 into the apparatus and rotates the inner drum 6 of the cartridge 5 rightward. As a result, the projection 67*a* of the rotatable engaging portion 67 of the inner drum 6 engages with the frame 9, locking the cartridge 5, and the projection 67*a* of the rotatable engaging portion 67 of the inner drum 6 sets the drive rightward rotational position switch CP1 on, as shown in FIG. 48B. At this time, the drive mechanism 8 comes in the state of FIG. 48A.

③ As the drive rightward rotational position switch CP1 is set on, the control section 100 starts the exchanging operation and repeats the forward and reverse rotations of the motor 85 twice. Consequently, the first cam 86 turns in the reverse direction (leftward) to turn the inner drum 6 leftward to the position shown in FIGS. 49A and 49B. This releases the state of the toner supply ports 65 of the inner drum 6 facing the tone injection ports 73 of the outer case 7 and closes the latter ports 73. Then, the control section 100 performs the forward and reverse rotations of the motor 85 once to turn the second cam 87 in the reverse direction. Next, the control section 100 turns the motor 85 in the forward direction to cause the forward turning of the second cam 87. As a result, the shutter opening/closing lever 82 is activated to drive the discharging screw 78 and causes the main motor to drive the developing apparatus 4 for one minute.

As a result, the developer in the developing apparatus 4 falls from the discharge port 45 of the developing apparatus into the waste developer storage room 71 through the collecting port 77 of the cartridge 5, and is discharged into the waste developer storage room 71 by the discharging screw 78, as shown in FIG. 33B, accomplishing the collection of the waste developer.

Then, after driving the developing apparatus 4 for one minute, the control section 100 rotates the motor 85 in the reverse direction, considering that the whole developer in the developing apparatus 4 have been collected. As a result, the second cam 87 turns in the reverse direction to activate the shutter opening/closing lever 82 to close the discharge shutter 46 of the developing apparatus 4. Then, the control section 100 stops causing the screw drive shaft 83 to drive the discharging screw 78, and stops driving the developing apparatus 4 by the main motor.

Figure 50B:
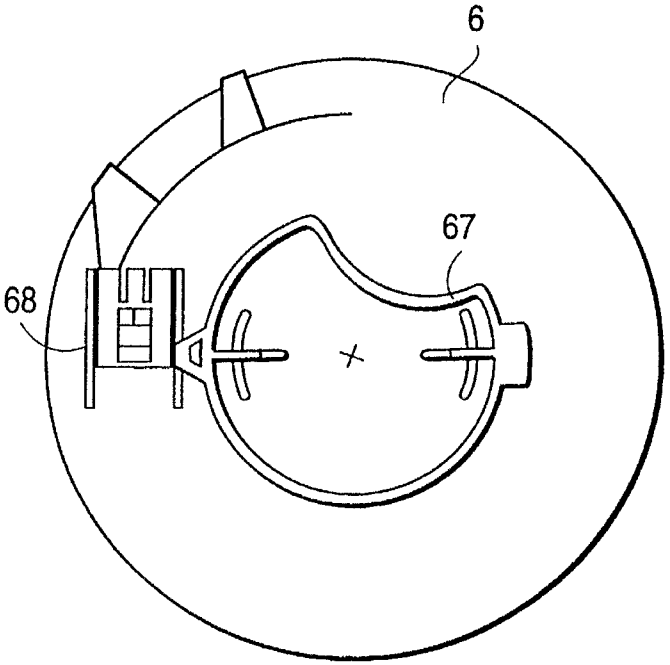
Figure 50A:
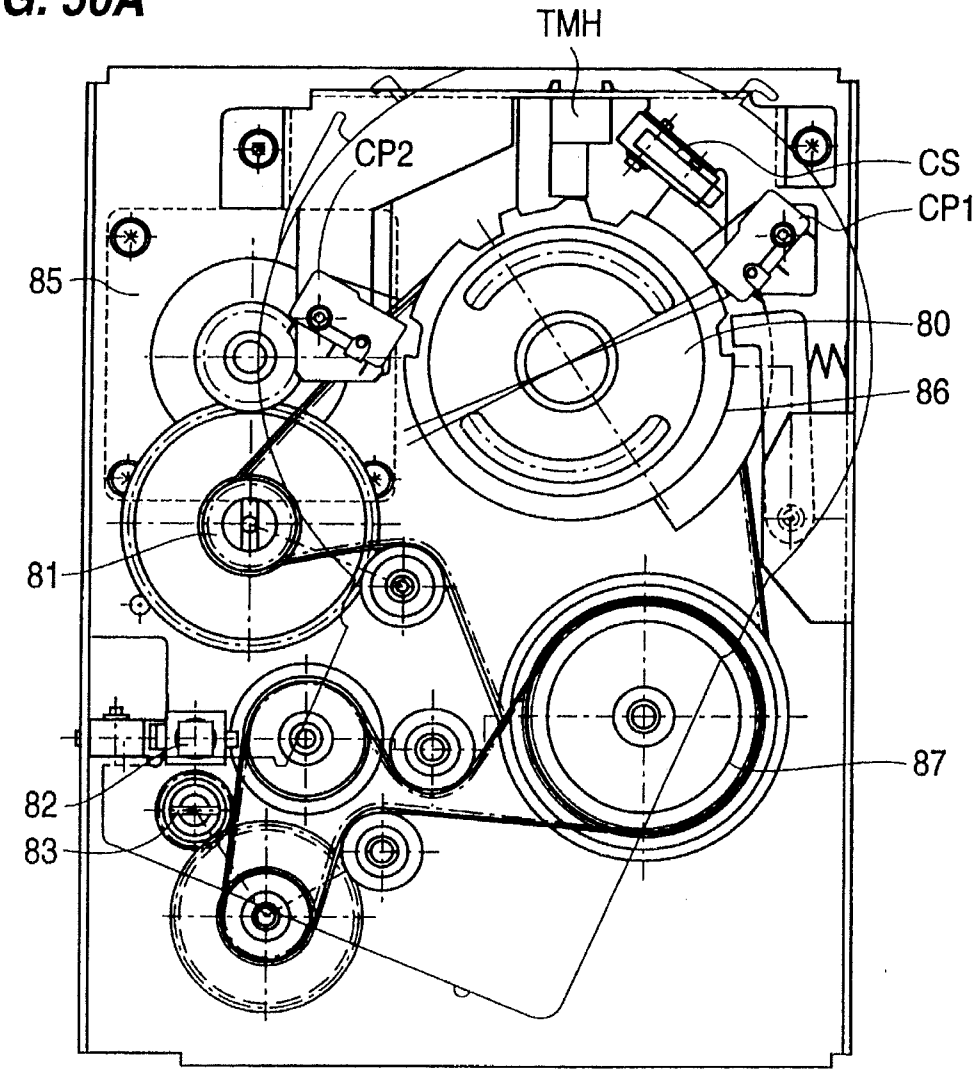

④ Next, the control section 100 repeats the forward and reverse rotations of the motor 85 twice to turn the first cam 86 in the reverse direction (leftward) so that the inner drum 6 rotates leftward as shown in FIGS. 50A and 50B. In other words, the inner drum 6 is turned until the drive left position switch CP2 is set on by the projection 67*a* of the rotatable engaging portion 67 of the inner drum 6. In this state, the developer injection ports 63 of the inner drum 6 face the developer injection ports 72 of the outer case 7 as shown in FIG. 33C. The control section 100 therefore causes the paddle drive shaft 80*a* to drive the paddle shaft 62, thereby rotating the paddle 64. Consequently, the developer in the developer storage room 60 in the inner drum 6 is supplied through the injection port 44 into the developing apparatus 4, and the developer exchanging operation will be terminated.

Figure 51B:
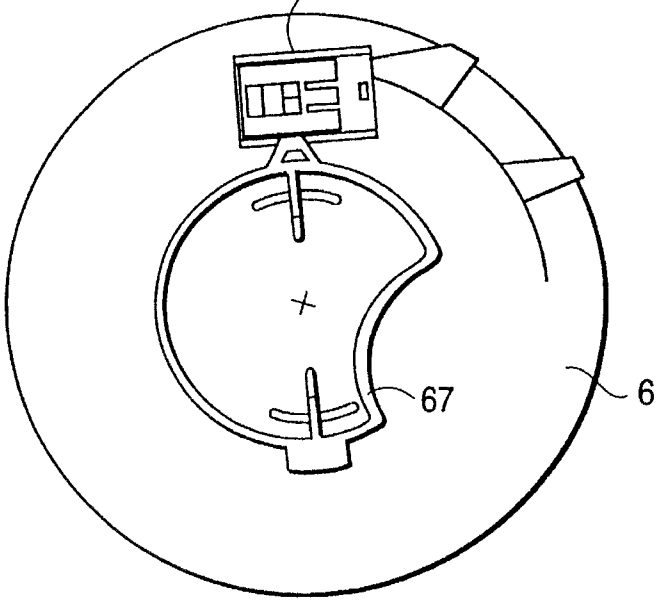
Figure 51A:
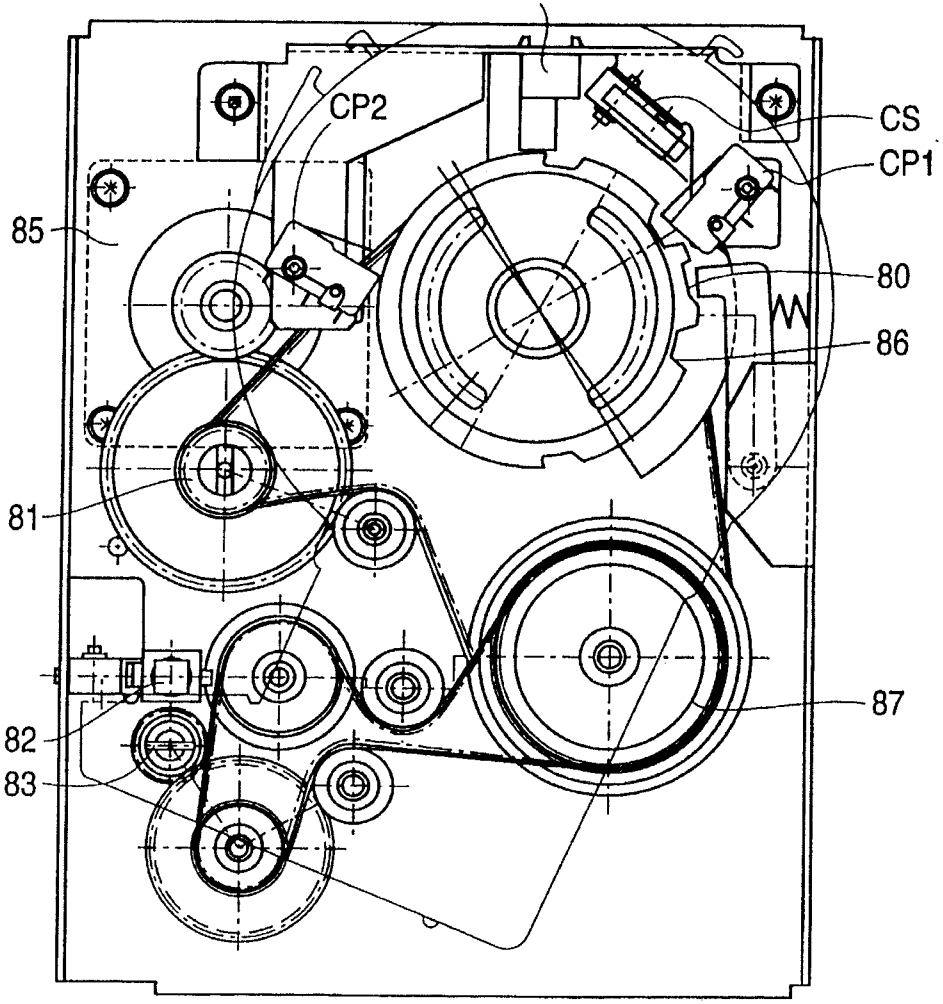

⑤ Then, the control section 100 repeats the forward and reverse rotations of the motor 85 twice to turn the first cam 86 in the reverse direction (rightward), thereby rotating the inner drum 6 until the drive right position switch CP1 is set on by the projection 67*a* of the rotatable engaging portion 67 of the inner drum 6, as shown in FIGS. 51A and 51B. Accordingly, the developer injection ports 63 of the inner drum 6 face the discharge port of the waste toner discharging section 36, as shown in FIG. 33D. The toner supply ports 65 of the inner drum 6 face the toner injection ports 73 of the outer case 7.

Consequently, the apparatus is ready for normally printing and the supplement of the toner and the collection of the waste tone are possible. That is, as the paddle shaft 62 is driven by the paddle drive shaft 80*a* to rotate the paddle 66, the toner is supplied to the toner supply roller 43 from the toner storage room 61. Under the toner density control, the control section 100 causes the developing-apparatus drive shaft 81 to rotate the toner supply roller 43 to supply the toner into the developing apparatus 4. Further, the waste toner from the cleaner 34 is collected into the developer storage room 60 of the cartridge 5 through the waste toner carrying pipe 35 and the waste toner discharging section 36.

⑥ When the toner empty is discriminated under the toner density control while supplementing the toner in the above manner, an exchange indication is given on the operator panel 14. The operator then depresses the exchange switch on the operator panel 14.

⑦ When detecting the depression of the exchange switch, the control section 100 performs the forward and reverse rotations of the motor 85 once to turn the first cam 86 in the reverse direction. Accordingly, the drive mechanism 8 rotates the inner drum 6 leftward to the position shown in FIG. 33E. As a result, the state of the toner supply ports 65 of the inner drum 6 facing the toner injection ports 73 of the outer case 7 is released, the latter ports 73 are closed and the cartridge 5 is locked.

In this state, the control section 100 causes the developing-apparatus drive shaft 81 to rotate the tone supply roller 43 to allow the residual toner at the injection port 44 of the developing apparatus 4 to be collected in the developing apparatus 4, thereby preventing the sputtering of the toner at the time the cartridge 5 is detached therefrom.

⑧ Thereafter, the control section 100 repeats the forward and reverse rotations of the motor 85 twice to turn the first cam 86 in the forward direction (rightward). Consequently, the inner drum 6 is rotated rightward so that the projection 67*a* of the rotatable engaging portion 67 of the inner drum 6 comes to the mounting hole 90 of the frame 9, as shown in FIG. 33F. This unlocks the cartridge 5 so that it can be detached.

In the above manner, the detachment of the cartridge 5, the exchange of the developer, the supplement of the toner, the rotation of the paddles, etc. can be accomplished by the functions of the cams 86 and 87 by controlling a single motor 85.

Figure 52A:
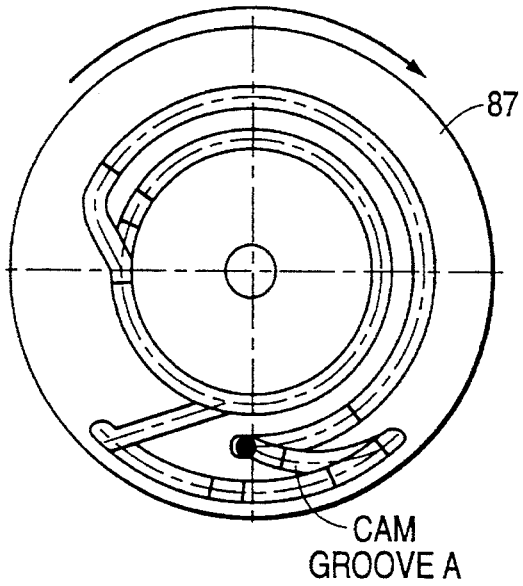
FIGS. 52A through 52D are diagrams for explaining the function of the cams in the developer exchanging operation.
Figure 52C:
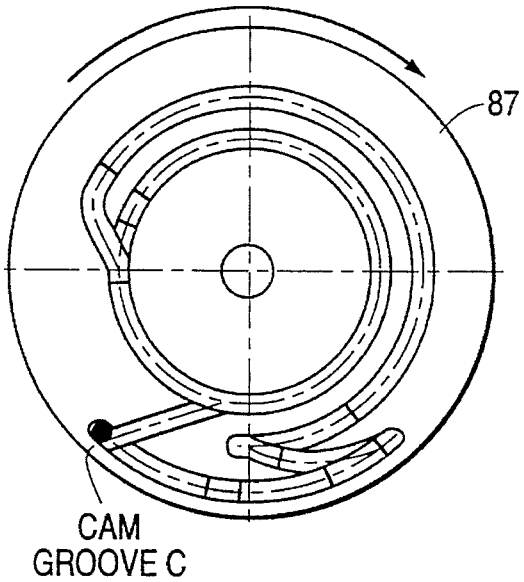
Figure 52B:
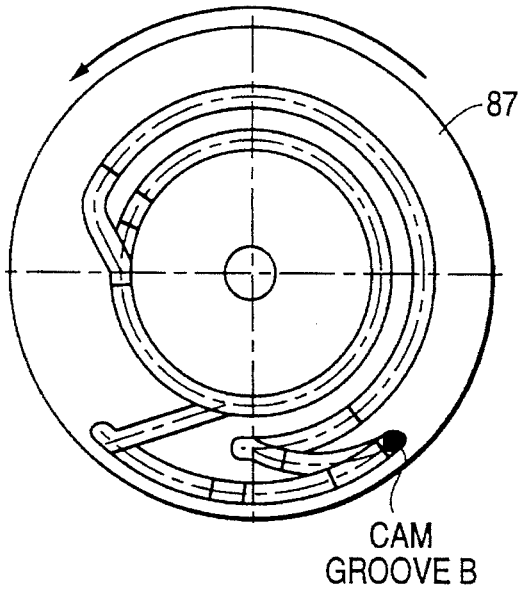
Figure 52D:
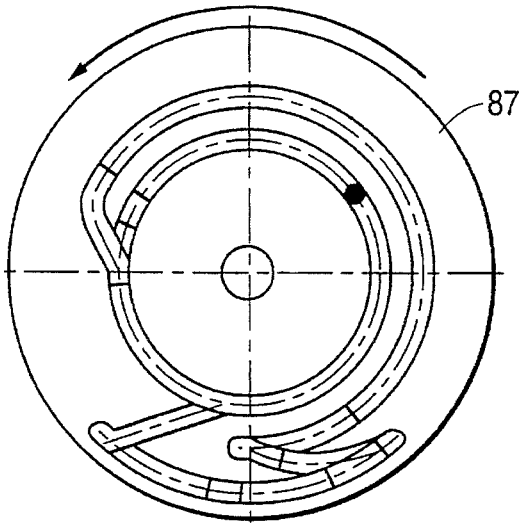

As shown in FIGS. 52A to 52D, the developer discharge shutter 46 is driven by the second cam 87. In other words, when the motor 85 rotates clockwise, the pin enters the cam 87 and the shutter 46 is kept closed (FIG. 52A). When the motor 85 rotates counterclockwise, the pin enters the cam groove B along the cam 87, and the shutter 46 is open (FIG. 52C). When the motor 85 further rotates counterclockwise, the pin is disengaged from the cam groove (FIG. 52D).

When an abnormality occurs in the image forming apparatus while the shutter 46 is open, the motor 85 is immediately stopped giving an alarm. In this case, the shutter 46 is kept open. Upon hearing the alarm, the user calls a service engineer from the maker or the like to attend to the problem. With the shutter 46 open, however, the service engineer cannot deal with the problem and should close it. Since the opening/closing of the shutter is performed by the cam 87, the service engineer, if he does not know the function of the cam 87, cannot set the shutter closed. In such a case, the service engineer should replace the drive mechanism with a new one or should manually close the shutter, spending a couple of hours, while checking it with an available technical engineer.

To avoid such a problem, therefore, even when an abnormality of the apparatus is detected with the shutter open, the apparatus will not be stopped immediately, but after the drive mechanism 8 closes the shutter and gives an alarm.

Instead of this measure, it is possible to add a sequence to drive the drive mechanism to close the shutter through the operation of the operator panel and stop the apparatus, when an abnormality of the apparatus is detected with the shutter open.

The present invention may further be modified as follows.

① Although the image forming apparatus in the foregoing description of this embodiment has been explained as an electronic photographing mechanism, this invention may also be used in other printing mechanisms involving toner development (e.g., an electrostatic recording mechanism).

② Although the inner drum of the cartridge is bisected into right and left sections, it may be divided into top and bottom sections.

③ Although the drive mechanism 8 is constituted of a single motor, it may use two or more driving sources.

In short, as the paddles are provided in the developer storage room in this invention, it is unnecessary to provide the developer storage room on the developing apparatus. This design feature can make the cartridge having both the developer storage room and waste developer storage room compact. Further, since the cartridge can be arranged beside the developing apparatus, free space can be utilized without using the space around the photosensitive drum, thus contributing to making the apparatus more compact.

What is claimed is:

1. A developer cartridge for exchanging developers comprising:

a first developer storage room for storing an unused developer;

a second developer storage room located under said first developer storage room for storing a used developer;

openings respectively formed in said first and second developer storage rooms;

shutters respectively provided at said openings;

paddling means disposed in said first developer storage room for paddling said unused developer in said first developer storage room;

said second developer storage room having a projecting block where said opening and said shutter are provided;

and a carrying screw, having a carrying direction, provided below said opening of said projecting block of said second developer storage room, for carrying said used developer to said second developer storage room, the carrying direction of said used developer by said carrying screw being parallel with a surface of said shutter.

2. A developer cartridge for exchanging developers comprising:

a first developer storage room for storing an unused developer;

a second developer storage room located under said first developer storage room for storing a used developer;

openings respectively formed in said first and second developer storage rooms;

shutters respectively provided at said openings;

paddling means disposed in said first developer storage room for paddling said unused developer in said first developer storage room;

said first developer storage room having a arcuate lower portion where said opening is provided;

and wherein said first developer storage room includes a rotatable inner drum having a supply port constituting said shutter and an outer case having said opening for retaining said inner drum.

3. A developer cartridge for exchanging developers comprising:

a first developer storage room for storing an unused developer;

a second developer storage room located under said first developer storage room for storing a used developer;

openings respectively formed at an area of said first and second developer storage rooms;

shutters respectively provided at said openings; and paddling means, spaced away from the opening formed in the first developer storage room, disposed in said first developer storage room for paddling said unused developer from the interior of said first developer storage room toward the opening formed at the area of said first developer storage room, wherein said first developer storage room having a third developer storage room for storing said unused developer and a toner storage room for storing a toner to be supplemented, and wherein said first developer storage room includes:

an inner drum having said third developer storage room having a first supply port constituting said shutter and a toner storage room having a second supply port constituting said shutter; and an outer case, having a first opening for said third developer storage room and a second opening for said toner storage room, for retaining said inner drum.

4. A developer cartridge for exchanging developers comprising:

a first developer storage room for storing an unused developer;

a second developer storage room located under said first developer storage room for storing a used developer;

opening respectively formed at an area of said first and second developer storage rooms;

shutters respectively provided at said openings; and paddling means disposed in said first developer storage room for paddling said unused developer from the interior of said first developer storage room toward the opening formed at the area of said first developer storage room, wherein said first developer storage room has a third developer storage room for storing said unused developer and a toner storage room for storing a toner to be supplemented, and wherein said first developer storage room includes:

an inner drum having said third developer storage room having a first supply port constituting said shutter and a toner storage room having a second supply port constituting said shutter; and an outer case, having a first opening for said third developer storage room and a second opening for said toner storage room, for retaining said inner drum.

5. The developer cartridge according to claim 4, wherein said first supply port is shifted from said second supply port in said inner drum in a rotational direction thereof.

6. The developer cartridge according to claim 4, wherein said unused developer storage room and said toner storage room are provided on right and left portions of said inner drum in a lengthwise direction.

7. The developer cartridge according to claim 6, further comprising first padding means for padding an unused developer in said unused developer storage room, second paddling means for paddling a toner in said toner storage room, and a rotational shaft shared by said first and second paddling means.

8. An image forming apparatus comprising:

an endless latent carrier;

means for forming an electrostatic latent image on said endless latent carrier;

developing means for developing said electrostatic latent image on said endless latent carrier;

a developer cartridge detachably attached to said developing means for exchanging developers and arranged opposite to said latent carrier, said developer cartridge having a first developer storage room for storing an unused developer, a second developer storage room located under said first developer storage room for storing a used developer, openings respectively formed in said first and second developer storage rooms, shutters respectively provided at said openings, and paddling means, spaced apart from the opening formed in the first developer storage room, disposed in said first developer storage room for paddling said unused developer from the interior of said first developer storage room toward the opening formed therein; and drive means for driving said shutters of said attached developer cartridge, for exchanging a used developer with an unused developer; wherein said developing means has a discharging port for a developer and a discharge shutter at a lower portion of said developing means, wherein said second developer storage room for said developer cartridge has a protruding block provided with said opening and said shutter, for allowing said opening to face said discharging port when said developer cartridge is attached to said developing means, wherein said first developer storage room of said developer cartridge includes:

an inner drum having a first developer storage room having a supply port constituting said shutter; and an outer case having an opening for said first developer storage room, for retaining said inner drum, and wherein said drive mechanism rotates said inner drum.

9. The image forming apparatus according to claim 8, wherein said second developer storage room of said developer cartridge has a bottom inclined with respect to that face of said protruding block where said opening is formed.

10. The image forming apparatus according to claim 8, wherein said drive means has a projection provided at said developing means and a drive mechanism for driving said first shutter of said first developer storage room and said discharge shutter of said developing means to cause said developer cartridge, when attached to said developing means, to engage with said second shutter of said second developer storage room to thereby open said shutter.

11. An image forming apparatus comprising:

an endless latent carrier;

means for forming an electrostatic latent image on said endless latent carrier;

developing means for developing said electrostatic latent image on said endless latent carrier;

a developer cartridge detachably attached to said developing means for exchanging developers and arranged opposite to said latent carrier, said developer cartridge having a first developer storage room for storing an unused developer, a second developer storage room located under said first developer storage room for storing a used developer, openings respectively formed in said first and second developer storage rooms, shutters respectively provided at said openings, and paddling means disposed in said first developer storage room for paddling said unused developer from the interior of said first developer storage room toward the opening formed therein;

drive means for driving said shutters of said attached developer cartridge, for exchanging a used developer with an unused developer; and wherein said developing means has a discharging port for a developer and a discharge shutter at a lower portion of said developing means; and said second developer storage room for said developer cartridge has a protruding block provided with said opening and said shutter, for allowing said opening to face said discharging port when said developer cartridge is attached to said developing means, wherein said developer cartridge includes a carrying screw provided below said opening of said protruding block of said second developer storage room, for carrying said developer to said second developer storage room.

12. An image forming apparatus comprising:

an endless latent carrier;

means for forming an electrostatic latent image on said endless latent carrier;

developing means for developing said electrostatic latent image on said endless latent carrier;

a developer cartridge detachably attached to said developing means for exchanging developers and arranged opposite to said latent carrier, said developer cartridge having a first developer storage room for storing an unused developer, a second developer storage room located under said first developer storage room for storing a used developer, openings respectively formed in said first and second developer storage rooms, shutters respectively provided at said openings, and paddling means disposed in said first developer storage room for paddling said unused developer in said first developer storage room;

drive means for driving said shutters of said attached developer cartridge, for exchanging a used developer with an unused developer, and wherein said first developer storage room of said developer cartridge includes a rotatable inner drum having a supply port constituting said shutter and an outer case having said opening for retaining said inner drum; and wherein said drive mechanism rotates said inner drum.

13. The image forming apparatus according to claim 12, further comprising:

cleaner means for removing residual toner on said endless latent carrier; and toner carrying means for carrying said toner removed by said cleaner means to said first developer storage room.

14. The image forming apparatus according to claim 13, wherein said outer case of said developer cartridge has a collecting port at a position facing a discharge port of said toner carrying means.

15. The image forming apparatus according to claim 14, wherein said drive means rotates said inner drum in such a way that after said supply port of said first developer storage room is made to face said injection port of said developing means and an unused developer is supplied to said developing means, said supply port of said first developer storage room is made to face said collecting port of said outer case.

16. An image forming apparatus comprising:

an endless latent carrier;

means for forming an electrostatic latent image on said endless latent carrier;

developing means for developing said electrostatic latent image on said endless latent carrier;

a developer cartridge detachably attached to said developing means for exchanging developers and arranged opposite to said latent carrier, said developer cartridge having a first developer storage room for storing an unused developer, a second developer storage room located under said first developer storage room for storing a used developer, openings respectively formed in said first and second developer storage rooms, shutters respectively provided at said openings, and paddling means, spaced away from the opening formed in the first developer storage room, disposed in said first developer storage room for paddling said unused developer from the interior of said first developer storage room toward the opening formed therein; and drive means for driving said shutters of said attached developer cartridge, for exchanging a used developer with an unused developer, wherein said first developer storage room of said developer cartridge has a third developer storage room for storing said unused developer and a fourth developer storage room for storing a toner to be supplemented, wherein said first developer storage room of said developer cartridge includes:

an inner drum having a third developer storage room having a first supply port constituting said shutter and a fourth developer storage room having a second supply port constituting said shutter; and an outer case having a first opening for said third developer storage room and a second opening for said fourth developer storage room, for retaining said inner drum, and wherein said drive mechanism rotates said inner drum.

17. An image forming apparatus comprising:

an endless latent carrier;

means for forming an electrostatic latent image on said endless latent carrier;

developing means for developing said electrostatic latent image on said endless latent carrier;

a developer cartridge detachably attached to said developing means for exchanging developers and arranged opposite to said latent carrier, said developer cartridge having a first developer storage room for storing an unused developer, a second developer storage room located under said first developer storage room for storing a used developer, openings respectively formed in said first and second developer storage rooms, shutters respectively provided at said openings, and paddling means disposed in said first developer storage room for paddling said unused developer from the interior of said first developer storage room toward the opening formed therein;

drive means for driving said shutters of said attached developer cartridge, for exchanging a used developer with an unused developer, and wherein said first developer storage room of said developer cartridge has a third developer storage room for storing said unused developer and a fourth developer storage room for storing a toner to be supplemented, wherein said first developer storage room of said developer cartridge includes:

an inner drum having a third developer storage room having a first supply port constituting said shutter and a fourth developer storage room having a second supply port constituting said shutter; and an outer case having a first opening for said third developer storage room and a second opening for said fourth developer storage room, for retaining said inner drum; and wherein said drive mechanism rotates said inner drum.

18. The image forming apparatus according to claim 17, wherein said first supply port of said developer cartridge is shifted from said second supply port in said inner drum in a rotational direction thereof.

19. The image forming apparatus according to claim 18, wherein said third developer storage room and said fourth developer storage room of said developer cartridge are provided on right and left portions of said inner drum in a lengthwise direction.

20. The image forming apparatus according to claim 19, wherein said developer cartridge further includes first paddling means for paddling an unused developer in said third developer storage room, second paddling means for paddling a toner in said fourth developer storage room, and a rotational shaft shared by said first and second paddling means.

21. A developer cartridge for exchanging developers comprising:

a first developer storage room for storing an unused developer;

a second developer storage room located under said first developer storage room for storing a used developer;

openings respectively formed at an area of said first and second developer storage rooms;

shutters respectively provided at said openings; and paddling means, spaced away from the opening formed in the first developer storage room, disposed in said first developer storage room for paddling said unused developer from the inside of said first developer storage room toward the opening formed at the area of said first developer storage room, wherein said first developer storage room includes a rotatable inner drum having a supply port constituting said shutter and an outer case having said opening for retaining said inner drum.

22. A developer cartridge according to claim 21, wherein said second developer storage room has a projected block where said opening and one of said shutters is provided.

23. A developer cartridge as in claim 22, wherein said second developer storage room has a bottom inclined with respect to said face of said protruding block where said opening is formed.

24. A developer cartridge as in claim 21, wherein said first developer storage room has an arcuate lower portion where said opening is provided.

25. A developer cartridge as in claim 21, wherein said first developer storage room has a third developer storage room for storing said unused developer and a fourth developer storage room for storing a toner to be supplemented.

26. A developer cartridge for exchanging developers comprising:

a first developer storage room for storing an unused developer;

a second developer storage room located under said first developer storage room for storing a used developer;

openings respectively formed at an area of said first and second developer storage rooms;

shutters respectively provided at said openings;

paddling means disposed in said first developer storage room for paddling said unused developer from the inside of said first developer storage room toward the opening formed at the area of said first developer storage room, wherein said developer storage room has a projecting block where said opening and one of said shutters is provided; and a carrying screw, having a carrying direction, provided below said opening of said projecting block of said second developer storage room, for carrying said used developer to said second developer storage room, the carrying direction of said used developer by said carrying screw being parallel with a surface of said shutter.

27. A developer cartridge for exchanging developers comprising:

a first developer storage room for storing an unused developer;

a second developer storage room located under said first developer storage room for storing a used developer;

openings respectively formed at an area of said first and second developer storage rooms;

shutters respectively provided at said openings; and paddling means disposed in said first developer storage room for paddling said unused developer from the inside of said first developer storage room toward the opening formed at the area of said first developer storage room, wherein said first developer storage room has an accurate lower portion where said opening is provided, and wherein said first developer storage room includes a rotatable inner drum having a supply port constituting said shutter and an outer case having said opening for retaining said inner drum.

28. A developer cartridge for exchanging developers comprising:

a first developer storage room for storing an unused developer;

a second developer storage room located under said first developer storage room for storing a used developer;

openings respectively formed at an area of said first and second developer storage rooms;

shutters respectively provided at said openings; and paddling means disposed in said first developer storage room for paddling said unused developer from the inside of said first developer storage room toward the opening formed at the area of said first developer storage room, wherein said first developer storage room has a third developer storage room for storing said unused developer and a fourth developer storage room for storing a toner to be supplemented, and wherein said first developer storage room includes:

an inner drum having a third developer storage room having a first supply port constituting said shutter and a fourth developer storage room having a second supply port constituting said shutter; and an outer case having a first opening for said third developer storage room and a second opening for said fourth developer storage room, for retaining said inner drum.

29. A developer cartridge as in claim 28, wherein said first supply port is shifted from said second supply port in said inner drum in a rotational direction thereof.

30. A developer cartridge as in claim 28, wherein said third developer storage room and said fourth developer storage room are provided on right and left portions of said inner drum in a lengthwise direction.

31. A developer cartridge as in claim 30, further comprising first paddling means for paddling an unused developer in said third developer storage room, second paddling means for paddling a toner in said fourth developer storage room, and a rotational shaft shared by said first and second paddling means.

32. An image forming apparatus comprising:

an endless latent carrier;

means for forming an electrostatic latent image on said endless latent carrier;

developing means for developing said electrostatic latent image on said endless latent carrier by using a toner;

a developer cartridge detachably attached to said developing means for exchanging developers, and having a first developer storage room for storing an unused developer including at least a carrier which is used for carrying the toner, a second developer storage room located under said first developer storage room for storing a used developer, openings respectively formed in said first and second developer storage rooms, shutters respectively provided at said openings, and paddling means, spaced away from the opening formed in the first developer storage room, disposed in said first developer storage room for paddling said unused developer from the interior of said first developer storage room toward the openings formed therein; and drive means for driving said shutters of said attached developer cartridge, for exchanging a used developer with an unused developer, wherein said first developer storage room of said developer cartridge includes a rotatable inner drum having a supply port constituting said shutter and an outer case having said opening for retaining said inner drum, and wherein said drive mechanism rotates said inner drum.

33. An image forming apparatus as in claim 32, wherein said developer cartridge is arranged opposite to said latent carrier of said developing means.

34. An image forming apparatus as in claim 33, wherein said developing means has a discharging port for a developer and a discharge shutter at a lower portion of a body of said developing means; and said second developer storage room of said developer cartridge has a protruding block provided with said opening and said shutter, for allowing said opening to face said discharging port when said developer cartridge is attached to said developing means.

35. An image forming apparatus as in claim 34, wherein said second developer storage room of said developer cartridge has a bottom inclined with respect to that face of said protruding block where said opening is formed.

36. An image forming apparatus as in claim 34, wherein said drive means has a projection provided at said developing means and a drive mechanism for driving said first shutter of said first developer storage room and said discharge shutter of said developing means to cause said developer cartridge, when attached to said developing means, to engage with said second shutter of said second developer storage room to thereby open said shutter.

37. An image forming apparatus as in claim 33, wherein said first developer storage room of said developer cartridge has an arcuate lower portion where said opening is provided; and said developing means has an injection port at a position facing said opening.

38. An image forming apparatus comprising:

an endless latent carrier;

means for forming an electrostatic latent image on said endless latent carrier;

developing means for developing said electrostatic latent image on said endless latent carrier by using a toner;

a developer cartridge detachably attached to said developing means for exchanging developers, and having a first developer storage room for storing an unused developer including at least a carrier which is used for carrying the toner, a second developer storage room located under said first developer storage room for storing a used developer, openings respectively formed in said first and second developer storage rooms, shutters respectively provided at said openings, and paddling means disposed in said first developer storage room for paddling said unused developer from the interior of said first developer storage room toward the openings formed therein; and drive means for driving said shutters of said attached developer cartridge, for exchanging a used developer with an unused developer, wherein said developer cartridge is arranged opposite to said latent carrier of said developing means, wherein said developing means has a discharging port for a developer and a discharge shutter at a lower portion of a body of said developing means, wherein said second developer storage room of said developer cartridge has a protruding block provided with said opening and said shutter, for allowing said opening to face said discharging port when said developer cartridge is attached to said developing means, and wherein said developer cartridge includes a carrying screw provided below said opening of said protruding block of said second developer storage room, for carrying said used developer to said second developer storage room.

39. An image forming apparatus comprising:

an endless latent carrier;

means for forming an electrostatic latent image on said endless latent carrier;

developing means for developing said electrostatic latent image on said endless latent carrier by using a toner;

a developer cartridge detachably attached to said developing means for exchanging developers, and having a first developer storage room for storing an unused developer including at least a carrier which is used for carrying the toner, a second developer storage room located under said first developer storage room for storing a used developer, openings respectively formed in said first and second developer storage rooms, shutters respectively provided at said openings, and paddling means disposed in said first developer storage room for paddling said unused developer from the interior of said first developer storage room toward the openings formed therein; and drive means for driving said shutters of said attached developer cartridge, for exchanging a used developer with an unused developer, wherein said developer cartridge is arranged opposite to said latent carrier of said developing means, and wherein said first developer storage room of said developer cartridge includes a rotatable inner drum having a supply port constituting said shutter and an outer case having said opening for retaining said inner drum; and wherein said drive mechanism rotates said inner drum.

40. An image forming apparatus as in claim 39, wherein said first developer storage room of said developer cartridge has a third developer storage room for storing said unused developer and a fourth developer storage room for storing a toner to be supplemented.

41. An image forming apparatus as in claim 39, wherein said first developer storage room of said developer cartridge includes:

an inner drum having a third developer storage room having a first supply port constituting said shutter; and an outer case having a first opening for said third developer storage room and a second opening for said fourth developer storage room, for retaining said inner drum; and wherein said drive mechanism rotates said inner drum.

42. An image forming apparatus as in claim 41, wherein said first supply port of said developer cartridge is shifted from said second supply port in said inner drum in a rotational direction thereof.

43. An image forming apparatus as in claim 42, wherein said third developer storage room and said fourth developer storage room of said developer cartridge are provided on right and left portions of said inner drum in a lengthwise direction.

44. An image forming apparatus as in claim 43, wherein said developer cartridge further includes first paddling means for paddling an unused developer in said third developer storage room, second paddling means for paddling a toner in a said fourth developer storage room, and a rotational shaft shared by said first and second paddling means.

45. An image forming apparatus as in claim 39, further comprising:

cleaner means for removing a residual toner on said endless latent carrier; and toner carrying means for carrying said toner removed by said cleaner means to said first developer storage room.

46. An image forming apparatus as in claim 45, wherein said outer case of said developer cartridge has a collecting port at a position facing a discharge port of said toner carrying means.

47. An image forming apparatus as in claim 46, wherein said drive means rotates said inner drum in such a way that after said supply port of said first developer storage room is made to face said injection port of said developing means and an unused developer is supplied to said developing means, said supply port of said first developer storage room is made to face said collecting port of said outer case.

* * * * *